US009284142B2

(12) United States Patent
Takematsu et al.

(10) Patent No.: US 9,284,142 B2
(45) Date of Patent: Mar. 15, 2016

(54) SHEET PROCESSING APPARATUS AND IMAGE FORMING SYSTEM

(71) Applicant: CANON KABUSHIKI KAISHA, Tokyo (JP)

(72) Inventors: Koji Takematsu, Abiko (JP); Kazuhisa Okuda, Tokyo (JP); Kenjiro Sugaya, Moriya (JP); Shutaro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/220,430

(22) Filed: Mar. 20, 2014

(65) Prior Publication Data

US 2014/0205317 A1 Jul. 24, 2014

Related U.S. Application Data

(63) Continuation of application No. PCT/JP2013/078723, filed on Oct. 23, 2013.

(30) Foreign Application Priority Data

Oct. 30, 2012 (JP) ..... 2012-238500

(51) Int. Cl.
*G03G 21/16* (2006.01)
*B65H 5/06* (2006.01)
(Continued)

(52) U.S. Cl.
CPC ..... *B65H 5/068* (2013.01); *B65H 7/02* (2013.01); *B65H 29/125* (2013.01); *G03G 15/6576* (2013.01); *G03G 21/16* (2013.01); *B65H 2403/72* (2013.01); *B65H 2404/14* (2013.01); *B65H 2404/143* (2013.01); *B65H 2511/20* (2013.01); *B65H 2515/32* (2013.01); *B65H 2801/06* (2013.01)

(58) Field of Classification Search
None
See application file for complete search history.

(56) References Cited

U.S. PATENT DOCUMENTS 6,318,716 B1 11/2001 Okuda
6,338,481 B1 * 1/2002 Maruchi ..... 271/188
(Continued)

FOREIGN PATENT DOCUMENTS

JP 05-058500 A 3/1993
JP 05-150679 A 6/1993
(Continued)

OTHER PUBLICATIONS

IDS Transmittal Letter with Statement of Relevance relating to JP 2012-24953A.
(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

In order to correct a corrugation caused when a sheet widthwise edge portion elongates more than the vicinity of the center in a sheet feeding direction, a sheet processing apparatus includes: a fixing portion that fixes a toner image onto a sheet by heating, a plurality of pairs of rollers provided along a sheet feeding direction with an interval in the downstream of the fixing portion in the feeding direction to nip and convey a sheet; and a tensioning device that applies a tensile strength of the sheet feeding direction to a sheet in a center area of a width direction perpendicular to the sheet feeding direction.

25 Claims, 50 Drawing Sheets

(51) Int. Cl.

| | |
|---|---|
| ***G03G 15/00*** | (2006.01) |
| ***B65H 7/02*** | (2006.01) |
| ***B65H 29/12*** | (2006.01) |

(56) References Cited

U.S. PATENT DOCUMENTS

| | | | | |
|---|---|---|---|---|
| 7,424,261 | B2 | 9/2008 | Uchida et al. | |
| 7,684,745 | B2 | 3/2010 | Uchida et al. | |
| 8,219,907 | B2 | 7/2012 | Kohlmeier et al. | |
| 2006/0206798 | A1 | 9/2006 | Kohlmeier et al. | |
| 2007/0048048 | A1* | 3/2007 | Kougami et al. | 399/341 |
| 2007/0201892 | A1* | 8/2007 | Ando et al. | 399/68 |
| 2007/0280765 | A1* | 12/2007 | Shida et al. | 399/406 |
| 2009/0003912 | A1 | 1/2009 | Nagasaki et al. | |
| 2009/0074495 | A1* | 3/2009 | Shiraki et al. | 399/407 |
| 2009/0190982 | A1* | 7/2009 | Yamamoto | 399/406 |
| 2009/0212488 | A1* | 8/2009 | Hashimoto et al. | 271/226 |
| 2010/0032895 | A1* | 2/2010 | Sahara et al. | 271/314 |
| 2011/0116852 | A1* | 5/2011 | Ogushi | 399/341 |
| 2011/0305245 | A1 | 12/2011 | Tanaka et al. | |

FOREIGN PATENT DOCUMENTS

| | | | |
|---|---|---|---|
| JP | 3084692 | B2 | 7/2000 |
| JP | 2006-154609 | A | 6/2006 |
| JP | 2006-182537 | A | 7/2006 |
| JP | 2009-007079 | A | 1/2009 |
| JP | 2009-202994 | A | 9/2009 |
| JP | 2009-268972 | A | 11/2009 |
| JP | 2010-058980 | A | 3/2010 |
| JP | 2012-024953 | A | 2/2012 |
| JP | 5025350 | B2 | 6/2012 |
| JP | 5132358 | B2 | 11/2012 |
| JP | 5349836 | B2 | 8/2013 |

OTHER PUBLICATIONS

Certified Partial English Translation of paragraphs [0032] through [0058] of JP 2012-24953A.

* cited by examiner

FIG. 9A

DATA ABOUT SHEET P OUTPUT BY USING FIXING DEVICE (WITHOUT SHEET CORRUGATION CORRECTING DEVICE)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 420.4 | 0 |
| MAXIMUM CORRUGATION LENGTH X max [mm] | 0.4 | 3.3 | |
| MAXIMUM CURL LENGTH Y max [mm] | 0.0 | 5.0 | |

FIG. 9B

DATA ABOUT SHEET P OUTPUT BY USING SHEET CORRUGATION CORRECTING DEVICE (WITHOUT CURL CORRECTION)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 421.0 | 0.6 |
| MAXIMUM CORRUGATION LENGTH X max [mm] | 0.4 | 1.0 | |
| MAXIMUM CURL LENGTH Y max [mm] | 0.0 | 10.0 | |

FIG. 9C

DATA ABOUT SHEET P OUTPUT BY USING SHEET CORRUGATION CORRECTING DEVICE (WITH CURL CORRECTION)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 421.0 | 0.6 |
| MAXIMUM CORRUGATION LENGTH X max [mm] | 0.4 | 1.0 | |
| MAXIMUM CURL LENGTH Y max [mm] | 0.0 | 1.0 | |

TURN OFF CLUTCH

TURN ON CLUTCH

FIG. 18A

VALUES AFTER SHEET PASSES THROUGH FIXING DEVICE (300 m/s)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 420.4 | 0 |
| MAXIMUM CORRUGATION LENGTH X max [mm] | 0.4 | 3.3 | |

FIG. 18B

VALUES AFTER SHEET PASSES THROUGH FIXING DEVICE (300 m/s) AND SHEET CONVEYING DEVICE

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 420.8 | 0.4 |
| MAXIMUM CORRUGATION LENGTH X max [mm] | 0.4 | 1.7 | |

FIG. 18C

VALUES AFTER SHEET PASSES THROUGH FIXING DEVICE (300 m/s), MOISTURE APPLYING DEVICE, AND SHEET CONVEYING DEVICE

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 421.0 | 0.6 |
| MAXIMUM CORRUGATION LENGTH X max [mm] | 0.4 | 1.0 | |

TURN ON PRESSURE RELEASE

TURN OFF PRESSURE RELEASE

FIG. 50A

DATA ABOUT SHEET P OUTPUT BY USING FIXING DEVICE (WITHOUT SHEET CORRUGATION CORRECTING DEVICE)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 420.4 | 0 |
| MAXIMUM CORRUGATION LENGTH X max [mm] | 0.4 | 3.3 | |
| MAXIMUM CURL LENGTH Y max [mm] | 0.0 | 5.0 | |

FIG. 50B

DATA ABOUT SHEET P OUTPUT BY USING SHEET CORRUGATION CORRECTING DEVICE (WITHOUT FAN)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 421.0 | 0.6 |
| MAXIMUM CORRUGATION LENGTH X max [mm] | 0.4 | 1.0 | |
| MAXIMUM CURL LENGTH Y max [mm] | 0.0 | 10.0 | |

FIG. 50C

DATA ABOUT SHEET P OUTPUT BY USING SHEET CORRUGATION CORRECTING DEVICE (WITHOUT FAN)

| | INITIAL STATE | AFTER DISCHARGE | ELONGATION LENGTH |
|---|---|---|---|
| EDGE LENGTH L edge [mm] | 420.4 | 421.0 | 0.6 |
| CENTER LENGTH L center [mm] | 420.4 | 421.0 | 0.6 |
| MAXIMUM CORRUGATION LENGTH X max [mm] | 0.4 | 1.0 | |
| MAXIMUM CURL LENGTH Y max [mm] | 0.0 | 1.0 | |

SHEET PROCESSING APPARATUS AND IMAGE FORMING SYSTEM

BACKGROUND OF THE INVENTION

1. Field of the Invention

The present invention relates to a sheet processing apparatus and an image forming system having the sheet processing apparatus, such as a copying machine, a printer, and a facsimile.

2. Description of the Related Art

In the related art, an image forming apparatus using an electrophotographic system develops a latent image formed on a photosensitive drum as an image bearing member to visualize it. This visualized image (toner image) is transferred onto a sheet using an electrostatic force. Then, the toner image on the sheet is fixed by applying heat and pressure so that an image is recorded and formed on the sheet.

As a fixing device for such an image forming apparatus, a heat roller fixing method is employed, in which a heat source such as a heater is internally provided, and a fixing nip portion is formed with a fixing roller maintained at a predetermined temperature and an elastic pressure roller making pressed contact with the fixing roller, so that a toner image is fixed onto a sheet in the fixing nip portion.

In recent years, in an image forming apparatus (particularly, a full-color image forming apparatus) including such a type of the fixing device, there is known a fixing device capable of increasing a heating time and increasing a fixing speed in order to improve a chromogenic property or image quality of a toner image. For example, as discussed in Japanese Patent Laid-Open No. 5-150679, there is known a so-called belt nip type fixing device in which an endless fixing belt stretching around a plurality of rollers makes pressed contact with a heating roller.

In addition, in recent years, there is a demand for a high process speed in order to obtain a high-speed output image forming apparatus. For this purpose, it is necessary to provide a wider nip in a width direction perpendicular to a sheet feeding direction. In addition, a belt fixing method has been proposed and commercially produced, in which a wider nip width is obtained by substituting one or both of the fixing roller and the pressure roller with an endless belt.

SUMMARY OF THE INVENTION

However, since heat and pressure are applied to a sheet having a transferred toner image in a heat-fixing process of such a fixing device, moisture inside a sheet is evaporated in the pressed nip portion after the pressed nipping. A change of the moisture amount caused by applying heat to a sheet in this case and a stress caused by applying pressure to a sheet generate a curl by which a sheet is bent or a corrugation by which a sheet is undulated.

Here, sheet-like paper most widely employed as a sheet will be described in a fiber level. Paper is formed by weaving short fibers, and moisture is contained inside fibers or in gaps between fibers. In addition, fibers and water have an equilibrium state while making a hydrogen bonding to maintain flatness.

However, as heat and pressure are applied to paper in a fixing process, the bonding between fibers is deteriorated due to the pressure. If heat is applied in this state, and moisture is evaporated, another hydrogen bonding is generated between fibers, and the paper is deformed. If this paper is left as it is, it absorbs moisture from the atmosphere and tries to return to its original state by cutting the hydrogen bonding between fibers.

However, moisture is not absorbed into some bonding between fibers of paper. As a result, the deformation of paper is maintained. A deformation pattern includes a curl and a corrugation as described above. A curl is generated due to an expansion/contraction difference between front and rear sides of a paper sheet. A corrugation is generated due to an expansion/contraction difference between a center portion and an edge portion of a paper sheet.

First, a corrugation in an edge portion of a sheet is generated while the sheet passes through a nip portion of the fixing device. For example, in the case of a fixing device having a wide nip such as a belt fixing method, a conveyance speed inside a nip portion in the edge side is set to be higher than that in the center side of the width direction perpendicular to the sheet feeding direction in order to prevent a sheet from being folded while the sheet passes through the nip portion. If an ironing effect is applied to the sheet as a result, the sheet edge side passing through the nip portion elongates in the sheet feeding direction relative to the vicinity of the center. As a result, a corrugation is generated in the edge portion of the sheet.

Second, a corrugation in an edge portion of a sheet is generated after the sheet passes through a nip portion of the fixing device. While sheets are loaded in a bundle state, each sheet adjoins the atmosphere in the edge portion. Therefore, moisture rapidly accesses the sheet in the edge portion. If moisture is rapidly absorbed in the edge portion of the sheet after heat is applied to the sheet in a fixing process, and moisture inside the sheet is evaporated, the edge portion of the sheet also elongates in the feeding direction relative to the vicinity of the center. As a result, a corrugation is generated in the edge portion of the sheet.

In particular, in a belt fixing method in which a wide nip width is obtained by substituting one or both of the fixing roller and the pressure roller with an endless belt, a distance or time where the sheet stays in the nip increases relative to a heat roller method. Therefore, a corrugation may become significant in an edge portion of a sheet.

In this regard, the invention has been made to correct a corrugation caused when an edge portion of the width direction of a sheet elongates in a feeding direction relative to the vicinity of the center.

According to an aspect of the invention, there is provided a sheet processing apparatus that processes a sheet, including: a plurality of pairs of rollers provided along a sheet feeding direction with an interval to nip and convey a sheet; and a tensioning device that applies a tensile strength of the sheet feeding direction to a sheet in a center area of a width direction perpendicular to the sheet feeding direction.

According to another aspect of the invention, there is provided an image forming system including: a transfer portion that transfers a toner image onto a sheet; a fixing portion that fixes the transferred toner image on a sheet by heating; and the sheet processing apparatus that processes a sheet and having the aforementioned configuration.

According to the present invention, a sheet widthwise center portion elongates in a sheet feeding direction by applying a tensile strength of the sheet feeding direction to a sheet widthwise center area. Therefore, it is possible to align a length of the sheet widthwise center portion in the sheet feeding direction and a length of the sheet widthwise edge portion in the sheet feeding direction. As a result, it is possible to equalize the sheet center length and the sheet edge length and correct a corrugation in a sheet edge portion.

Further features of the present invention will become apparent from the following description of exemplary embodiments with reference to the attached drawings.

BRIEF DESCRIPTION OF THE DRAWINGS

FIGS. 9A to 9C are tables showing sheet states in experiments.

FIGS. 18A to 18C are tables showing sheet states in experiments.

FIGS. 50A to 50C are tables showing sheet states in experiments.

DESCRIPTION OF THE EMBODIMENTS

Hereinafter, exemplary embodiments of the invention will be described in detail with reference to the accompanying drawings. It would be appreciated that features such as dimensions, materials, shapes, relative distributions, and the like of components described in the following embodiments may be appropriately changed depending on a configuration of an apparatus of the invention and various conditions. They are not intended to limit the scope of the invention unless specified otherwise.

Embodiment 1

An image forming apparatus having a sheet processing apparatus according to Embodiment 1 will be described with reference to FIGS. 1 to 10. In the following description, the image forming apparatus will be described first, and the sheet processing apparatus will be described later. In Embodiment 1, an image forming system having a sheet processing apparatus connected to the exterior of the image forming apparatus will be described. However, the invention is also effectively applicable to an image forming system having a sheet processing apparatus integrated into the inside of the image forming apparatus.

Figure 1:
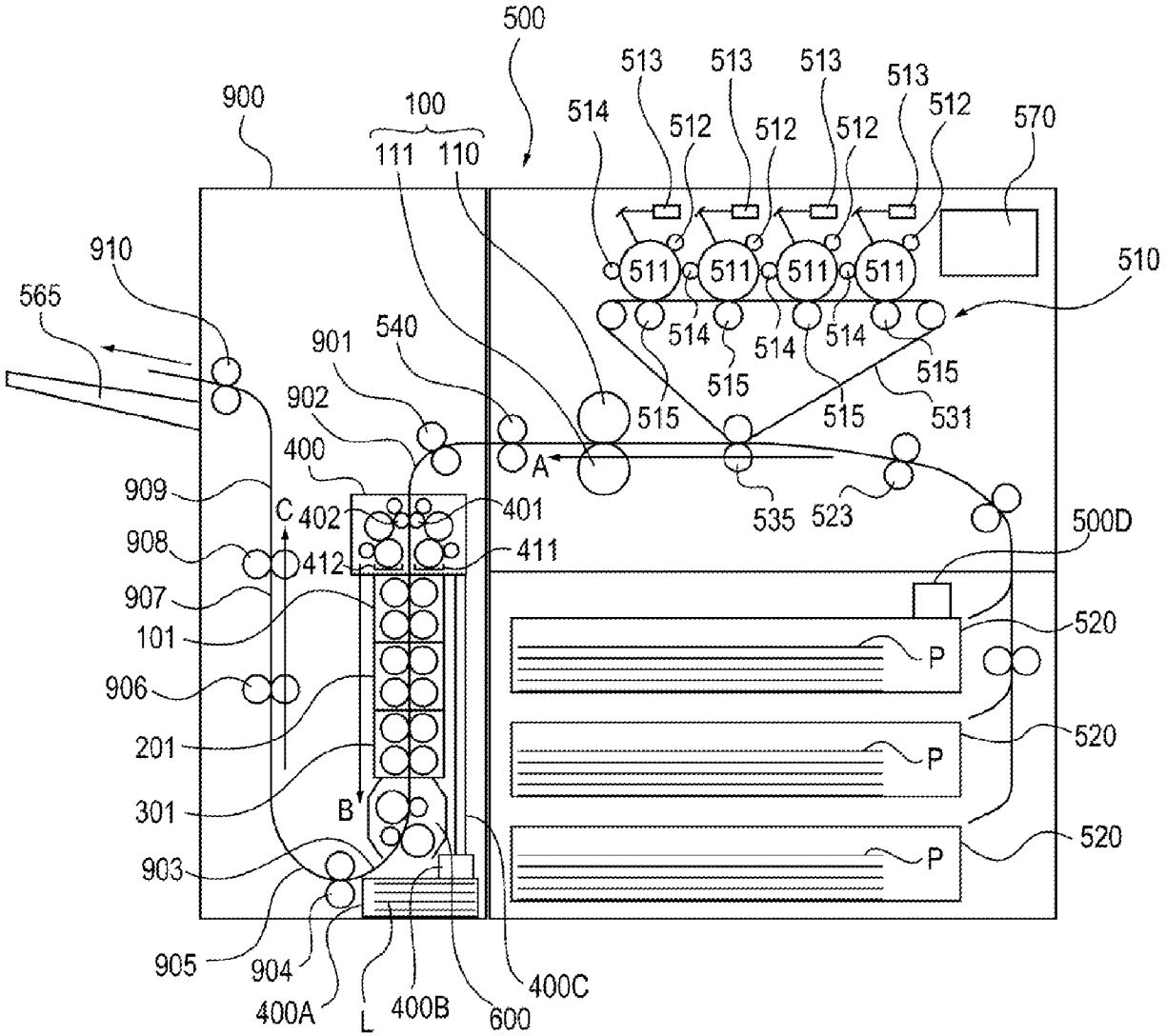
FIG. 1 is a cross-sectional view illustrating an electrophotographic printer in Embodiment 1.

First, a description will be made for an image forming apparatus as an example of an image forming system and a sheet processing apparatus detachably attached to the image forming apparatus with reference to FIG. 1. FIG. 1 is a cross-sectional view schematically illustrating a color electrophotographic printer 500 as an example of the image forming apparatus and a sheet corrugation correcting device 900 having a moisture adding device and a tensioning device as an example of the sheet processing apparatus along a sheet feeding direction. Note that the color electrophotographic printer will be simply referred to as a printer in the following description.

A toner image is formed on a sheet. Specifically, the sheet may include, for example, a plain paper sheet, a resin sheet as a substitute of the plain paper sheet, a thick paper sheet, an overhead projector applicable sheet, and the like.

The printer 500 of FIG. 1 has an image forming portion 510 for each color of yellow (Y), magenta (M), cyan (C), and black (Bk). In the image forming portion 510 for each color, toner images of each color are formed on a sheet. In addition, an endless intermediate transfer belt 531 as an intermediate transfer member is arranged to face the image forming portion. That is, a visible image forming apparatus is employed, in which processes until visualization are executed in parallel for each color.

It is noted that an arrangement sequence of the image forming portions for each color of Y, M, C, and K is not limited to that illustrated in FIG. 1. In addition, the embodiment may also be applicable to a monochromatic image forming apparatus without limiting to a full-color intermediate transfer type image forming apparatus of FIG. 1.

In the image forming portion 510 for each color, each process unit is provided as follows. For each color of Y, M, C, and K, an electrophotographic photosensitive element (hereinafter, referred to as a photosensitive drum) 511 as an image bearing member for bearing an electrostatic latent image on a surface, a charging roller 512, a laser scanner 513, and a development device 514 are provided. The photosensitive drum 511 is charged by the charging roller 512 in advance. Then, the photosensitive drum 511 is exposed by the laser scanner 513 to form a latent image. The latent image is developed by the development device 514 and is visualized as a toner image.

In a primary transfer portion including the photosensitive drum 511 and a primary transfer roller 515, each toner image formed and borne on a surface of the photosensitive drum 511 is primarily transferred onto an intermediate transfer belt 531 by the primary transfer roller 515 in a sequentially superimposed manner.

Meanwhile, sheets P are fed from a sheet cassette 520 one by one to a pair of registration rollers 523. The pair of registration rollers 523 receives the sheet P once and corrects a skew in the case of skew feeding. In addition, the pair of registration rollers 523 feeds the sheet P to a secondary transfer portion between the intermediate transfer belt 531 and a secondary transfer roller 535 in synchronization with the toner image on the intermediate transfer belt 531. The color toner images on the intermediate transfer belt 531 are secondarily transferred onto the sheet P, for example, by the secondary transfer roller 535 as a transfer portion in a collective manner.

Then, the sheet having the image (toner image) formed by the image forming portion as described above is conveyed to a fixing device 100. In the fixing device (fixing portion) 100, the toner image on the sheet is fixed by applying heat and pressure to the unfixed toner image by nipping the sheet in a fixing nip portion. The sheet passing through the fixing device 100 is fed by a pair of discharge rollers 540 to a sheet corrugation correcting device 900 as a sheet processing apparatus for processing the sheet. Then, a corrugation on the sheet is corrected by the sheet corrugation correcting device 900, and the sheet is discharged to a discharge tray 565.

Here, the fixing device will be described. The fixing device 100 includes a fixing roller 110 as a heating rotating member and a pressure roller 111 as a pressing rotating member. The fixing roller 110 applies heat generated from an internal halogen heater (not illustrated) to a toner on the sheet P and conveys the sheet P in cooperation with the pressure roller 111. The fixing roller 110 has a halogen heater embedded into a metal core made of an aluminum cylindrical tube, for example, having an outer diameter of 56 mm and an inner diameter of 50 mm. An elastic layer made of a silicon rubber, for example, having a thickness of 2 mm and a hardness of 45° (Asker-C) is coated on a surface of the metal core, and a heat-resistant toner parting layer made of perfluoroalkoxy (PFA) or polytetrafluoroethylene (PTFE) is further coated on a surface of the elastic layer.

The pressure roller 111 conveys the sheet P in cooperation with the fixing roller 110. Similarly, the pressure roller 111 has a metal core made of an aluminum cylindrical tube, for example, having an outer diameter of 56 mm and an inner diameter of 50 mm. An elastic layer made of a silicon rubber, for example, having a thickness of 2 mm and a hardness of 45° (Asker-C) is coated on a surface of the metal core, and a heat-resistant toner parting layer made of perfluoroalkoxy (PFA) or polytetrafluoroethylene (PTFE) is further coated on a surface of the elastic layer.

The fixing nip portion is formed by the fixing roller 110 and the pressure roller 111. In an experiment of the inventors, a conveyance speed of the sheet P is set to 300 to 500 mm/sec assuming that a surface setting temperature of the fixing roller 110 is 180° C., a surface setting temperature of the pressure roller 111 is 100° C., an atmospheric temperature is 23° C., and an atmospheric humidity is 50%. Then, fibers of the sheet P heated and pressed in the fixing nip portion elongate in a sheet feeding direction. In this case, the edge side of the sheet P of a width direction perpendicular to the sheet feeding direction elongates more than the center side. As a result, an edge corrugation (hereinafter, referred to as a corrugation) is generated.

Figure 2:
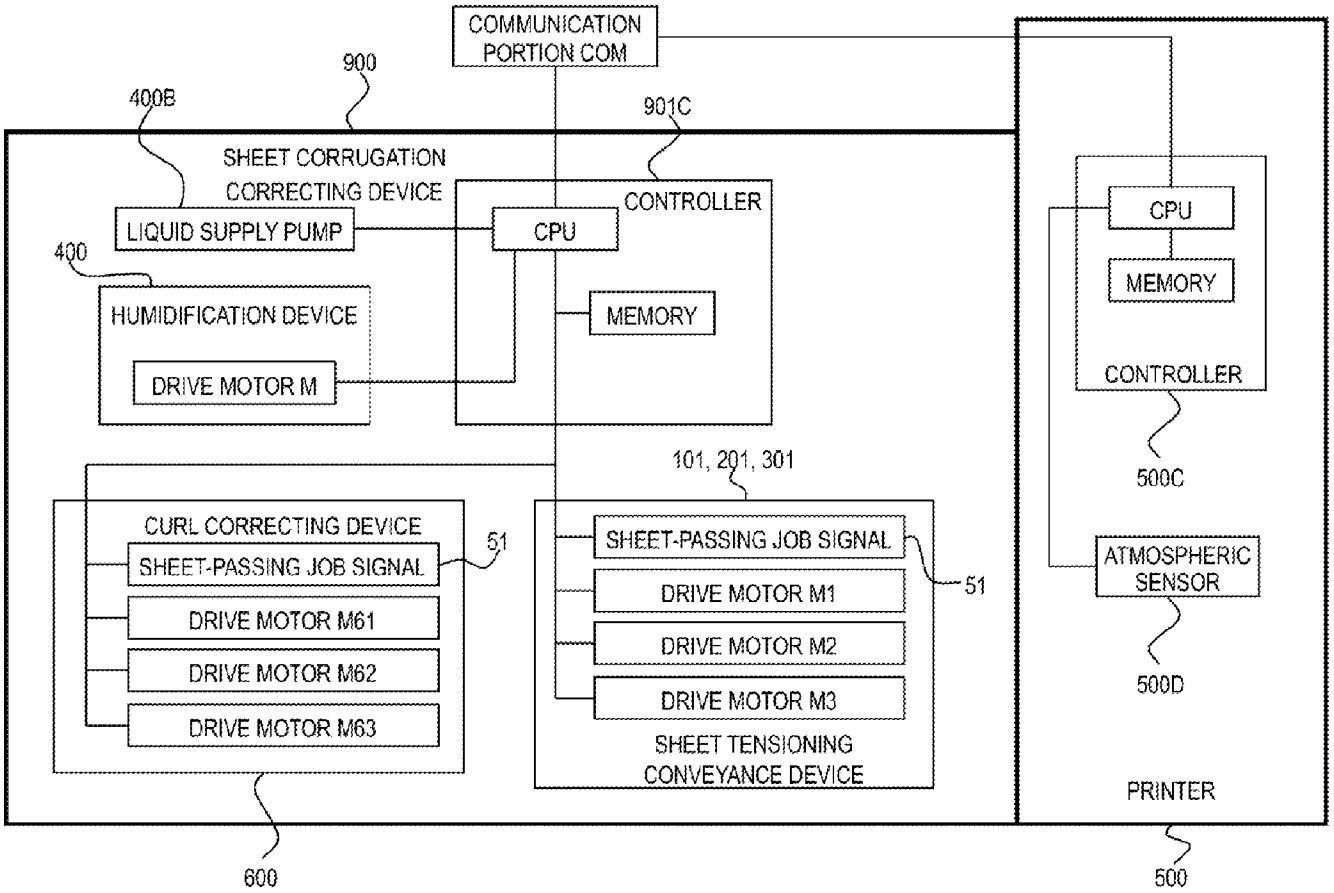
FIG. 2 is a block diagram illustrating control of a printer and a sheet corrugation correcting device in Embodiment 1.

It is noted that sheet type information of a sheet P in the sheet cassette 520 is input by a user using a manipulation panel 570 and is transmitted to a controller 500C having a central processing unit (CPU) and a memory in the printer 500 of FIG. 2. In addition, image density information of a toner image formed on a sheet P by the image forming portion 510 is transmitted to the controller 500C having a CPU and a memory in the printer 500 of FIG. 2. Furthermore, an atmospheric sensor 500D provided over the sheet cassette 520 in the image forming apparatus 500 detects a temperature and a humidity in the image forming apparatus 500, and information about the temperature and the humidity is transmitted to the controller 500C having a CPU and a memory.

The sheet P having the toner image fixed by the fixing device 100 is fed to the sheet corrugation correcting device 900 by the pair of discharge rollers 540. The sheet P is conveyed along a conveyance guide 902 by a pair of entrance rollers 901 of the sheet corrugation correcting device 900, and the conveyance direction is changed to a vertically downward direction (arrow direction B in FIG. 1) by the conveyance guide 902. Then, the sheet P is fed to a sheet moistening device 400 as a moisture adding device (moisture adding unit). Here, the sheet P is moistened by a pair of moistening rollers 401 and 402.

Subsequently, the sheet P discharged from the sheet moistening device 400 is sequentially conveyed to sheet tensioning conveyance devices 101, 201, and 301 as a tensioning device. The sheet P is moistened by the sheet moistening device 400 at a predetermined moisture amount or more. Then, the sheet P sequentially passes through the sheet tensioning conveyance devices 101, 201, and 301, and the center portion of the width direction perpendicular to the sheet feeding direction is pulled in the sheet feeding direction so as to reduce a length difference of the sheet feeding direction between the edge portion and the center of the width direction.

The sheet P obtained by correcting a corrugation in the edge portion of the sheet width direction in this manner is conveyed to a curl correcting device 600 later to correct a curl.

The sheet P obtained by correcting a curl is conveyed by a pair of conveying rollers 904 while a conveyance direction is changed to a vertically upward direction (arrow direction C in FIG. 1) in conveyance guides 903 and 905. Then, the sheet P is conveyed by a pair of conveying rollers 906 and 908 while it is guided by conveyance guides 907 and 908. Then, the sheet P is discharged to the outside of the sheet corrugation correcting device 900 by a pair of discharge rollers 910 and is loaded on the discharge tray 565.

It is noted that a moistening liquid L for moistening the sheet P is stored in a reservoir 400A. The moistening liquid L stored in the reservoir 400A is occasionally supplied to liquid supply baths 411 and 412 provided in the sheet moistening device 400 using a pump 400B through a liquid supply pipe 400C. The moistening liquid L (also, referred to as an application liquid) contains water as a main component.

Here, a control relationship in the entire image forming system will be described with reference to FIG. 2. FIG. 2 is a block diagram illustrating a control relationship in the entire image forming system including the printer 500 and the sheet corrugation correcting device 900. A computer system having a CPU, a memory, an operational unit, an input/output (I/O) port, a communication interface, a driving circuit, and the like is employed in a controller 500C of the printer 500 and a controller 901C of the sheet corrugation correcting device 900.

Control operations of each controller 500C and 901C described above are performed by causing the CPU to execute a predetermined program stored in the memory. The controller 901C of the sheet corrugation correcting device 900 controls operations of the sheet moistening device 400, the sheet tensioning conveyance devices 101, 201, and 301, and the curl correcting device 600 included in the apparatus. In addition, the controllers 500C and 901C described above are connected to each other using a communication portion COM to exchange information.

It is noted that, although a description is made herein for a configuration in which the controller 901C (control unit) of the sheet corrugation correcting device 900 is controlled by the controller 500C (control unit) of the printer 500 to control the operation of the sheet corrugation correcting device 900, the invention is not limited thereto. For example, the sheet corrugation correcting device may not have a control unit, and the control unit of the printer may control the operation of the sheet corrugation correcting device.

Figure 3:
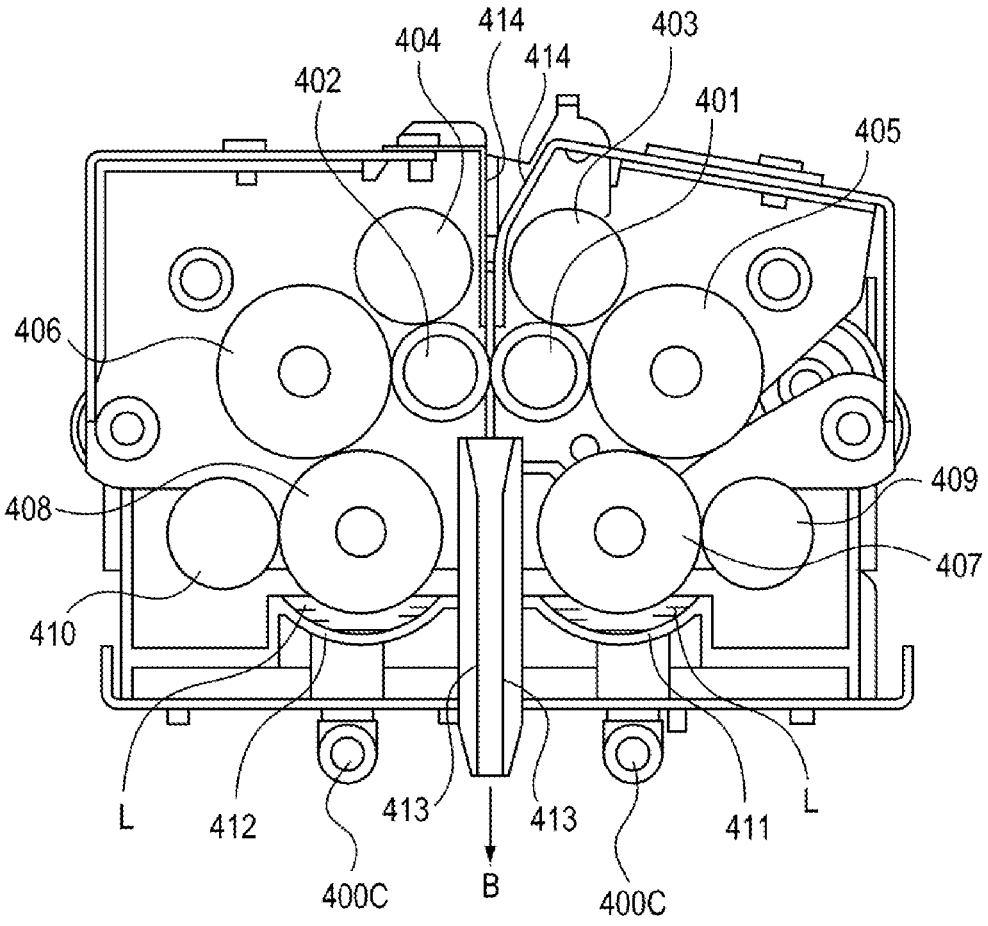
FIG. 3 is a cross-sectional view illustrating a moistening device in Embodiment 1.

Next, the sheet moistening device 400 will be described in detail with reference to FIG. 3. FIG. 3 is a cross-sectional view illustrating the entire sheet moistening device 400.

The sheet P conveyed in the arrow direction B of FIG. 3 matching the arrow direction B of FIG. 1 is guided by entrance guides 414 and 414 to a nip portion of a first pair of moistening rollers 401 and 402, where the sheet P is moistened by transferring the moistening liquid L onto a surface of the sheet P. The sheet P passing through the nip portion between the moistening rollers 401 and 402 is conveyed to a first sheet tensioning conveyance device 101 through a discharge guide 413.

Both the moistening rollers 401 and 402 are elastic rollers obtained by forming a solid rubber layer made of nitrile butadiene rubber (NBR), silicon, or the like as a main component on a surface of a core made of a metal rigid body such as stainless steel.

The liquid supply rollers 405, 406, 407, and 408 serve as a liquid supply member for sequentially supplying the moistening liquid L in the liquid supply baths 411 and 412 to a pair of the moistening rollers 401 and 402. The liquid supply rollers 405, 406, 407, and 408 are elastic rollers having a solid rubber layer made of a material, such as NBR, as a main component having a hydrophilic surface capable of holding water on a core surface made of a metal rigid body such as stainless steel. The solid rubber layer may be made of metal or resin subjected to hydrophilic treatment.

The liquid supply rollers 407 and 408 supply the moistening liquid L to the liquid supply rollers 405 and 406 by drawing the moistening liquid L in the liquid supply baths 411 and 412 and abutting on the liquid supply rollers 405 and 406, respectively. The liquid supply rollers 405 and 406 supply the moistening liquid L to the moistening rollers 401 and 402 by abutting on the moistening rollers 401 and 402, respectively.

First controlling rollers 409 and 410 serve as a first controlling member for controlling a liquid supply amount to the liquid supply rollers 407 and 408. The first controlling rollers 409 and 410 are rollers plated with nickel or chromium on a core surface made of a metal rigid body such as stainless steel.

The first controlling rollers 409 and 410 abut on the liquid supply rollers 407 and 408, respectively, in order to appropriately suppress the amount of the moistening liquid retained on the surface of the solid rubber layer to control a moisture amount supplied to the sheet P. That is, the first controlling rollers 409 and 410 make pressed contact with and deform the solid rubber layers of the liquid supply rollers 407 and 408, respectively, to squeeze the moistening liquid retained on the surface.

The second controlling rollers 403 and 404 serve as a second controlling member for controlling the liquid supply amount to the moistening rollers 401 and 402, respectively. The second controlling rollers 403 and 404 are rollers plated with nickel or chromium on a core surface made of a metal rigid body such as stainless steel.

The second controlling rollers 403 and 404 abut on the moistening rollers 401 and 402, respectively, in order to appropriately suppress the amount of moistening liquid retained on a surface of the solid rubber layer to control the moisture amount supplied to the sheet P. That is, the second controlling rollers 403 and 404 make pressed contact with and deform the solid rubber layers of the moistening rollers 401 and 402, respectively, to squeeze the moistening liquid retained on the surface.

As a result, the sheet P is moistened with an optimal moisture amount to facilitate the pulling effect of the sheet tensioning conveyance devices 101, 201, and 301 described above.

Figure 33:
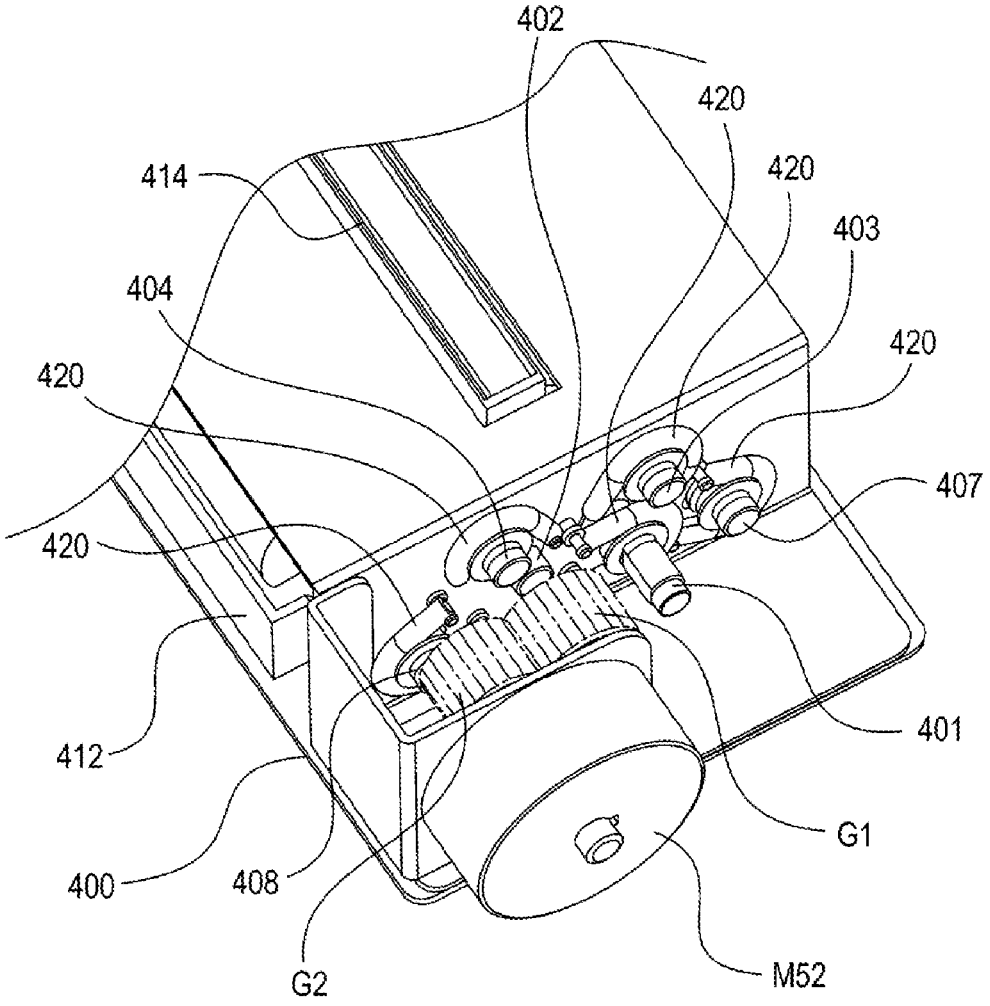
FIG. 33 is a perspective view illustrating main parts for driving the moistening device in Embodiment 5.

A drive gear G1 of FIG. 33 is fixed to the shaft end side of the moistening roller 402 so that a rotational driving force from a drive motor M52 of FIG. 33 is transmitted. Other rollers are drivenly rotated by a driving force transmitted from a surface of the moistening roller 402.

The moisture amount applied to the sheet in the pair of moistening rollers for moistening the sheet P can increase to a water content necessary to tear off the hydrogen bonding between fibers of the sheet P and facilitate expansion/contraction caused by a tension load in the center portion of the width direction of the sheet P using the sheet tensioning conveyance devices 101, 201, and 301.

Next, configurations of each sheet tensioning conveyance devices 101, 201, and 301 will be described with reference to FIGS. 4, 5, and 6. In this embodiment, the first to third sheet tensioning conveyance devices 101, 201, and 301 have the same configuration in which a plurality of pairs of rollers are provided to apply a tensile strength for elongating a widthwise center portion of the sheet P in the feeding direction. For this reason, in the following description for the configuration of the sheet tensioning conveyance device, the first sheet tensioning conveyance device 101 will be representatively described, and descriptions for the second and third sheet tensioning conveyance devices 201 and 301 will not be repeated.

Figure 4:
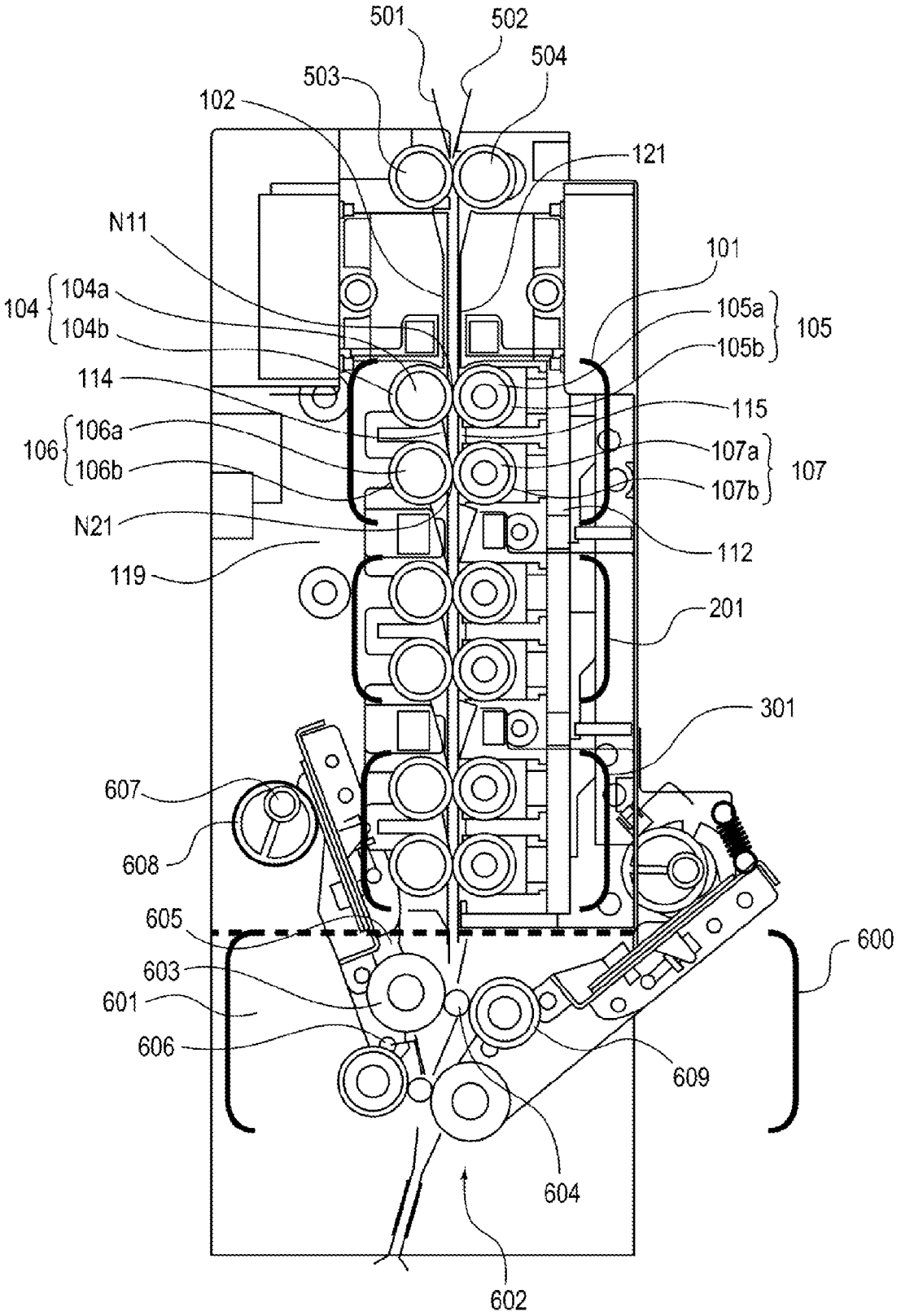
FIG. 4 is a cross-sectional view illustrating a tensioning conveyance device and a curl correcting device in Embodiment 1.

FIG. 4 is a front cross-sectional view illustrating the sheet tensioning conveyance devices 101, 201, and 301 and the curl correcting device 600 described below according to this embodiment. In addition, FIG. 5 is a perspective view illustrating the sheet tensioning conveyance devices 101, 201, and 301 according to Embodiment 1, and FIG. 6 is a left cross-sectional view illustrating the sheet tensioning conveyance devices 101, 201, and 301 according to Embodiment 1.

Here, a first pair of rollers and a second pair of rollers provided in the downstream side from the first pair of rollers in the sheet feeding direction described below are exemplarily illustrated as a plurality of pairs of rollers.

The first pair of rollers includes a first upper roller 104 as a first rotatable roller and a first lower roller 105 as a first pressure roller that makes pressed contact with the first upper roller 104 to form a nip portion N11 where a sheet P is nipped and conveyed.

The second pair of rollers is provided in the downstream side of the feeding direction from the first pair of rollers. The second pair of rollers includes a second upper roller 106 as a second rotatable roller and a second lower roller 107 as a second pressure roller that makes pressed contact with the second upper roller 106 to form a nip portion N21 where a sheet P is nipped and conveyed.

In the sheet tensioning conveyance device 101, a sheet P is nipped and conveyed by the first upper roller 104 and the first lower roller 105 corresponding to the first pair of rollers and the second upper roller 106 and the second lower roller 107 corresponding to the second pair of rollers. While a sheet P is conveyed, the sheet tensioning conveyance device 101 further applies, to the sheet P, a tensile strength for elongating the widthwise center portion of the sheet P in the sheet feeding direction.

The first upper roller 104, the first lower roller 105, the second upper roller 106, and the second lower roller 107 have elastic rubbers 104*b*, 105*b*, 106*b*, and 107*b*, respectively, made of silicon, NBR, ethylene propylene diene monomer (EPDM), or the like as illustrated in FIG. 4. The elastic rubbers 104*b*, 105*b*, 106*b*, and 107*b* are formed on surfaces of roller shafts 104*a*, 105*a*, 106*a*, and 107*a*, respectively, made of a high rigidity material such as stainless steel or iron steel.

Figure 5:
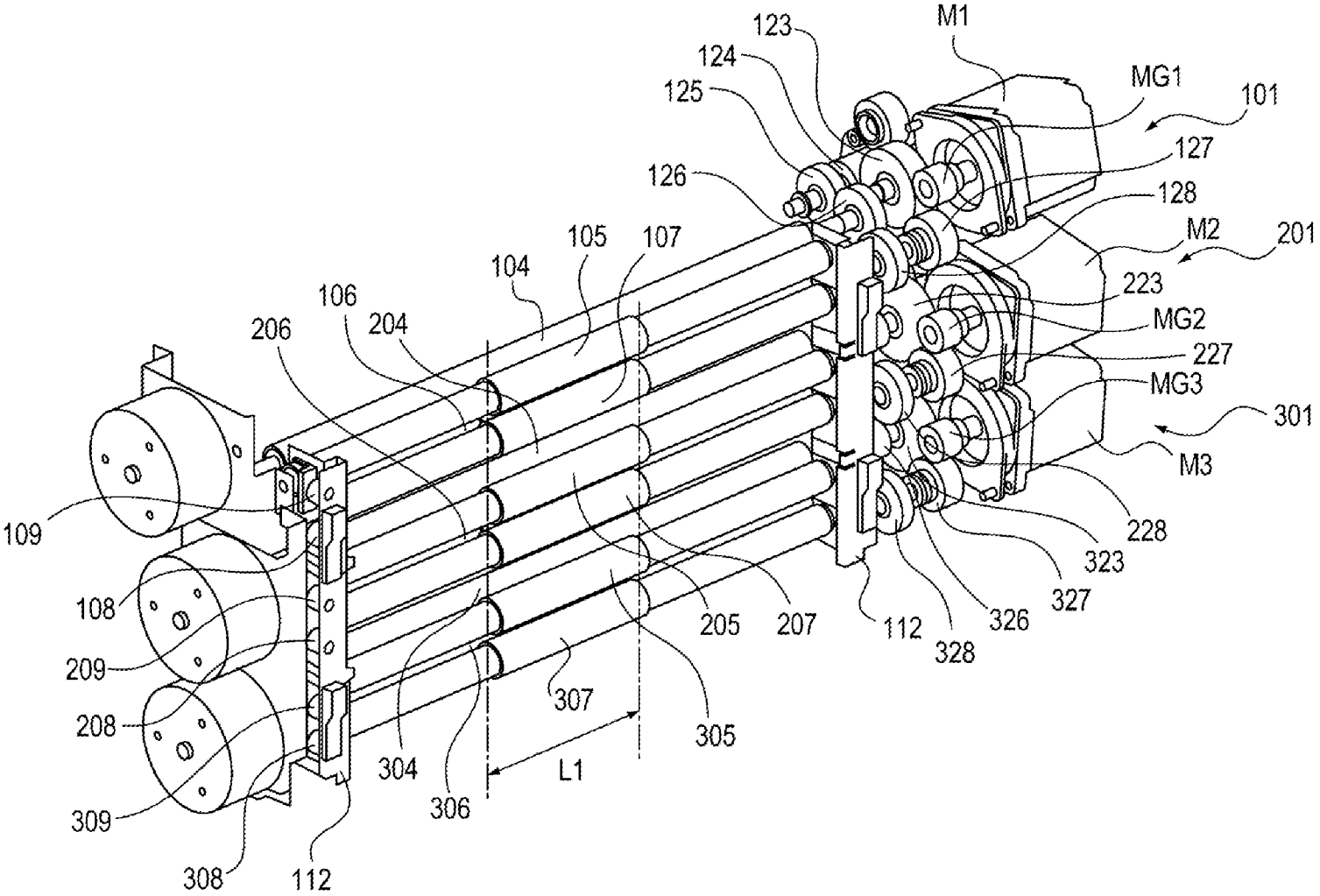
FIG. 5 is a perspective view illustrating the tensioning conveyance device in Embodiment 1.
Figure 8:
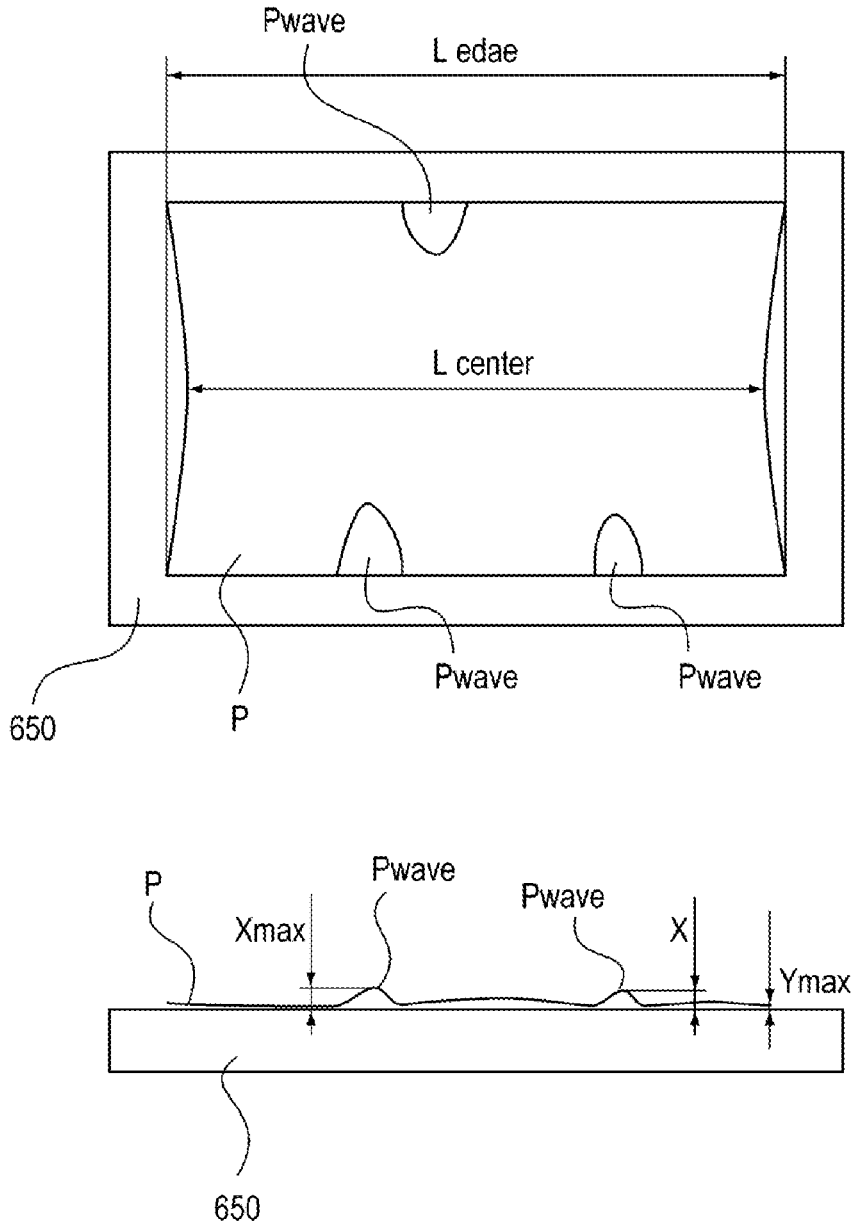
FIG. 8 is an exterior view illustrating a configuration of a sheet.

As illustrated in FIG. 5, the elastic rubbers 105*b* and 107*b* of the first and second lower rollers 105 and 107 are formed in an area having a length L1 in the center portion of the sheet width direction so as to be symmetrical with respect to the sheet passage center (widthwise center). Here, the sheet passage center refers to a position of the widthwise center serving as a reference when a sheet P is conveyed. The length L1 is set to be shorter than the maximum widthwise length of a sheet P that makes a corrugation trouble as illustrated in FIG. 8. In this embodiment, the length L1 is set to 100 mm.

In addition, an upper conveyance guide 114 and a lower conveyance guide 115 as a sheet guide member are provided between the nip portions of the first pair of rollers 104 and 105 and the second pair of rollers 106 and 107, and the distance between the nip portions is set to 25 mm.

Figure 6:
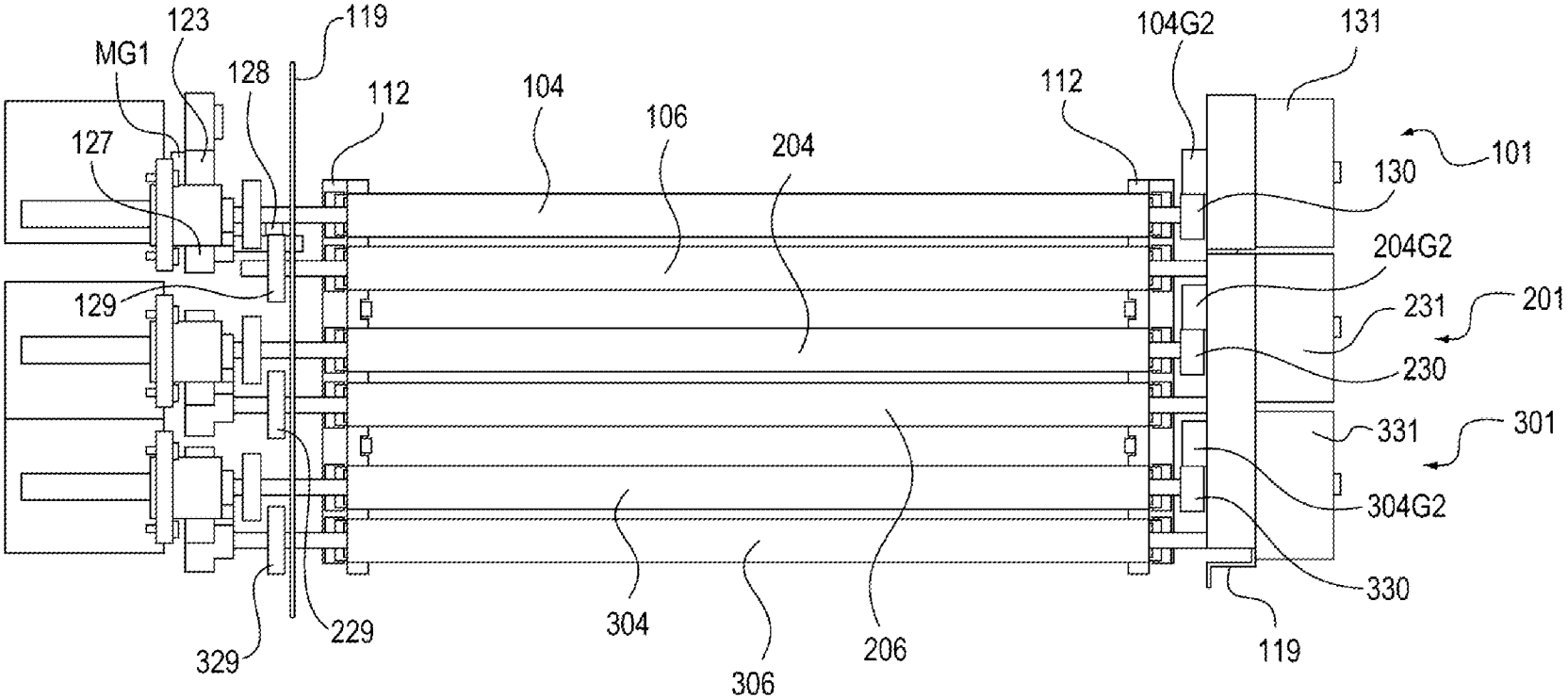
FIG. 6 is a top plan view illustrating the tensioning conveyance device in Embodiment 1.

Both ends of roller shafts 104*a* and 106*a* of the first and second upper rollers 104 and 106, respectively, are supported by an upper side plate 119 of FIG. 6 using a bearing (not illustrated).

Both ends of the roller shaft 105*a* of the first lower roller 105 are supported by a compression plate 112 of FIG. 6 using a bearing (not illustrated). In addition, the first lower roller 105 receives a force from a first compression spring 109 of FIG. 5 provided between the compression plate 112 and the bearing (not illustrated). As a result, the first lower roller 105 is pressed to the first upper roller 104 to form a first nip portion N11. In this embodiment, a bias force of the first compression spring 109 is set such that a total roller pressing force becomes approximately 98 N (10 kgf).

Both ends of the roller shaft 107*a* of the second lower roller 107 are supported by the compression plate 112 using a bearing (not illustrated). In addition, the second lower roller 107 receives a force from a second compression spring 108 of FIG. 5 between the compression plate 112 and a bearing (not illustrated). As a result, the second lower roller 107 is pressed to the second upper roller 106 to form a second nip portion N21. In this embodiment, a biasing force of the second compression spring 108 is set such that a pressing force becomes approximately 98 N (10 kgf).

In FIGS. 5 and 6, the first upper roller 104 is rotated by receiving a rotational driving force from a motor gear MG1 of a drive motor M1 serving as a drive source (drive unit) via drive transmission gears 123, 124, 125, and 126. The second upper roller 106 is rotated by receiving a rotational driving force via drive transmission gears 123, 127, 128, and 129.

The first and second lower rollers 105 and 107 pressed by the first and second upper rollers 104 and 106 are drivenly rotated by rotation of the first and second upper rollers 104 and 106, respectively.

The drive transmission gear 124 has an one-way clutch (not illustrated). The one-way clutch is locked when the first upper roller 104 is rotated by driving the drive motor M1 in the feeding direction of the sheet P so that a driving force of the drive motor M1 is transmitted to the first upper roller 104.

The second upper roller 106 is rotated at nearly the same conveyance speed as that of a pair of entrance rollers 503. The conveyance speed of the first upper roller 104 is lower than that of the second upper roller 106.

In this embodiment, the conveyance speed (circumferential velocity) of the first upper roller 104 is set to be lower than the conveyance speed (circumferential velocity) of the second upper roller 106 by approximately 2%.

In addition, as illustrated in FIG. 6, a drive gear 104G2 is fixed to one end of the first upper roller 104 and is connected to a torque limiter 131 through the drive transmission gear 130. Here, the torque limiter 131 may have any brake system such as an electromagnetic brake or a brake pad if it applies a drive load to the first upper roller 104. In this embodiment, when the same sheet P exists in both the first and second nip portions N11 and N21 due to the torque limiter 131, a setting value of the torque limiter is set such that a tension applied to the sheet P becomes approximately 68 N (7 kgf). The setting value of the torque limiter 131 is set such that the sheet P is not damaged while a sufficient tension is applied to the sheet P.

Next, a description will be made for an operation when a sheet P is conveyed to the sheet tensioning conveyance device.

A sheet P is guided to inlet guides 102 and 121 in the sheet tensioning conveyance device 101 and is nipped in the first nip portion N11 of the sheet tensioning conveyance device 101. The sheet P is conveyed at a conveyance speed set by the first nip portion N11 until it is nipped in the second nip portion N21 by the first nip portion N11. In this embodiment, a rotation number of the drive motor M1 is set such that a conveyance speed of 294 mm/s is obtained in the first nip portion N11.

Then, as the sheet P is nipped in the second nip portion N21 of the sheet tensioning conveyance device 101, the sheet P is conveyed by the second nip portion N21 at a conveyance speed faster than that of the first nip portion N11. In this embodiment, when the first nip portion N11 is conveyed at a conveyance speed of 294 mm/s, the conveyance speed in the second nip portion N21 is set to 300 mm/s. In this case, since the conveyance speed of the second nip portion N21 in the downstream side of the sheet feeding direction is faster than that of the first nip portion N11 of the upstream side, the one-way clutch is idled. That is, a driving force is not transmitted to the first upper roller 104, the first pair of rollers 104 and 105 of the sheet tensioning conveyance device 101 is drivenly rotated by the sheet P conveyed by the second pair of rollers 106 and 107. In addition, since the first upper roller 104 is connected to the torque limiter 131 through the drive gear 104G2 and the drive transmission gear 130, a torque load is generated in order to rotate the first upper roller 104. As a result, the sheet P is conveyed while a tension is generated between the first pair of rollers 104 and 105 and the second pair of rollers 106 and 107.

As described above, a sheet length difference between the edge portion and the center portion is reduced by pulling the sheet widthwise center portion in the sheet feeding direction while the sheet passes through the tensioning device of this embodiment. As a result, it is possible to correct a corrugation.

Hereinafter, a relationship between a plurality of sheet tensioning conveyance devices 101, 201, and 301 will be described. In this embodiment, it is assumed that a plurality of sheet tensioning conveyance devices, that is, three sheet tensioning conveyance devices 101, 201, and 301 are provided.

A plurality of sheet tensioning conveyance devices are provided in order to obtain a sufficient pulling effect of a sheet P. The pulling effect of a sheet P may also be enhanced by increasing a tension between the first and second nip portions N11 and N21. However, if a stress is applied to a sheet P abruptly by excessively increasing a tension, the sheet P is significantly damaged so that the resulting product may be deteriorated. In addition, since a load increases when the second upper roller 106 extracts a sheet P from the first nip portion N11, the sheet P may slip in the second nip portion N21 so that a difference of the pulling effect of the sheet P or a difference of the conveyance speed may occur. For this reason, a plurality of sheet tensioning conveyance devices are provided to pull a sheet P in a stepwise manner. As a result, the pulling effect can be applied to a sheet P without such a problem. In this embodiment, if, for example, a tension of 98 N (10 kgf) or higher is applied, the sheet P is significantly damaged, and the resultant product is deteriorated. For this reason, a plurality of sheet tensioning conveyance devices 101, 201, and 301 are provided while a tension setting value of the torque limiters 131, 231, and 331 is set to approximately 68 N (7 kgf).

Since a plurality of sheet tensioning conveyance devices are provided to pull a sheet P in a stepwise manner as described above, it is possible to obtain a sufficient sheet pulling effect and correct a sheet corrugation without deteriorating the resultant product.

Next, a curl correcting device 600 arranged in the downstream side of the sheet tensioning conveyance devices 101, 201, and 301 will be described with reference to FIG. 4.

A sheet P discharged from the sheet tensioning conveyance devices 101, 201, and 301 may have a curl due to an image formed on the sheet P and an influence of the sheet moistening device 400.

This is because, if a sheet P is moistened by the sheet moistening device 400 while a difference of the toner image density between front and rear sides of the sheet is large, one of the front and rear sides having a lower toner image density of the sheet P elongates. For this reason, a curl is generated due to a difference of elongation between the front and rear sides of a sheet. Specifically, a sheet P curls up toward the side having a higher toner image density.

In this regard, in this embodiment, in order to address such as problem, the curl correcting device 600 is provided in the downstream side of the sheet tensioning conveyance devices 101, 201, and 301 as illustrated in FIG. 4.

Next, the curl correcting device 600 according to Embodiment 1 will be described with reference to FIG. 7. The curl correcting device 600 includes a first curl correcting portion 601 for correcting a curl protruding to one side of a sheet and a second curl correcting portion 602 for correcting a curl protruding to the other side of the sheet.

The first curl correcting portion 601 includes a sponge roller 603, a rigid roller 604, and a backup roller 609. The sponge roller 603 has an elastic portion made of a sponge material and a roller shaft made of a rigid metal material in the center. The rigid roller 604 is a metal roller and is arranged to face the sponge roller 603. Both ends of the sponge roller 603 are held by a holding metal plate 605 rotatable with respect to a rotational center 606. Such components are integrated as an assembly.

An eccentric cam 608 rotatable with respect to the rotational center shaft 607 makes sliding contact with the holding metal plate 605. As the eccentric cam 608 rotates, the assembly described above is rotated with respect to the rotational center 606 so that the sponge roller 603 makes pressed contact with the rigid roller 604. In addition, an intrusion amount of the sponge roller 603 into the rigid roller 604 can be changed depending on a rotation angle of the eccentric cam 608. As a result, it is possible to change a curl correction amount of a sheet P.

The holding metal plate 605 receives a spring force from an extension spring 612 and is biased to the eccentric cam 608 side so that the holding metal plate 605 abuts on the outer circumferential surface of the eccentric cam 608 at all times. Since an outer circumferential surface of the backup roller 609 abuts on an outer circumferential surface of the rigid roller 604, the backup roller 609 prevents sagging of the rigid roller 604 when it makes pressed contact with the sponge roller 603. In addition, the backup roller 609 is rotatable using a bearing 610 and a support shaft 611 provided on an inner circumferential surface.

A pulley 613 integrated with a rotation flag is fixed to an end of the rotational center shaft 607 of the eccentric cam 608 so that the eccentric cam 608 is rotatable by a step motor M61 using a timing belt 615. In addition, a rotational position of the eccentric cam 608 is detected by a photo-interrupter 614, and the position is held at a predetermined angle based on a rotation angle of the step motor M61.

The rigid roller 604 is rotated using a gear 616 connected to the motor M62 and a non-illustrated gear. The sponge roller 603 and the backup roller 609 are drivenly rotated by rotation of the rigid roller 604.

In this configuration, a nip portion having a curved shape (hereinafter, referred to as a curved nip portion) is formed in the sponge roller 603 by causing the sponge roller 603 to make pressed contact with the rigid roller 604 and causing the rigid roller 604 to intrude into the sponge roller 603. In addition, in FIG. 7, a curl of a sheet is corrected when a sheet P having a curl protruding to the right side passes through the curved nip portion.

Since a depth of the rigid roller 604 intruding into the sponge roller 603 changes depending on the rotational position of the eccentric cam 608, a curvature of the curved portion also changes. Therefore, it is possible to change a correction amount for correcting a curl of a sheet. That is, it is possible to adjust a curl correction amount depending on a size of the curl generated in a sheet.

Figure 7:
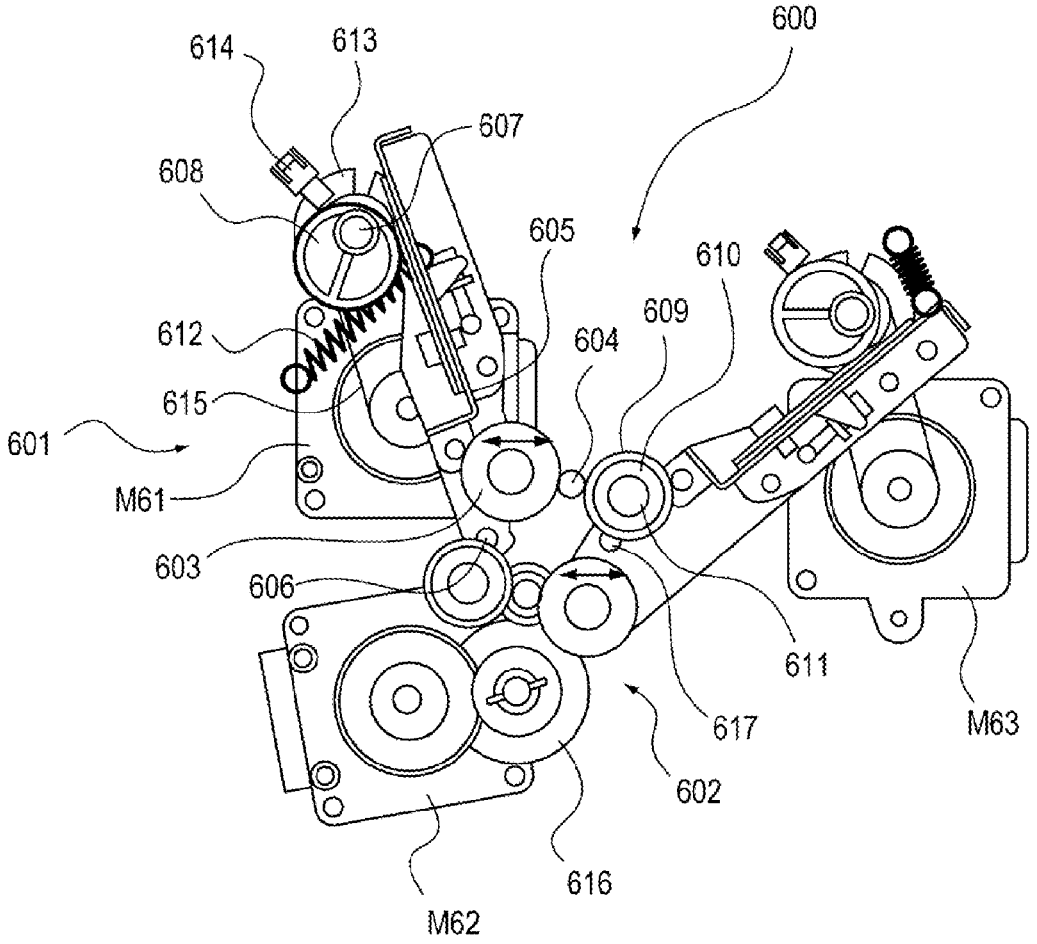
FIG. 7 is a cross-sectional view illustrating the curl correcting device in Embodiment 1.

In the second curl correcting portion 602 of FIG. 7, a positional relationship between the sponge roller and the rotation center 617 of the holding metal plate is different from that of the first curl correcting portion 601. Therefore, the relationship of the holding metal plate in the rotational direction of the second curl correcting portion 602 is opposite to that of the first curl correcting portion 601. However, the relationship of the second curl correcting portion 602 is similar to that of the first curl correcting portion 601, particularly, from the viewpoint of curl correction.

It is noted that an orientation of the curl corrected by the second curl correcting portion 602 is opposite to that corrected by the first curl correcting portion 601 (in FIG. 7, a curl protruding in the left side is corrected). In addition, a curl correction amount is controlled by the rotation angle of the step motor M63. Similarly to the first curl correcting portion 601, a depth of the rigid roller intruding into the sponge roller changes depending on the rotational position of the eccentric cam.

Similar to the first curl correcting portion 601, the rigid roller is rotated using a gear 616 connected to the motor M62 and a non-illustrated gear, and the sponge roller and the backup roller are drivenly rotated by rotation of the rigid roller.

In the aforementioned configuration, it is possible to adjust a curl correction amount depending on an orientation of a curl generated in a sheet P.

That is, when a curl protruding into the right side is generated in FIG. 7, a curved nip portion is formed by increasing an intrusion depth of the sponge roller 603 in the first curl correcting portion 601, and a curved nip portion is not formed in the second curl correcting portion 602 by reducing an intrusion depth of the sponge roller. As a result, an upward protruding curl on a sheet P is corrected.

Meanwhile, when a curl protruding to the left side is generated in FIG. 7, a curved nip portion is not formed by reducing the intrusion depth of the sponge roller 603 in the first curl correcting portion 601, and a curved nip portion is formed by increasing the intrusion depth of the sponge roller in the second curl correcting portion 602. As a result, a downward protruding curl on a sheet P is corrected.

With reference to FIG. 8, a description will be made for a shape characteristic of a curl or an edge corrugation generated in a sheet P and a measurement method. A sheet P passing through only the nip portion N of the fixing device 100 or a sheet P passing through the nip portion N of the fixing device 100, and then continuously through the sheet tensioning conveyance devices 101, 201, and 301, and the curl correcting device 600 is loaded on a measurement table 650 as illustrated in FIG. 8. Here, "L edge [mm]" denotes an edge length of a sheet P in a sheet feeding direction, and "L center [mm]" denotes a center length.

A wave shape Pwave generated in the upper or lower side of the sheet P of FIG. 8, that is, the edge portion of the width direction perpendicular to the sheet feeding direction will be referred to as an edge corrugation. As an evaluation target, the largest one X max of gaps from the measurement table 650 is set as a corrugation length, and the largest one Y max of distances between four corners of a sheet P and the measurement table 650 is set as a maximum curl amount.

FIG. 9 illustrates a result of the experiment performed by the inventors for checking effects of the tensioning device and the curl correcting device according to Embodiment 1.

As an experiment condition, a toner image is transferred onto a front surface of a sheet P by 70% and is not transferred onto a rear surface. A sheet moisture amount immediately after the sheet passes through the sheet moistening device 400 is set to 7% or higher.

In this embodiment, the inventors measures the sheet moisture amount immediately after the sheet P passes through the sheet corrugation correcting device 900 and is discharged to the discharge tray 565. In this embodiment, a microwave type paper moisture amount meter is used.

The edge length L edge [mm], the center length L center [mm], the maximum corrugation amount X max [mm], and the maximum curl amount Y max [mm] are measured for each sheet P after the sheet P passes through the sheet corrugation correcting device 900. FIG. 9A shows the result of measurement when a sheet P does not pass through the sheet corrugation correcting device 900 immediately after the sheet P passes through the fixing device 100. FIG. 9B shows the result of measurement when a curl correction effect of the curl correcting device 600 is not exerted (the curved nip portion is not formed in the first and second curl correcting portions 601 and 602). FIG. 9C shows the result of measurement when a curl correction effect for a curl protruding upward from the curl correcting device 600 is exerted (the curved nip portion of the first curl correcting portion 601 is formed, and the curved nip portion of the second curl correcting portion 602 is not formed).

As illustrated in FIG. 9A, while an elongation amount of the center length L center immediately after a sheet P passes through the fixing device is 0 mm, an elongation amount of the edge length L edge is 0.6 mm, so that the edge length is longer than the center length by 0.6 mm. As a result, the maximum corrugation amount X max is 3.3 mm, which is significant. In addition, the maximum curl amount Y max is 5.0 mm.

As illustrated in FIG. 9B, when the curl correction effect is not exerted, the center length L center of a sheet P elongates by 0.6 mm, which indicates that a sufficient pulling effect is obtained. In addition, the maximum corrugation amount X max is 1.0 mm, which is reduced by ⅓ that of FIG. 9A. However, the maximum curl amount Y max increases to 10 mM.

As illustrated in FIG. 9C, when the effect for correcting the upward protruding curl is exerted, the center length L center of a sheet P elongates by 0.6 mm, which indicates that a sufficient pulling effect is obtained. In addition, the maximum corrugation amount X max decreases to 1.0 mm, and the maximum curl amount Y max is improved to 1.0 mm.

As described above, it is observed that both a corrugation and a curl can be corrected by arranging the curl correcting device 600 in the downstream side of the sheet tensioning conveyance devices 101, 201, and 301 in the sheet feeding direction. In this case, a curl direction (protruding to the left side or right side in FIG. 7) or a curl correction amount is known through an experiment in advance based on a sheet surface where a toner is transferred, a toner density, a sheet moistening amount, and the like. Therefore, a curl correcting portion and a curl correction amount can be selected for each sheet depending on a curl direction.

That is, a curl can be corrected for each sheet depending on sheet information transmitted to a controller having a CPU and a memory in the image forming apparatus, image density information of a toner image on a sheet P having an image, and information about a temperature, a humidity, and a moistening amount from the atmospheric sensor 500D.

Since a curl and a corrugation on a sheet are corrected in this manner, it is possible to prevent a conveyance error such as a jam, stably convey a sheet, and obtain excellent loadability on a sheet discharge tray.

Figure 10:
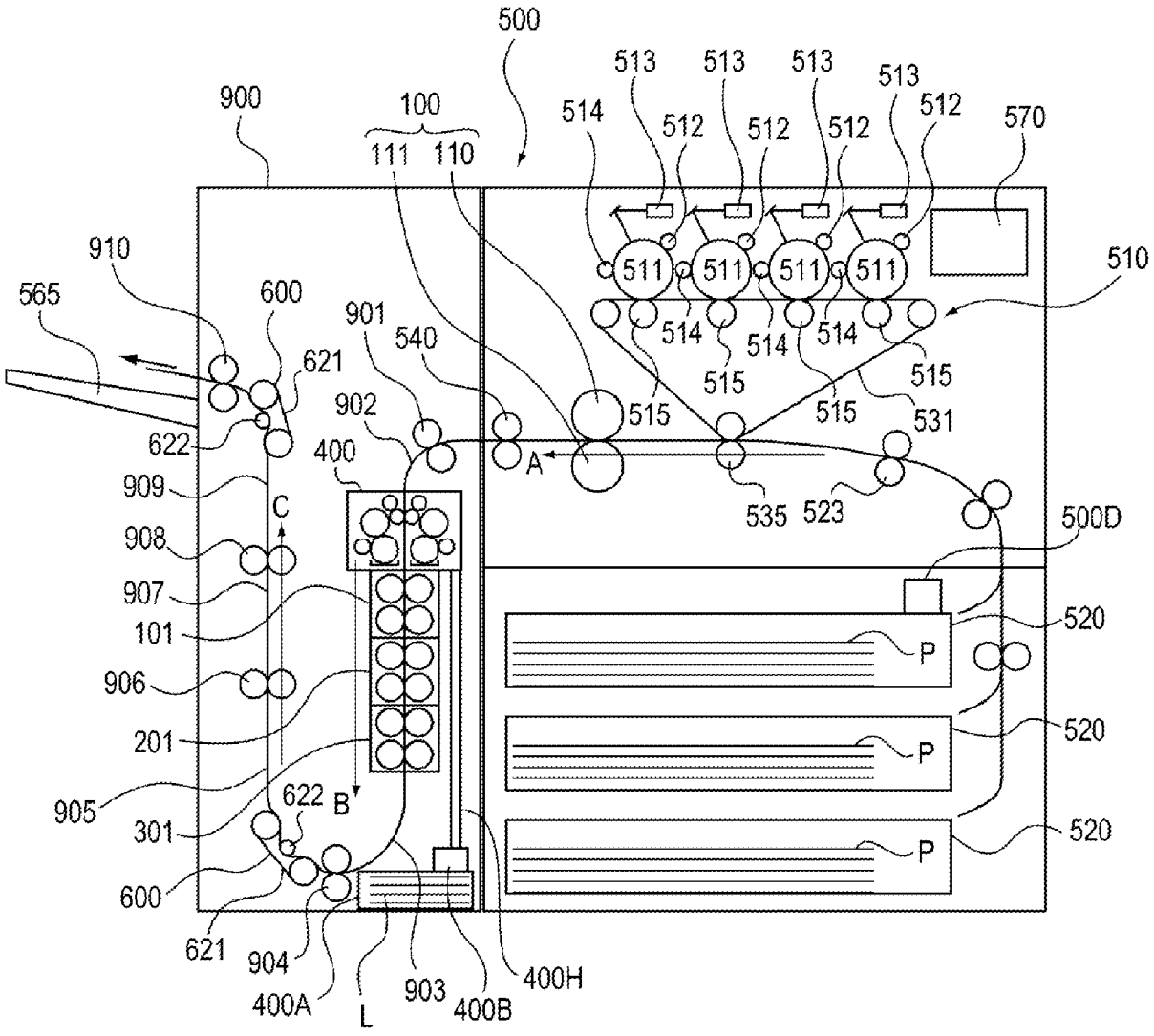
FIG. 10 is a cross-sectional view illustrating an electrophotographic printer in Embodiment 1.

Although, in the curl correcting device 600 according to this embodiment, a curl is corrected using a curved nip portion formed by causing the rigid roller 604 to intrude into the sponge roller 603, the invention is not limited thereto. For example, as illustrated in FIG. 10, a curl correcting device 600 including an endless belt 621 stretching across a plurality of rollers and a curved nip portion formed by intrusion of the rigid roller 622 may be provided for each curl direction.

In this embodiment, widths of the elastic rubbers 105*b* and 107*b* of the first and second lower rollers 105 and 107, respectively, are set to 100 mm. However, the invention is not limited thereto. At least a part of the outer diameters of the elastic rubbers 105*b* and 107*b* of the first and second lower rollers 105 and 107, respectively, may change in a rotational axis direction, and the center portion of the rotational axis direction may be larger than the edge portion of the rotational axis direction.

As a result, a conveyance speed of a sheet P increases in the center portion relative to the edge portion, and a nip pressure in the center also increases. Therefore, a tension force is applied to the sheet center portion. Accordingly, as described in the aforementioned embodiment, it is possible to reduce a difference of the sheet length between the edge portion and the center and improve a corrugation by pulling the sheet center portion. The aforementioned rollers may have a straight shape only in the center portion and a tapered shape narrowing to the edge portion therefrom. In addition, an outer diameter of the roller may have a crown shape such as a parabolic shape.

Embodiment 2

An image forming apparatus having a tensioning device according to Embodiment 2 will be described with reference to FIGS. 8 and 11 to 17. For a detailed description, some parts are not illustrated intentionally. In the following description, first, an image forming apparatus, a fixing device, and a tensioning device will be described in this order. In Embodiment 2, a description will be made for an image forming system having a tensioning device integrated into the inside of the image forming apparatus. However, this embodiment may also apply to an image forming system having a tensioning device connected from the outside of the image forming apparatus.

Figure 12:
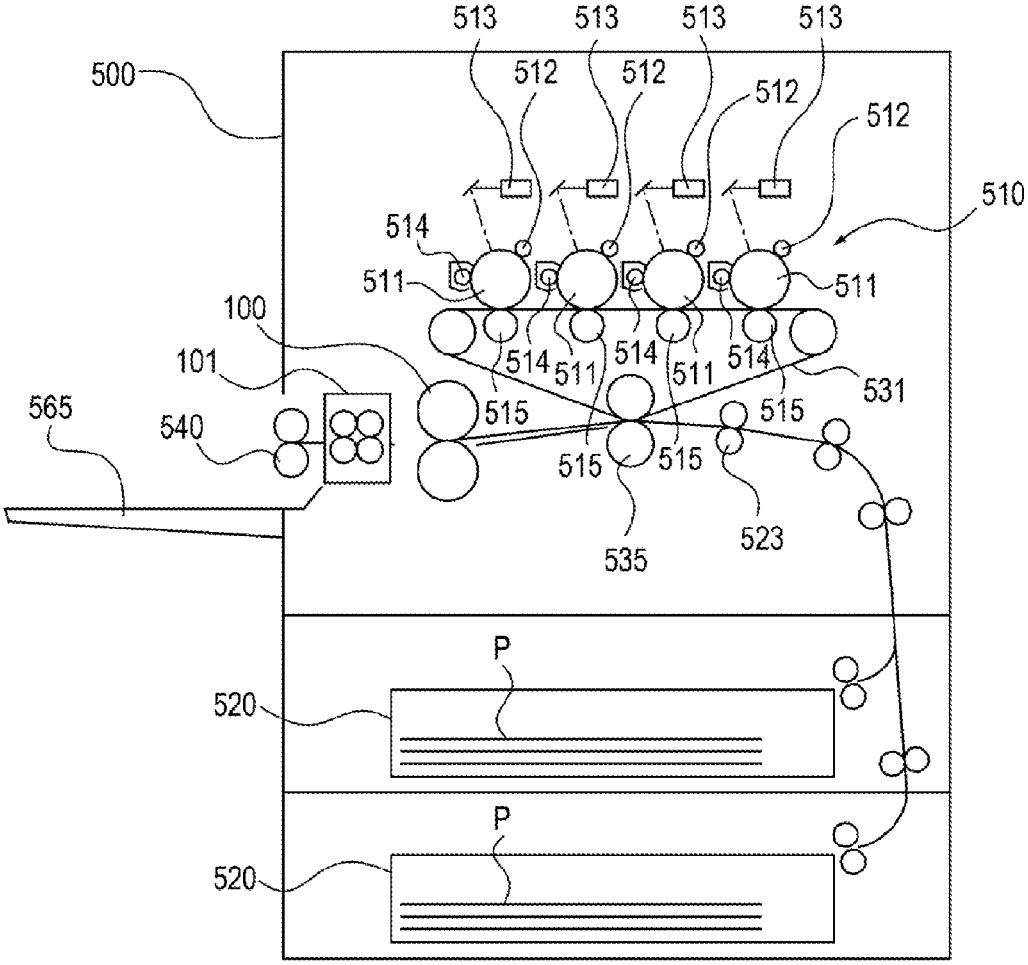
FIG. 12 is a cross-sectional view illustrating an electrophotographic printer in Embodiments 2 and 3.

First, an image forming apparatus as an example of the image forming system will be described with reference to FIG. 12. FIG. 12 is a cross-sectional view schematically illustrating a color electrophotographic printer 500 as an example of the image forming apparatus along a sheet feeding direction. Note that the color electrophotographic printer will be simply referred to as a "printer" in the following description.

A toner image is formed on a sheet. Specifically, the sheet may include, for example, a plain paper sheet, a resin sheet as a substitute of the plain paper sheet, a thick paper sheet, an overhead projector applicable sheet, and the like.

The printer 500 of FIG. 12 has an image forming portion 510 for each color of yellow (Y), magenta (M), cyan (C), and black (Bk). In the image forming portion 510 for each color, toner images of each color are formed on a sheet. In addition, an endless intermediate transfer belt 531 as an intermediate transfer member is arranged to run through the image forming portion. That is, a visible image forming apparatus is employed, in which processes until visualization are executed in parallel for each color.

It is noted that an arrangement sequence of the image forming portions for each color of Y, M, C, and K is not limited to that illustrated in FIG. 12. In addition, the embodiment may also be applicable to a monochromatic image forming apparatus without limiting to a full-color intermediate transfer type image forming apparatus of FIG. 12.

In the image forming portions 510 for each color, each process unit is provided as follows. For each color of Y, M, C, and K, an electrophotographic photosensitive element (hereinafter, referred to as a photosensitive drum) 511 as an image bearing member for bearing an electrostatic latent image on a surface, a charging roller 512, a laser scanner 513, and a development device 514 are provided. The photosensitive drum 511 is charged by the charging roller 512 in advance. Then, the photosensitive drum 511 is exposed by the laser scanner 513 to form a latent image. The latent image is developed by the development device 514 and is visualized as a toner image.

In a primary transfer portion including the photosensitive drum 511 and a primary transfer roller 515, each toner image formed and borne on a surface of the photosensitive drum 511 is primarily transferred onto an intermediate transfer belt 531 by the primary transfer roller 515 in a sequentially superimposed manner.

Meanwhile, sheets P are fed from a sheet cassette 520 one by one to a pair of registration rollers 523. The pair of registration rollers 523 receives the sheet P once and corrects a skew in the case of skew feeding. In addition, the pair of registration rollers 523 feeds the sheet P to a secondary transfer portion between the intermediate transfer belt 531 and a secondary transfer roller 535 in synchronization with the toner image on the intermediate transfer belt 531. The color toner images on the intermediate transfer belt 531 are secondarily transferred onto the sheet P, for example, by the secondary transfer roller 535 as a transfer portion in a collective manner.

Then, the sheet having an image (toner image) formed by the image forming portion as described above is conveyed to a fixing device 100. In the fixing device (fixing portion) 100, the toner image on the sheet is fixed by applying heat and pressure to the unfixed toner image by nipping the sheet in a fixing nip portion. The sheet passing through the fixing device 100 is discharged by a pair of discharge rollers 540 to a discharge tray 565 through a tensioning device 101 that applies a tensile strength to a sheet center portion of the width direction described below.

Figure 11:
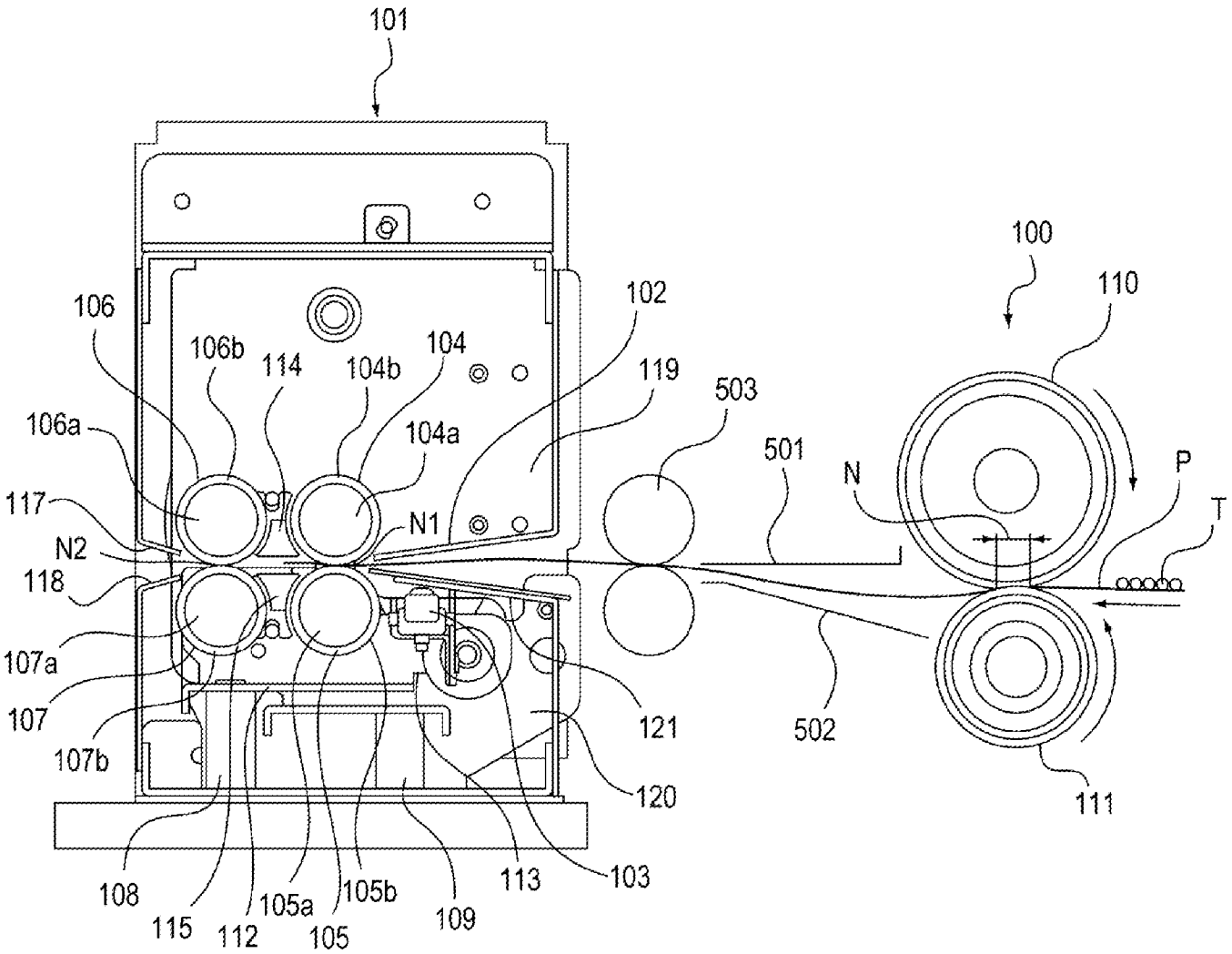
FIG. 11 is a cross-sectional view illustrating a tensioning conveyance device in Embodiment 2.

Here, the fixing device will be described with reference to FIG. 11. As illustrated in FIG. 11, the fixing device 100 includes a fixing roller 110 as a heating rotating member and a pressure roller 111 as a pressing rotating member. The fixing roller 110 applies heat generated from an internal halogen heater (not illustrated) to a toner T on the sheet P and conveys the sheet P in cooperation with the pressure roller 111. The fixing roller 110 has a halogen heater embedded into a metal core made of an aluminum cylindrical tube, for example, having an outer diameter of 56 mm and an inner diameter of 50 mm. An elastic layer made of a silicon rubber, for example, having a thickness of 2 mm and a hardness of 45° (Asker-C) is coated on a surface of the metal core, and a heat-resistant toner parting layer made of perfluoroalkoxy (PFA) or polytetrafluoroethylene (PTFE) is further coated on a surface of the elastic layer.

The pressure roller 111 conveys the sheet P in cooperation with the fixing roller 110. Similarly, the pressure roller 111 has a metal core made of an aluminum cylindrical tube, for example, having an outer diameter of 56 mm and an inner diameter of 50 mm. An elastic layer made of a silicon rubber, for example, having a thickness of 2 mm and a hardness of 45° (Asker-C) is coated on a surface of the metal core, and a heat-resistant toner parting layer made of perfluoroalkoxy (PFA) or polytetrafluoroethylene (PTFE) is further coated on a surface of the elastic layer.

The fixing nip portion of FIG. 11 is formed by the fixing roller 110 and the pressure roller 111. In an experiment of the inventors, a conveyance speed of the sheet P is set to 300 to 500 mm/sec assuming that a surface setting temperature of the fixing roller 110 is 180° C., a surface setting temperature of the pressure roller 111 is 100° C., an atmospheric temperature is 23° C., and an atmospheric humidity is 50%. Then, fibers of the sheet P heated and pressed in the fixing nip portion elongate in a sheet feeding direction. In this case, the edge side of the sheet P of a width direction perpendicular to the sheet feeding direction elongates more than the center side. As a result, an edge corrugation (hereinafter, referred to as a corrugation) is generated.

The sheet P conveyed to the fixing device 100 by the photosensitive drum 511 and the secondary transfer roller 535 enters a fixing nip portion N of the pressure roller 111 and the fixing device 100. The sheet P is heated and pressed in the fixing nip portion N formed by the fixing roller 110 and the pressure roller 111 so that a toner image is fixed. The sheet P having the fixed toner image is guided to a gap between an upper discharge guide 501 and a lower discharge guide 502 as illustrated in FIG. 11.

As illustrated in FIG. 11, the sheet P guided to a gap between the upper and lower discharge guides 501 and 502 passes through a pair of entrance rollers 503 and is guided to a gap between upper and lower inlet guides 102 and 121 in the tensioning device 101.

Next, the tensioning device 101 that applies a tensile strength to a sheet will be described with reference to FIGS. 11 and 13. The tensioning device 101 has a plurality of pairs of rollers for applying a tensile strength for elongating, in the sheet feeding direction, a center portion of the width direction of the sheet P that has passed through the fixing nip portion of the fixing device 100 and has been guided to the gap between the upper and lower discharge guides 501 and 502.

Here, a first pair of rollers and a second pair of rollers provided in the downstream side from the first pair of rollers in the sheet feeding direction described below are exemplarily illustrated as a plurality of pairs of rollers.

The first pair of rollers includes a first upper roller 104 as a first rotatable roller and a first lower roller 105 as a first pressure roller that makes pressed contact with the first upper roller 104 to form a nip portion N11 where a sheet P is nipped and conveyed.

The second pair of rollers is provided in the downstream side of the feeding direction from the first pair of rollers. The second pair of rollers includes a second upper roller 106 as a second rotatable roller and second lower roller 107 as a second pressure roller that makes pressed contact with the second upper roller 106 to form a nip portion N21 where a sheet P is nipped and conveyed.

In the tensioning device 101, a sheet P is nipped and conveyed by the first upper roller 104 and the first lower roller 105 corresponding to the first pair of rollers and the second upper roller 106 and the second lower roller 107 corresponding to the second pair of rollers. While a sheet P is conveyed, the tensioning device 101 further applies, to the sheet P, a tensile strength for elongating the widthwise center portion of the sheet P in the feeding direction. In addition, the sheet P is guided to between an upper outlet guide 117 and a lower outlet guide 118 and is discharged to the outside of the tensioning device 101.

Figure 13:
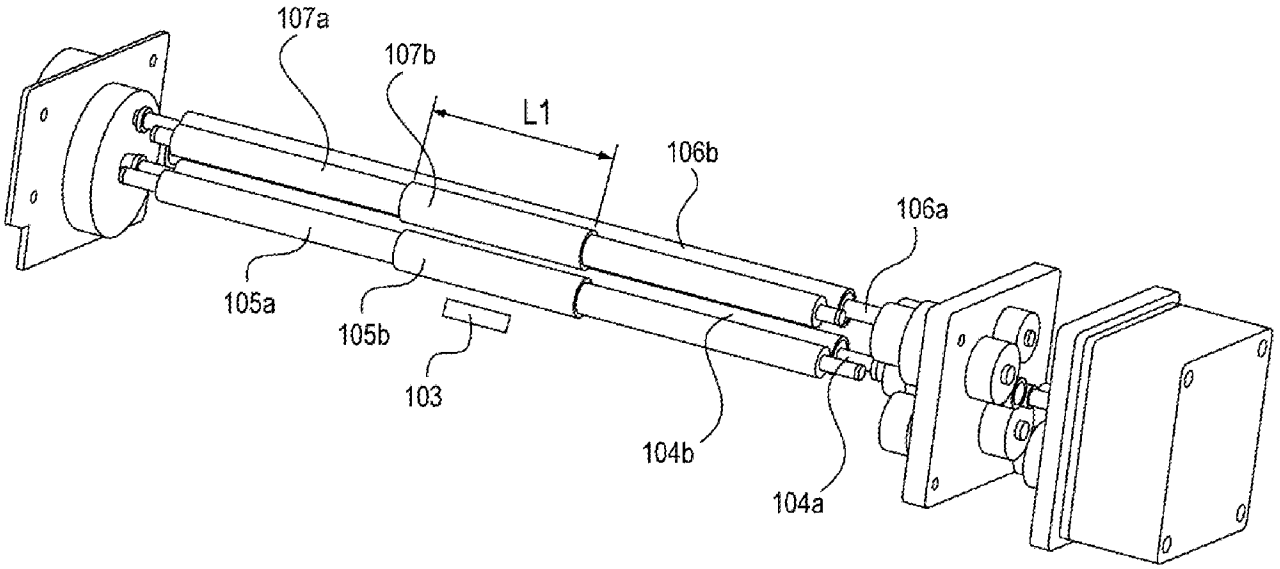
FIG. 13 is a perspective view illustrating the tensioning conveyance device in Embodiment 2.

The first upper roller 104, the first lower roller 105, the second upper roller 106, and the second lower roller 107 have elastic rubbers 104*b*, 105*b*, 106*b*, and 107*b*, respectively, made of silicon, NBR, ethylene propylene diene monomer (EPDM), or the like as illustrated in FIG. 13. The elastic rubbers 104*b*, 105*b*, 106*b*, and 107*b* are formed on surfaces of roller shafts 104*a*, 105*a*, 106*a*, and 107*a*, respectively, made of a high rigidity material such as stainless steel or iron steel. In this embodiment, all of the elastic rubbers 104*b*, 105*b*, 106*b*, and 107*b* have an outer diameter $\phi$ of 20 mm. In addition, as illustrated in FIG. 13, the elastic rubbers 105*b* and 107*b* of the first and second lower rollers 105 and 107 are formed in an area having a length L1 in the sheet widthwise center portion so as to be symmetrical with respect to the sheet passage center. Here, the sheet passage center refers to a position of the widthwise center serving as a reference when a sheet P is conveyed. The length L1 is set to be shorter than the maximum widthwise length of a sheet P that makes a corrugation trouble as illustrated in FIG. 8. In this embodiment, the length L1 is set to 100 mm.

In addition, an upper conveyance guide 114 and a lower conveyance guide 115 as a sheet guide member are provided between the nip portions of the first pair of rollers and the second pair of rollers, and the distance between the nip portions is set to 25 mm.

Both ends of roller shafts 104*a* and 106*a* of the first and second upper rollers 104 and 106, respectively, are supported by an upper side plate 119 using a bearing (not illustrated).

Both ends of the roller shaft 105*a* of the first lower roller 105 are supported by a first compression plate 113 using a bearing (not illustrated). The first compression plate 113 is rotatably supported by a lower side plate 120 using a first rotational shaft (not illustrated), and a bottom surface receives a force from the first compression spring 109. As a result, the first lower roller 105 is pressed to the first upper roller 104 to form a first nip portion N1.

Both ends of the roller shaft 107*a* of the second lower roller 107 are supported by the second compression plate 112 using a bearing (not illustrated). The second compression plate 112 is rotatably supported by a lower side plate 120 using a second rotational shaft (not illustrated), and a bottom surface receives a force from the second compression spring 108. As a result, the second lower roller 107 is pressed to the second upper roller 106 to form a second nip portion N2.

As illustrated in FIG. 11, a reflection light type sheet sensor 103 that detects arrival of a sheet P is arranged in a lower inlet guide 121. The sheet sensor 103 as a sheet detection unit is arranged to face the upstream side from the nip portion N2 of the second pair of rollers with a predetermined distance.

Figure 14:
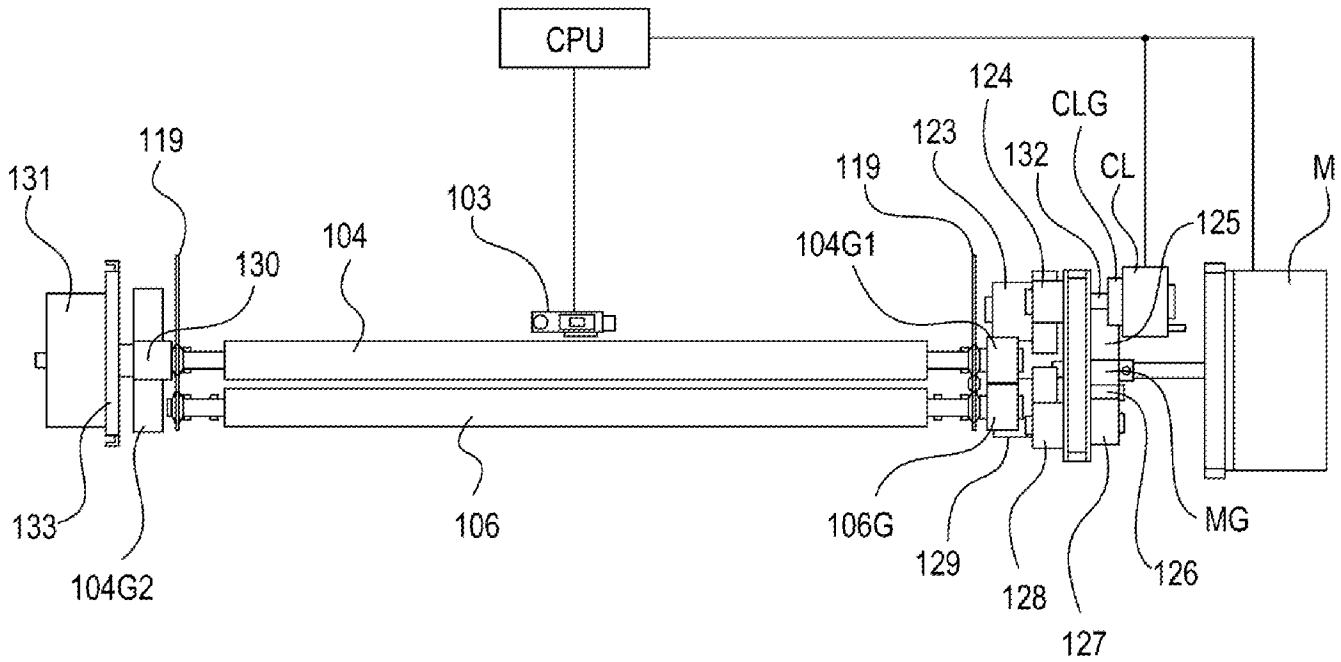
FIG. 14 is a top plan view illustrating the tensioning conveyance device in Embodiment 2.

FIG. 14 is a top plan view illustrating an operation of driving the first and second upper rollers 104 and 106. It is noted that a CPU serves as a control unit for controlling an operation of an electromagnetic clutch CL as a clutch unit (drive control unit) and a drive motor M as a drive unit in response to a signal of the sheet sensor 103.

As illustrated in FIG. 14, a drive gear 104G1 is held and fixed in one end of the first upper roller 104. The first upper roller 104 is rotated by receiving a rotational driving force from a motor gear MG of a drive motor M serving as a drive source (drive unit) via drive transmission gears 123, 124, and 125 and a clutch gear CLG. The first lower roller 105 pressed by the first upper roller 104 is drivenly rotated by rotation of the first upper rollers 104.

A drive gear 106G is held and fixed in one end of the second upper roller 106. The second upper roller 106 is rotated by receiving a rotational driving force from a motor gear MG of a drive motor M serving as a drive source via drive transmission gears 126, 127, 128, and 129. The second lower roller 107 pressed by the second upper roller 106 is drivenly rotated by rotation of the second upper rollers 106.

The clutch gear CLG is fixed to the electromagnetic clutch CL. As electricity flows through the electromagnetic clutch CL, a driving force between the clutch gear CLG and the drive transmission gear 124 is transmitted via a clutch shaft 132 so that the first upper roller 104 is rotated. Meanwhile, if electricity does not flow to the electromagnetic clutch CL, a driving force is not transmitted between the clutch gear CLG and the drive transmission gear 124, and the driving force of the drive motor M is not transmitted to the drive gear 104G. In addition, the first upper roller 104 is not rotated.

A drive gear 104G2 is fixed to the other end of the first upper roller 104. The drive gear 104G2 is connected to a load unit 131 such as a torque limiter and an electromagnetic brake through a drive transmission gear (driving force transmission member) 130.

Figure 15:
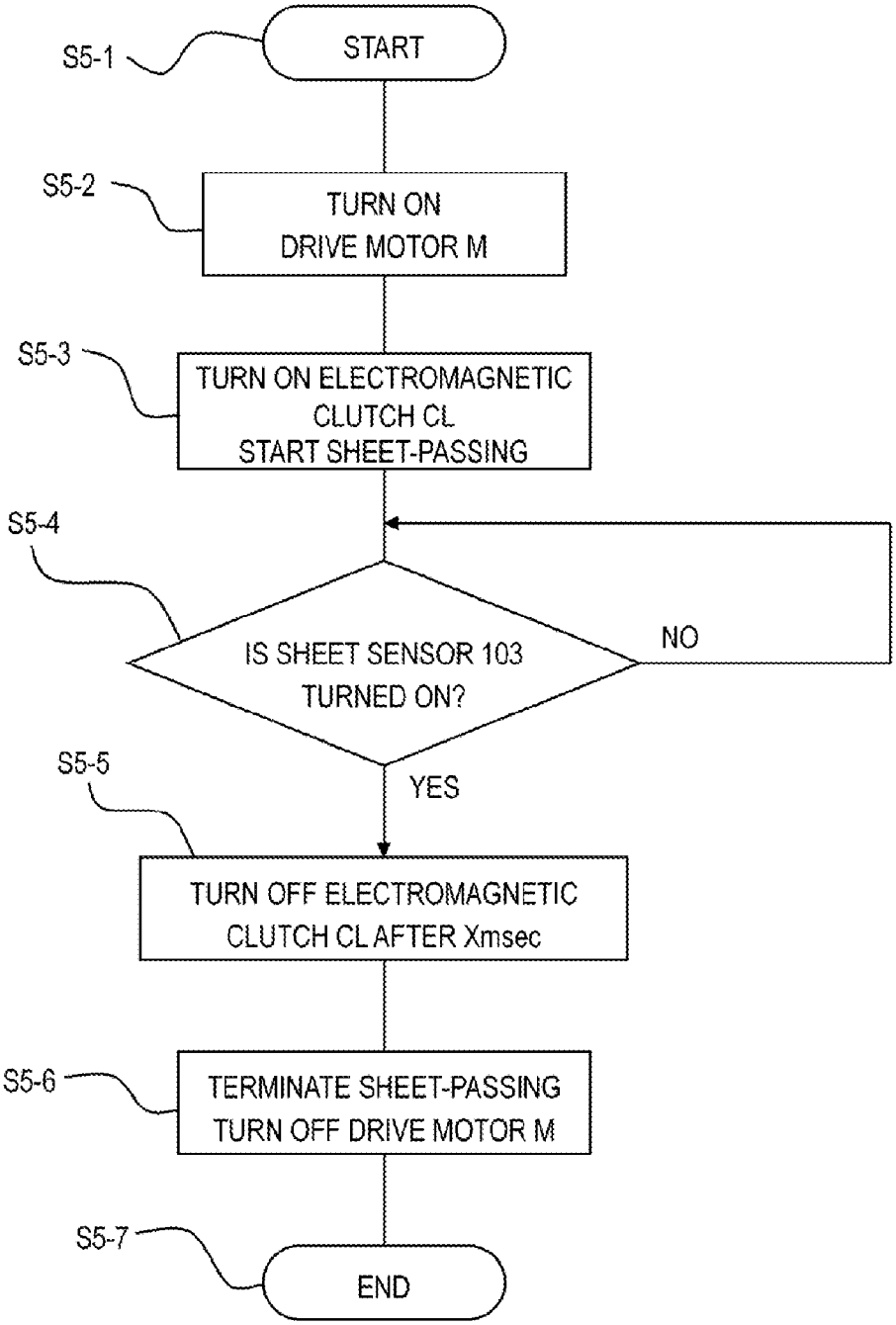
FIG. 15 is a flowchart illustrating control of the tensioning conveyance device in Embodiment 2.
Figure 16:
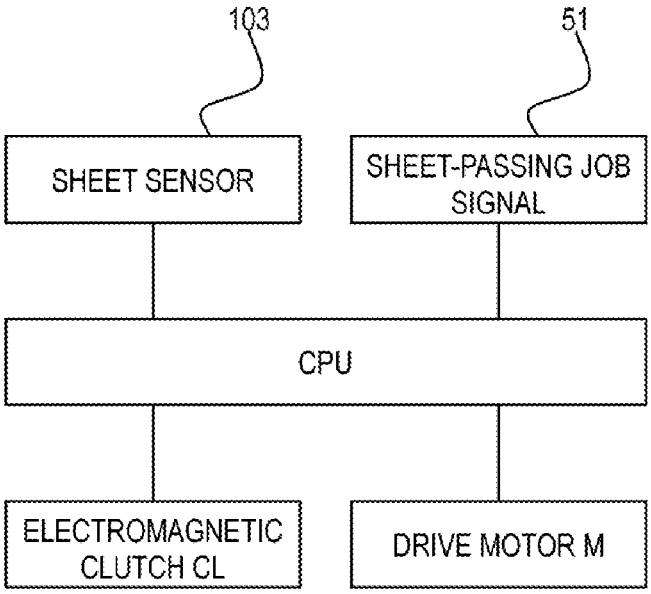
FIG. 16 is a block diagram illustrating control of the tensioning conveyance device in Embodiment 2.
Figure 17B:
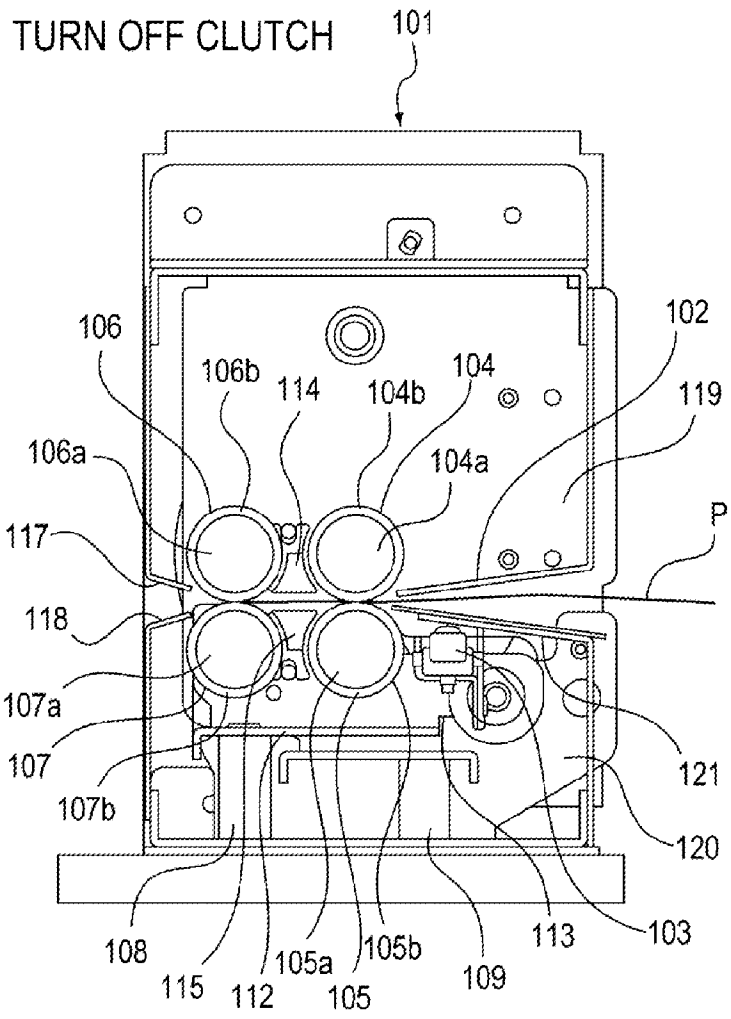
FIGS. 17A and 17B are cross-sectional views illustrating control of the tensioning conveyance device in Embodiment 2.
Figure 17A:
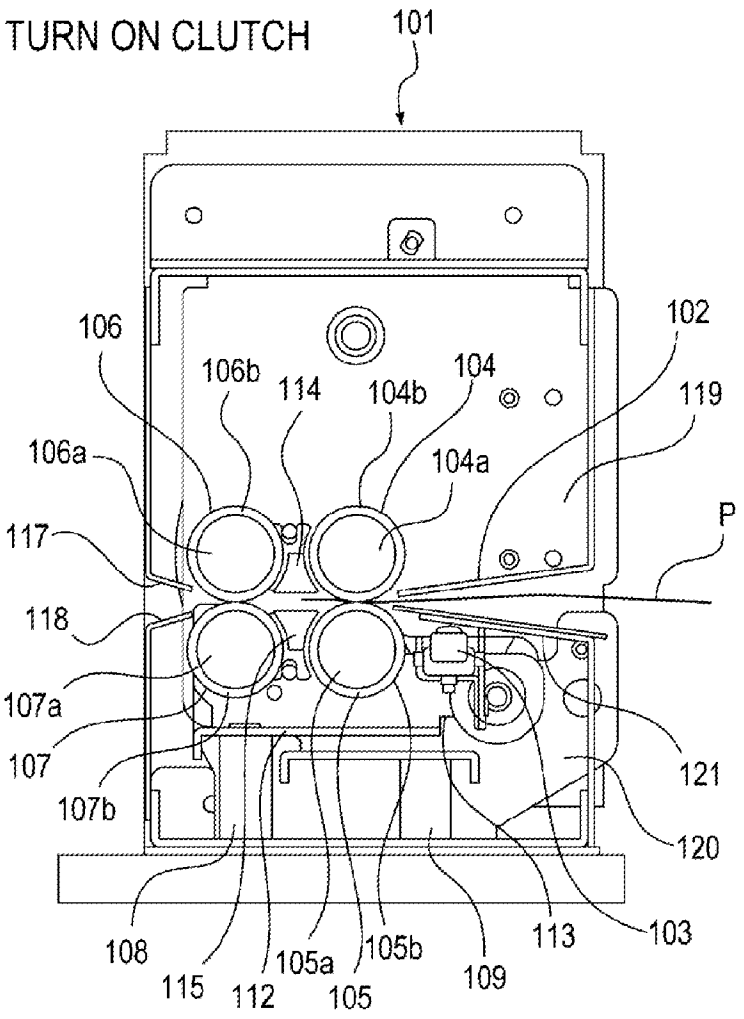

FIG. 15 is a flowchart illustrating a drive control operation according to Embodiment 2, and FIG. 16 is a block diagram illustrating a drive control operation according to Embodiment 2. FIGS. 17A and 17B are front cross-sectional view illustrating a tensioning device 101 for describing a drive control operation according to Embodiment 2. FIG. 17A is a front cross-sectional view illustrating the operation of the tensioning device at timing 0 to X msec after the sheet sensor is turned on, and FIG. 17B is a front cross-sectional view illustrating the operation of the tensioning device at timing X msec after the sheet sensor is turned on.

A description will be made for a flowchart of FIG. 15. As a sheet-passing job signal 51 of FIG. 16 is input to an input terminal of the CPU (control unit) (S5-1), the drive motor M is turned on (S5-2). As the drive motor M is turned on, the electromagnetic clutch CL is also turned on to start a sheet-passing operation (S5-3). As a result, a driving force of the drive motor M is transmitted to the drive gears 104G1 and 106G through the drive transmission gears as described above so that the first and second upper rollers 104 and 106 are rotated.

Then, as a sheet P is guided to the lower inlet guide 121 in the tensioning device 101, and a signal for turning on the sheet sensor 103 is recognized (S5-4), the electromagnetic clutch CL is turned off after X msec (S5-5). The value "X" is set to time immediately after the sheet sensor 103 is turned on, and a leading end of the sheet P is nipped in the nip portion of the second pair of rollers. The value "X" is determined based on a conveyance speed of the sheet P and a distance from the sheet sensor 103 to the nip portion of the second pair of rollers. That is, the control unit determines that the a sheet is nipped in the nip portion of the second pair of rollers based on a predetermined distance from the sheet sensor 103 to the nip portion of the second pair of rollers and the conveyance speed of the sheet P. In this embodiment, since the conveyance speed of the sheet P is 300 mm/s, and the distance from the sheet sensor 103 to the second pair of rollers is 45 mm, the value "X" is set to 160 msec (X=160 msec).

As the sheet sensor 103 is turned on, and the electromagnetic clutch CL is turned off after X msec, the drive operation of the first upper roller 104 is released. That is, when 0 to X msec elapses after the sheet sensor is turned on, the electromagnetic clutch CL is turned on as illustrated in FIG. 17A. Therefore, the first upper roller 104 receives a driving force to convey the sheet P. Then, as illustrated in FIG. 17B, when X msec elapses after the sheet sensor is turned on, the leading end of the sheet P reaches the nip portion of the second pair of rollers, and the sheet P is conveyed by driving the second upper roller 106. At the same time, the electromagnetic clutch CL is turned off, and no driving force is transmitted to the first upper roller 104. Therefore, the first pair of rollers is drivenly rotated. In addition, since the first upper roller 104 is connected to the load unit 131 through the drive gear 104G2 and the drive transmission gear 130, a torque load is generated in order to rotate the first upper roller 104. As a result, in FIG. 17B, a sheet P is conveyed while a predetermined tension force (tensile strength) is generated in the sheet P between the first pair of rollers and the second pair of rollers. In this embodiment, a load torque of the load unit 131 is set such that a tension force applied to a sheet P is approximately 59 N (approximately 6 kgf).

In this embodiment, as illustrated in FIG. 13, the nip portions of the first and second pairs of rollers have a width (length L1) of 100 mm in the sheet-passing center of a sheet. As a result, a tension force (tensile strength) of approximately 59 N (approximately 6 kgf) is applied only to the widthwise center portion of the sheet P from a leading end to a trailing end. Then, as the sheet-passing operation is terminated, the drive motor M is turned off (S5-6), and the process is terminated (S5-7). The aforementioned flow is repeated in the second and subsequent sheets.

With reference to FIG. 8, a description will be made for a shape characteristic of a curl or an edge corrugation generated in a sheet P and a measurement method. A sheet P passing through only the nip portion N of the fixing device 100 or a sheet P passing through the nip portion N of the fixing device 100 and then continuously through the sheet tensioning device 101 as illustrated in FIG. 11 is loaded on a measurement table 650 as illustrated in FIG. 8. Here, "L edge [mm]" denotes an edge length of a sheet P in a sheet feeding direction, and "L center [mm]" denotes a center length.

A wave shape Pwave generated in the upper or lower side of the sheet P of FIG. 8, that is, the edge portion of the width direction perpendicular to the sheet feeding direction will be referred to as an edge corrugation. As an evaluation target, the largest one X max of gaps from the measurement table 650 is set as a corrugation length.

FIGS. 18A to 18C show a result of the experiment for checking effects of the tensioning device 101 performed by the inventors according to Embodiment 2. FIG. 18A describes the edge length L edge [mm], the center length L center [mm], and the maximum corrugation amount X max [mm] of a sheet P immediately after the sheet P passes through the fixing device at a conveyance speed of 300 mm/s. FIG. 18B describes the edge length L edge [mm], the center length L center [mm], and the maximum corrugation amount X max [mm] of a sheet P immediately after the sheet P passes through the fixing device and the tensioning device according to Embodiment 2 at a conveyance speed of 300 mm/s.

As illustrated in FIG. 18A, an elongation amount of the center length L center immediately after a sheet P passes through the fixing device is 0 mm, and an elongation amount of the edge length L edge is 0.6 mm, so that the edge length is longer than the center length by 0.6 mm. This is because, in the case of the fixing device having a wide nip, an ironing effect is provided to a sheet by setting a conveyance speed of the sheet edge portion of the width direction to be higher than that of the sheet widthwise center portion in the nip portion in order to prevent a sheet folding while a sheet passes through a nip as described above. In this case, the sheet edge elongates relative to the vicinity of the center after the sheet is discharged from the nip portion.

Then, if a sheet passes through the tensioning device according to Embodiment 2 at a speed of 300 mm/s after it passes through the fixing device at a speed of 300 mm/s as illustrated in FIG. 18B, an elongation amount of the center length L center measured by placing the sheet P for one day after it passes through the tensioning device is 0.4 mm. In comparison, the elongation amount of the edge length L edge is 0.6 mm, and a difference between the edge length and the center length is 0.2 mm. That is, since the center portion of a sheet P is pulled by virtue of the effect of the tensioning device (applying a tensile strength) according to Embodiment 2, the center of the sheet P elongates in the sheet feeding direction. As a result, a difference between the edge portion and the center is reduced. Accordingly, since the sheet length difference between the edge portion and the center is reduced, the maximum corrugation amount of FIG. 18A is 3.3 mm, and the maximum corrugation amount of FIG. 18B is 1.7 mm. That is, the difference is reduced by approximately ½.

In this manner, since a tensile strength in the sheet feeding direction is applied to the center area of the width direction perpendicular to the sheet feeding direction using the first and second pairs of rollers, a relationship of the edge length and the center length in the sheet feeding direction is set to $A<A'$ and $B-A>B'-A'$. Here, "A" denotes a length of the sheet widthwise center portion in the sheet feeding direction before a sheet passes through the tensioning device 101, and "A'" denotes a length of the sheet widthwise center portion in the sheet feeding direction after a sheet passes through the tensioning device. In addition, "B" denotes a length of the sheet widthwise edge portion before a sheet passes through the tensioning device 101, and "B'" denotes a length of the sheet widthwise edge portion after a sheet passes through the tensioning device 101.

If the lengths A, A', B, and B' are substituted with the numerical values of FIG. 18, the value "A" corresponds to the center length after a sheet is discharged in FIG. 18A, the value "B" corresponds to the edge length after a sheet is discharged in FIG. 18B, the value "A'" corresponds to the center length after a sheet is discharged in FIG. 18B, and the value "B'" corresponds to the edge length after a sheet is discharged. Therefore, the relationship of the aforementioned lengths is established as "$A<A'$" and "$B-A>B'-A$."

As described above, since a sheet widthwise center portion is pulled as the sheet passes through the tensioning device according to Embodiment 2, a difference of the sheet length between the center portion and the edge portion is reduced, and it is possible to correct a corrugation.

In Embodiment 2, the elastic rubbers 105*b* and 107*b* of the first and second lower rollers 105 and 107, respectively, have a width of 100 mm. However, the invention is not limited thereto. The outer diameters of the elastic rubbers 105*b* and 107*b* of the first and second lower rollers 105 and 107, respectively, may change along a rotational axis direction at least in part such that an outer diameter in the center portion of the rotational axis direction may be larger than that in the edge portion of the rotational axis direction.

Figure 19:
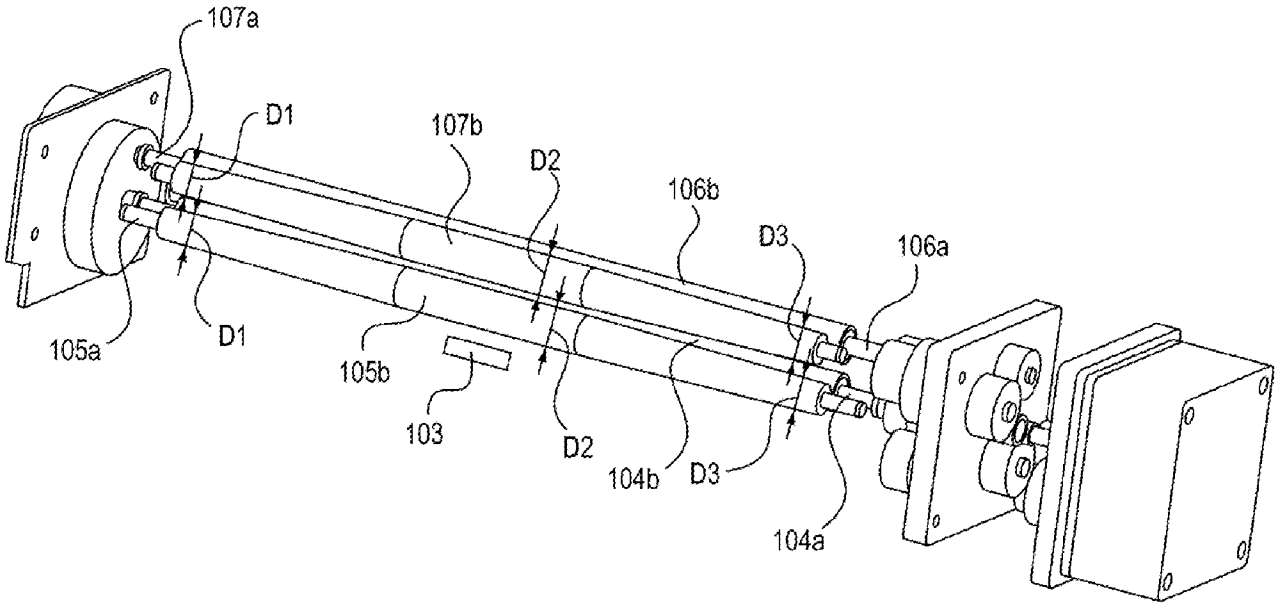
FIG. 19 is a perspective view illustrating the tensioning conveyance device in Embodiment 2.

For example, as illustrated in FIG. 19, the widthwise lengths of the elastic rubbers 105*b* and 107*b* of the first and second lower rollers 105 and 107, respectively, may be longer than the maximum sheet widthwise length so that a relationship "D2>D1 or D3" is established, where "D2" denotes an outer diameter of the elastic rubber in the vicinity of the center portion, and "D1 and D3" denote outer diameters in both ends. In FIG. 19, the outer diameters are set such that "D2=25 mm" and "D1 or D3=24.7 mm." The width D2 has a straight shape only in the center portion of 100 mm and is tapered toward the edge portion therefrom.

As a result, the conveyance speed of a sheet P becomes faster in the center portion relative to the edge portion, and a nip pressure increases in the center portion. Therefore, a tension is applied to the sheet center portion. Accordingly, as described in the aforementioned embodiment, by pulling the sheet center portion, it is possible to reduce a difference of the sheet length between the edge portion and the center and correct a corrugation. Although the rollers have a tapered shape in FIG. 19, an outer diameter of the roller may have a crown shape such as a parabolic shape.

Embodiment 3

Embodiment 3 will be described with reference to FIGS. 20 to 23. In this embodiment, only a drive mechanism is modified, and other components are similar. Therefore, a description thereof will not be repeated here.

Figure 20:
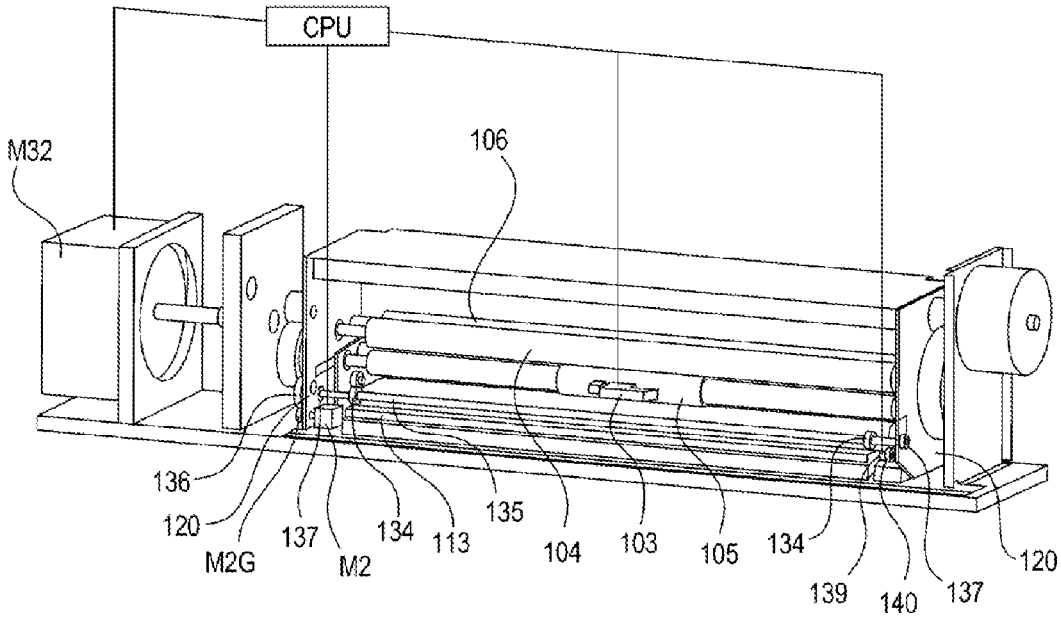
FIG. 20 is a perspective view illustrating a tensioning conveyance device in Embodiment 3.
Figure 21:
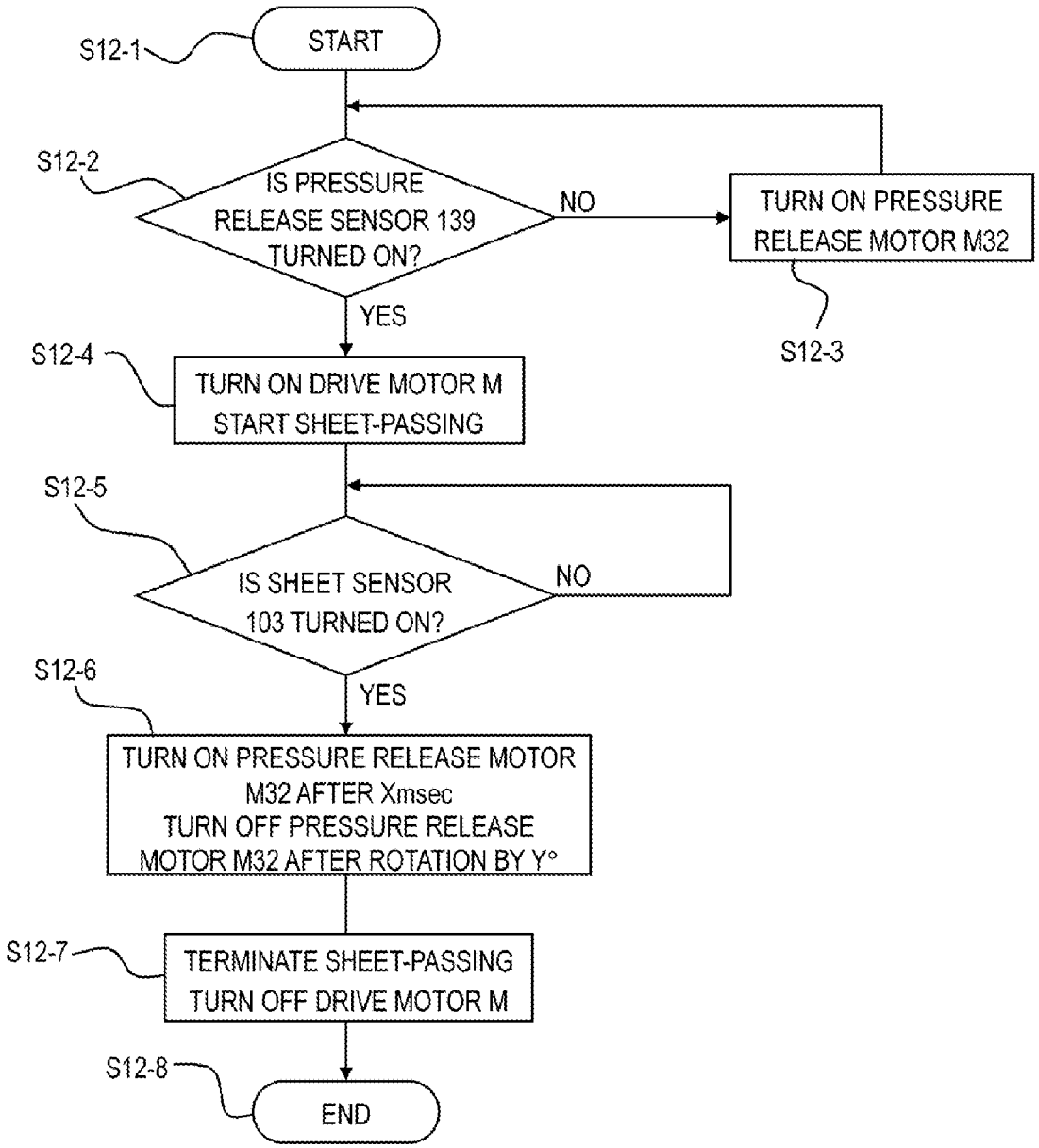
FIG. 21 is a flowchart illustrating control of the tensioning conveyance device in Embodiment 3.
Figure 22:
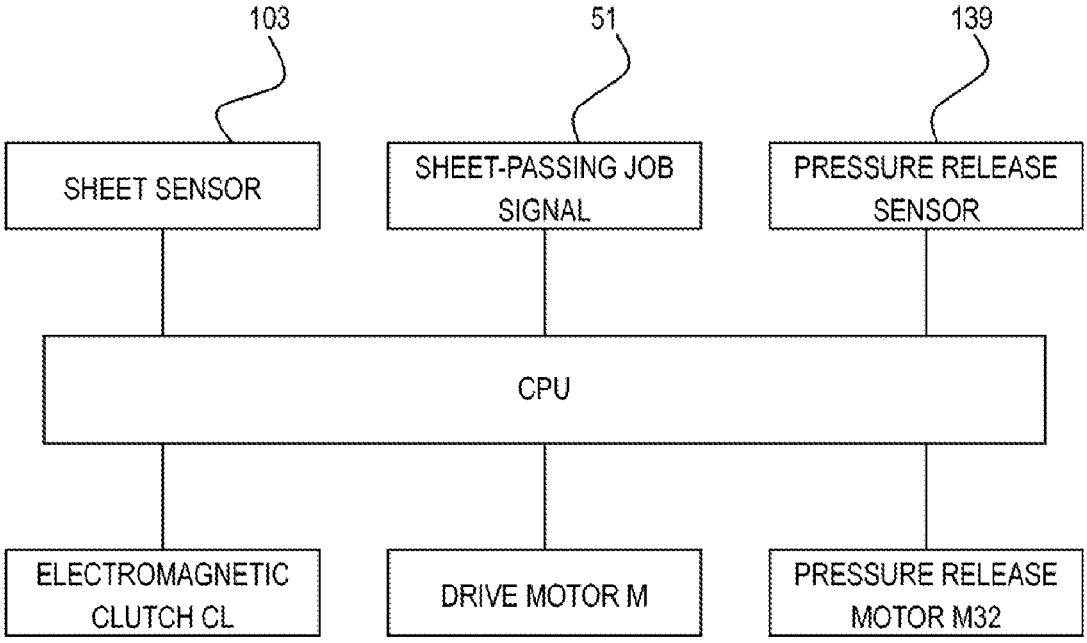
FIG. 22 is a block diagram illustrating control of the tensioning conveyance device in Embodiment 3.
Figure 23A:
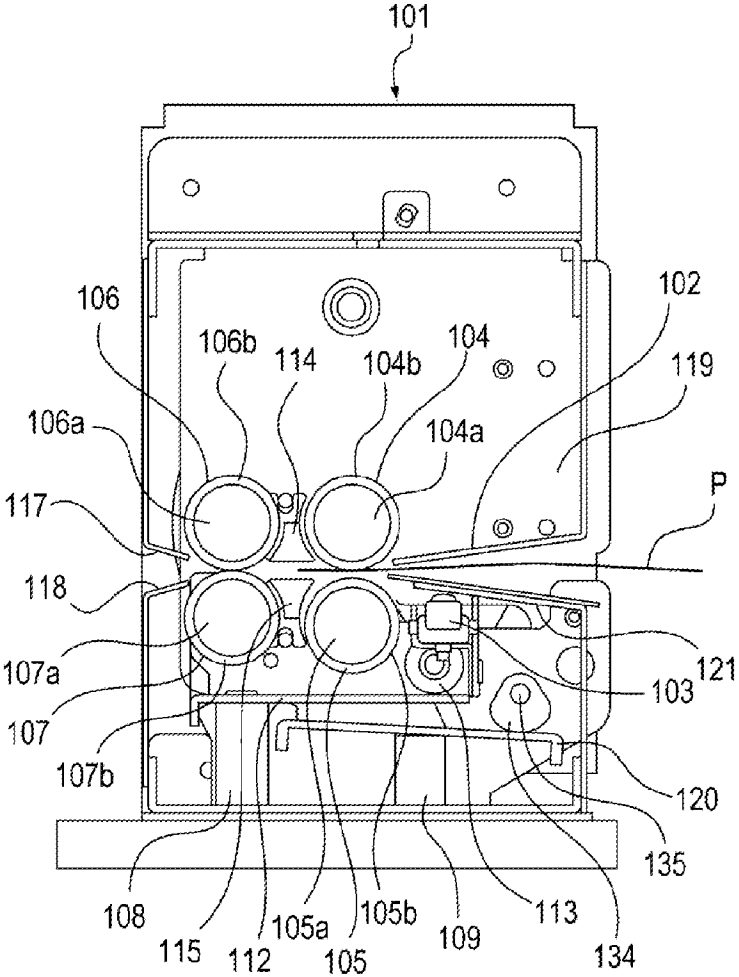
FIGS. 23A and 23B are cross-sectional views illustrating control of the tensioning conveyance device in Embodiment 3.
Figure 23B:
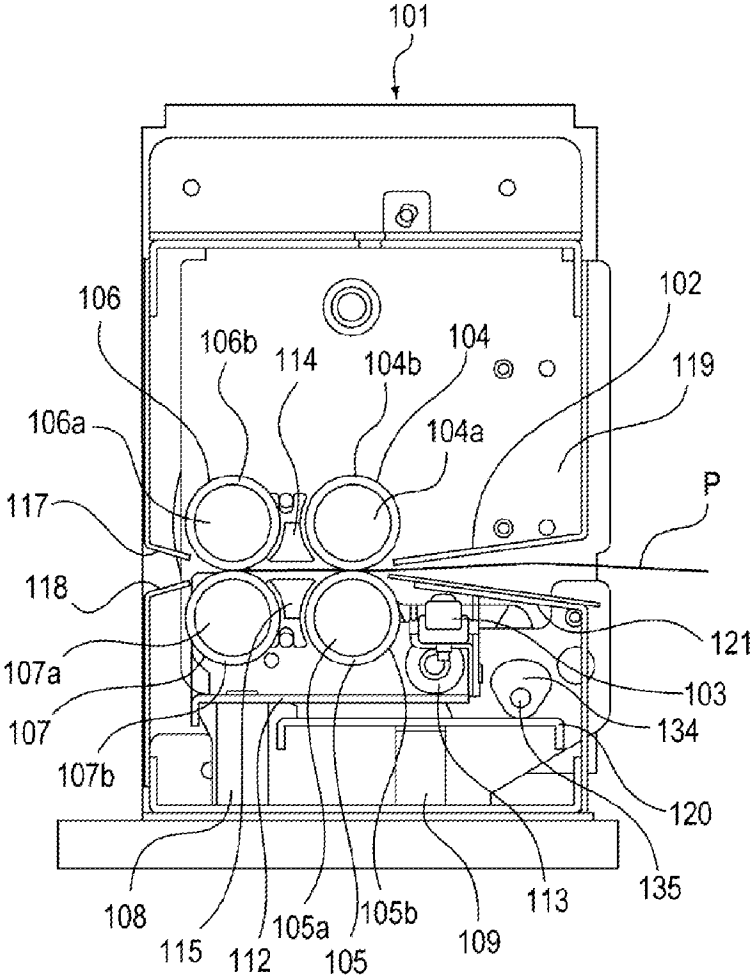

FIG. 20 is a perspective view illustrating a tensioning device 101 according to Embodiment 3. FIG. 21 is a flowchart illustrating a control operation of Embodiment 3. FIG. 22 is a block diagram illustrating a control operation of Embodiment 3. FIGS. 23A and 23B are front cross-sectional views illustrating the tensioning device 101 for describing a control operation and a configuration of Embodiment 3. FIG. 23A is a front cross-sectional view at timing 0 to X msec after the sheet sensor is turned on. FIG. 23B is a front cross-sectional view at timing X msec after the sheet sensor is turned on.

A drive gear is not provided in one end of the first upper roller 104 in FIG. 20. For this reason, the first upper roller 104 is not connected to a motor gear of a drive motor M through a connecting gear.

Meanwhile, a drive gear (not illustrated) is held and fixed in one end of the second upper roller 106 in FIG. 20. The second upper roller 106 is rotated by a motor gear (not illustrated) of a drive motor M serving as a drive source (drive unit) as the drive gear is rotationally driven through a drive transmission gear (not illustrated).

Hereinafter, a pressure release mechanism of the first lower roller 105 as a characteristic of Embodiment 3 will be described. The pressure release mechanism of the first lower roller 105 serves as a pressure release portion for releasing a pressing force of the first lower roller 105 toward the first upper roller and is configured as described below.

Pressure release cams 134 are arranged in upper surface portions of the near and far sides of the first compression plate 113 pressing the first lower roller 105. The pressure release cam 134 is fixed to a pressure release shaft 135. The pressure release shaft 135 is supported by a lower side plate 120 using a bearing 137 in both sides. The drive gear 136 is fixed to one end of the pressure release shaft 135 and is connected to a pressure release motor gear M2G of a pressure release motor M32 fixed to the lower side plate 120. In addition, a sensor flag 140 is fixed to the other end of the pressure release shaft 135 to enable detection of a rotational position of the pressure release cam 134 using the pressure release sensor 139.

In this configuration, in a position where the pressure release sensor 139 is turned on (FIG. 23A), the pressure release cam 134 makes contact with the first compression plate 113 and presses it. As a result, the first lower roller 105 is separated from the first upper roller 104 so that the pressure is released (pressure release state).

In a position where the pressure release motor M32 is turned on from the pressure release position, and the pressure release cam 134 is rotated by 180° (FIG. 23B), the pressure release cam 134 does not make contact with the first compression plate 113. Therefore, the first lower roller 105 is pressed to the first upper roller 104 (pressing state).

Next, a control operation of Embodiment 3 will be described with reference FIGS. 21 and 22.

A description will be made for the flowchart of FIG. 21. As a sheet-passing job signal 51 of FIG. 22 is input to an input terminal of a CPU (control unit) (S12-1), it is checked whether or not the pressure release sensor 139 is turned on (S12-2). If it is checked that the pressure release sensor 139 is not turned on, the first lower roller 105 is pressed to the first upper roller 104 as described above. Therefore, the pressure release motor M32 is turned on to operate the pressure release motor M32 until the pressure release sensor 139 is turned on (S12-3). While the pressure release sensor 139 is turned on, the first lower roller 105 is separated from the first upper roller 104 so that the pressure is released. Therefore, the drive motor M is turned on to start a sheet-passing operation (S12-4). As a result, as described above, a driving force of the drive motor M is transmitted to a drive gear (not illustrated) via a drive transmission gear so that the second upper roller 106 is rotated.

Then, as a sheet P is guided to a lower inlet guide 121 in the tensioning device 101, and an ON-signal of the sheet sensor 103 is recognized (S12-5), the pressure release motor M32 is turned on after X msec so that a motor shaft is rotated by Y°, and the pressure release motor M32 is turned off (S12-6). The value "X" is set to time elapsing after the sheet sensor 103 is turned on until a leading end of a sheet P is nipped into a nip portion of the second pair of rollers. The value "X" is determined based on a conveyance speed of the sheet P and a distance from the sheet sensor 103 to the nip portion of the second pair of rollers. In this embodiment, similar to Embodiment 2, since the conveyance speed of the sheet P is set to 300 mm/s, and the distance from the sheet sensor 103 to the nip portion of the second pair of rollers is set to 45 mm, the value of "X" is set to 160 msec. The value of "Y" is determined based on a rotation angle of the motor shaft necessary to rotate the pressure release cam 134 by 180° and a gear ratio between the pressure release motor gear M2G and the drive gear 136. In this embodiment, a ratio between the number of teeth of the pressure release motor gear M2G and the number of teeth of the drive gear 136 is set to 1:3. Therefore, a rotation angle of the motor shaft of the pressure release motor M32 necessary to rotate the pressure release cam 134 by 180° becomes 540° (Y=540°).

If the pressure release motor M32 is turned on when X msec elapses after the sheet sensor 103 is turned on, and the pressure release motor M32 is turned off after the motor shaft is rotated by Y°, the pressure release cam 134 stops in a position (FIG. 23B) rotated by 180° from the pressure release position (FIG. 23A). As a result, since the pressure release cam 134 does not make contact with the first compression plate 113, the first lower roller 105 is pressed to the first upper roller 104. That is, as illustrated in FIG. 23A, when 0 to X msec elapses after the sheet sensor is turned on, the first lower roller 105 is separated from the first upper roller 104, and no pressure is applied as described above. For this reason, a sheet P is conveyed through a gap between the upper and lower conveyance guides 114 and 115 by a pair of entrance rollers 503 of FIG. 11. Then, as illustrated in FIG. 23B, when X msec elapses after the sheet sensor is turned on, a leading end of a sheet P immediately reaches the nip portion of the second pair of rollers, and a sheet P is conveyed by driving the second upper roller 106. At the same time, as described above, in the first pair of rollers in which the first lower roller 105 is pressed to the first upper roller 104, a driving force is not transmitted to the first upper roller 104. Therefore, the first upper roller 104 is drivenly rotated. In addition, since the first upper roller 104 is connected to a load unit 131 via a driving force transmission member such as a drive gear 104G2 and a drive transmission gear 130, a predetermined load torque is generated in order to rotate the first upper roller 104. As a result, in FIG. 23B, a sheet P is conveyed while a tension force (tensile strength) is generated in the sheet P between the first pair of rollers and the second pair of rollers. In this embodiment, a load torque of the load unit 131 is set such that a tension force applied to a sheet P is approximately 59 N (approximately 6 kgf).

Similarly, in this embodiment, the nip portions of the first and second pairs of rollers have a width (length L1) of 100 mm in the sheet-passing center of a sheet. As a result, a tension force (tensile strength) of approximately 59 N (approximately 6 kgf) is applied only to the widthwise center portion of the sheet P from a leading end to a trailing end. Then, as the sheet-passing operation is terminated, the drive motor M is turned off (S12-7), and the process is terminated (S12-8). The aforementioned flow is repeated in the second and subsequent sheets.

As a result of the experiment performed by the inventions using the aforementioned configuration, it was observed that the effects similar to those of Embodiment 2 illustrated in FIG. 18 can be obtained.

As described above, since a sheet passes through the tensioning device according to Embodiment 3 by pulling the sheet widthwise center portion in the sheet feeding direction, it is possible to reduce a difference of the sheet length between the edge portion and the center portion and correct a corrugation.

Embodiment 4

An image forming apparatus having a sheet processing apparatus according to Embodiment 4 will be described with reference to FIGS. 24 to 29. In the following description, first, an image forming apparatus will be described. Then, a sheet processing apparatus will be described. In this embodiment, a description will be made for an image forming system having the sheet processing apparatus connected to the outside of the image forming apparatus. However, the invention may also apply to a configuration of the image forming system having the sheet processing apparatus integrated into the inside of the image forming apparatus.

Figure 24:
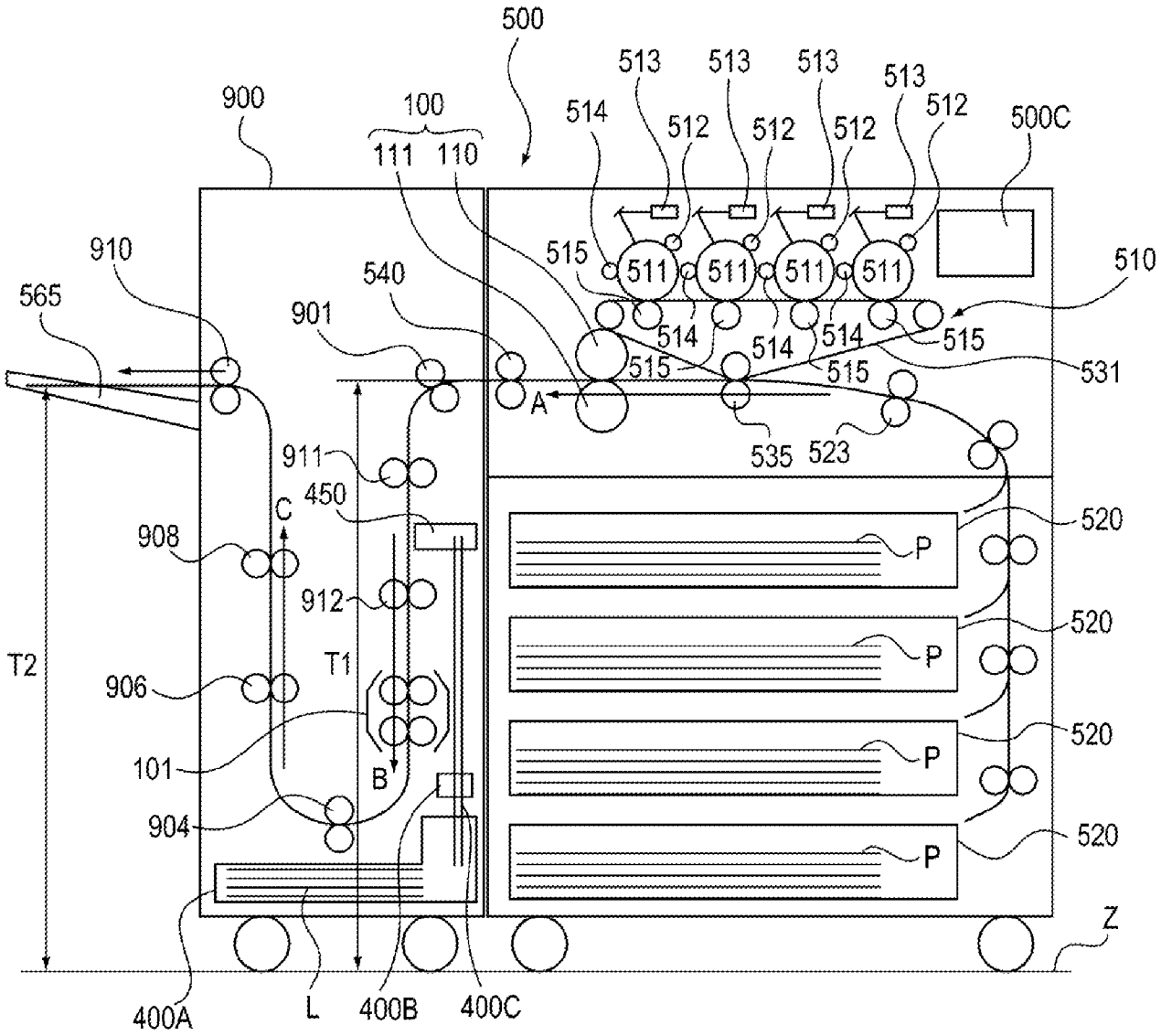
FIG. 24 is a cross-sectional view illustrating an electrophotographic printer in Embodiment 4.

First, an image forming apparatus as an example of the image forming system and a sheet processing apparatus detachably attached to the image forming apparatus will be described with reference to FIG. 24. FIG. 24 is a cross-sectional view schematically illustrating a color electrophotographic printer 500 as an example of the image forming apparatus and a sheet corrugation correcting device 900 having a tensioning device 101 and a moisture adding device 450 as an example of the sheet processing apparatus along a sheet feeding direction. Note that, in the following description, the color electrophotographic printer will be simply referred to as a "printer."

A toner image is formed on a sheet. Specifically, the sheet may include, for example, a plain paper sheet, a resin sheet as a substitute of the plain paper sheet, a thick paper sheet, an overhead projector applicable sheet, and the like.

The printer 500 of FIG. 24 has the same configuration as the printer 500 described in conjunction with FIG. 1 in Embodiment 1 described above. Therefore, like reference numerals denote like elements, and a description thereof will not be repeated in detail here.

In the printer 500 of FIG. 24, a sheet P having a toner image fixed by the fixing device 100 is fed to a sheet corrugation correcting device 900 by a pair of discharge rollers 540. The sheet P is conveyed by a pair of entrance rollers 901 of the sheet corrugation correcting device 900, and the conveyance direction is changed to an approximately vertically downward direction (arrow direction B in FIG. 24). Then, the sheet P is fed to a sheet moistening device 450 as a moisture adding device. The sheet moistening device 450 is arranged in the middle of a conveyance path from a pair of conveying rollers 911 to a pair of conveying rollers 912. While the sheet P passes through a side face of the sheet moistening device 450, the sheet P is moistened by the sheet moistening device 450.

The sheet P passing through the sheet moistening device 450 is fed to the sheet tensioning conveyance device 101 as a tensioning device by the pair of conveying rollers 912. The sheet P is moistened at a predetermined moisture amount or higher by the sheet moistening device 450 and then passes through the sheet tensioning conveyance device 101. Therefore, a length difference in the sheet feeding direction between the widthwise center portion and the widthwise edge portion is reduced by pulling, along the sheet feeding direction, a center portion of the width direction perpendicular to the sheet feeding direction.

In this manner, the sheet P having no corrugation in the sheet widthwise edge portion is conveyed by the pair of conveying rollers 904 by changing the sheet feeding direction to an approximately vertically upward direction (arrow direction C in FIG. 24). Then, the sheet P is conveyed by a pair of conveying rollers 906 and 908 and is discharged to the outside of the sheet corrugation correcting device 900 by a pair of discharge rollers 910. The discharged sheet P is loaded on a discharge tray 565.

Figure 27:
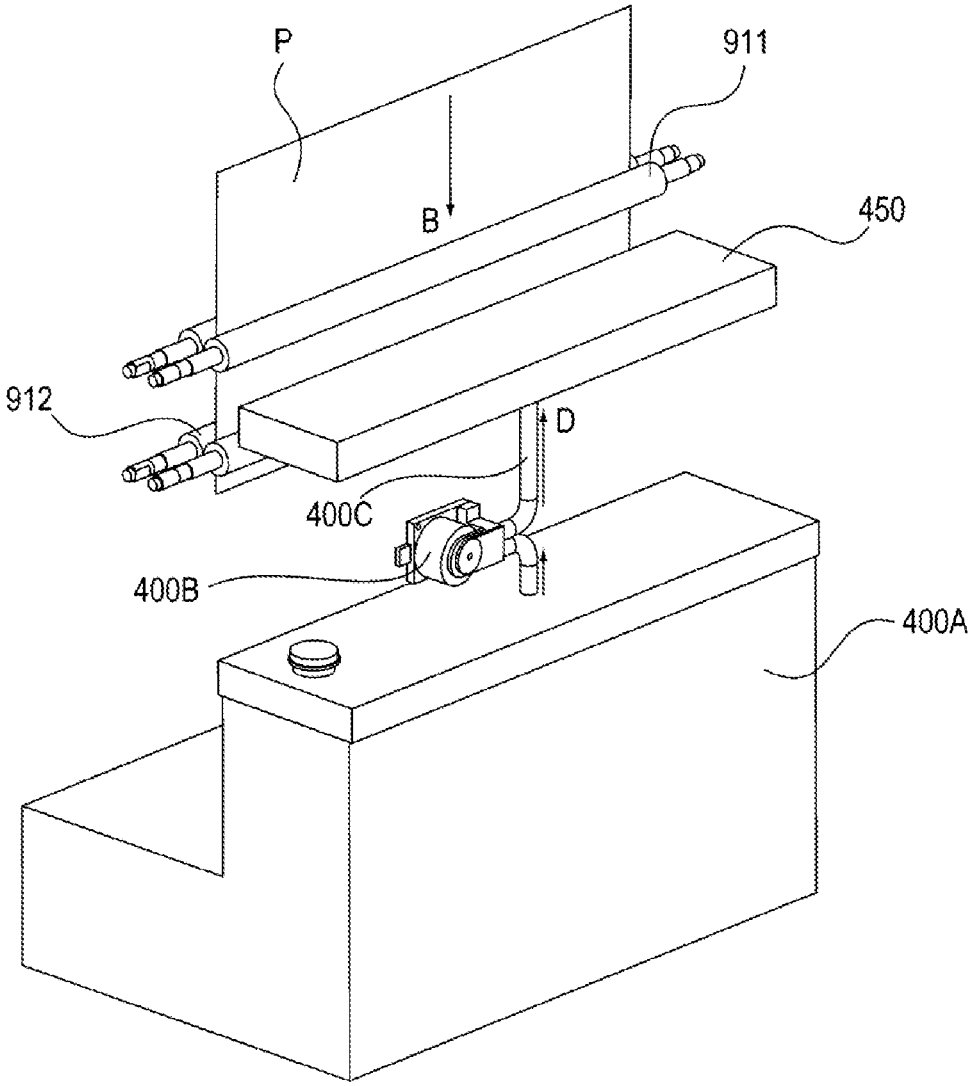
FIG. 27 is a perspective view illustrating the moistening device and surroundings of a reservoir.

FIG. 27 illustrates a configuration around a pair of conveying rollers 911, a pair of conveying rollers 912, a sheet moistening device 450, a reservoir 400A, and a liquid supply pump 400B.

In FIGS. 24 and 27, a moistening liquid L for moistening the sheet P is stored in a reservoir 400A. The moistening liquid L stored in the reservoir 400A is occasionally supplied to the sheet moistening device 450 through the liquid supply pipe 400C in the arrow direction D of FIG. 27 using the liquid supply pump 400B. The moistening liquid L contains water as a main component and may also contain a surfactant in consideration of moistening efficiency or a penetration capability to a sheet P.

Figure 28:
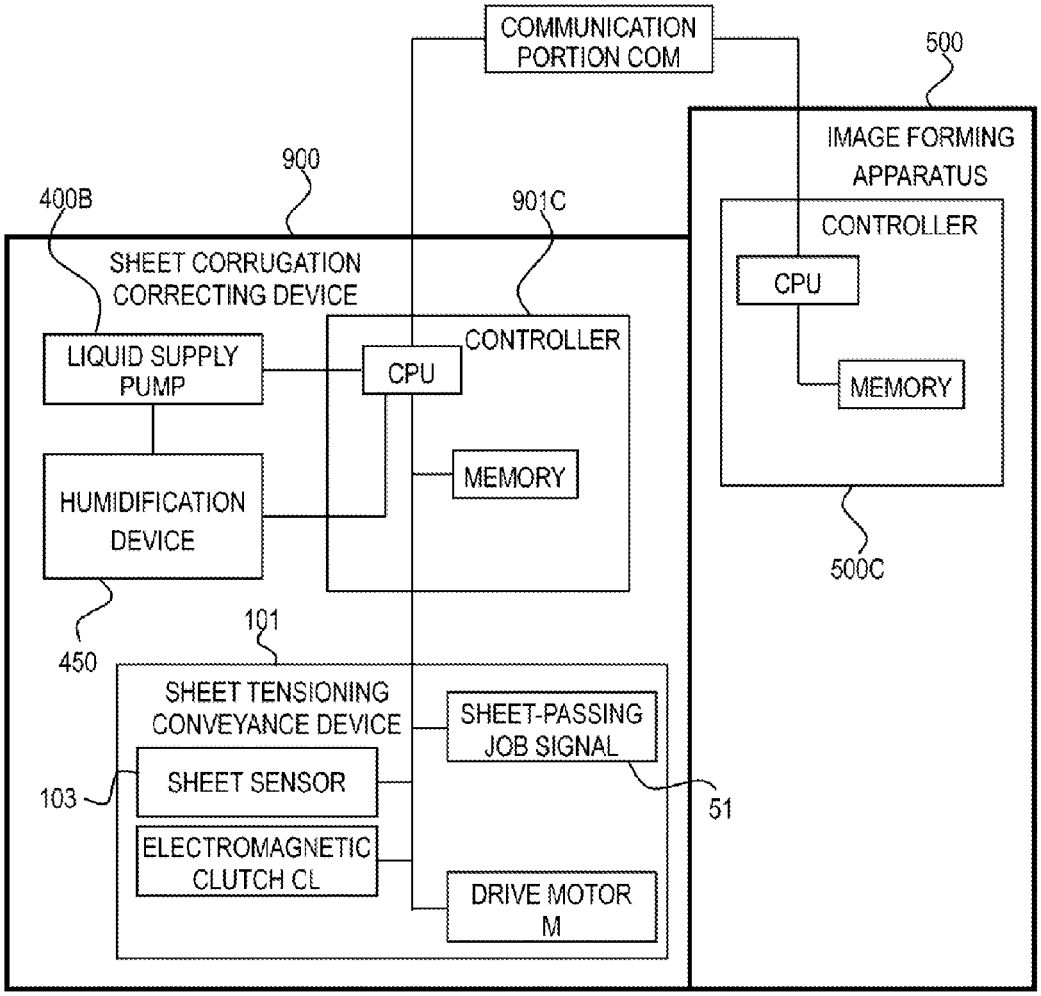
FIG. 28 is a block diagram illustrating control of a printer and a sheet corrugation correcting device in Embodiment 4.

Here, a control relationship of the entire image forming system will be described with reference to FIG. 28. FIG. 28 is a block diagram illustrating a control relationship in the entire image forming system including the printer 500 and the sheet corrugation correcting device 900. A computer system having a CPU, a memory, an operational unit, an input/output (I/O) port, a communication interface, a driving circuit, and the like is employed in a controller 500C of the printer 500 and a controller 901C of the sheet corrugation correcting device 900.

The control operations of each controller 500C and 901C described above are performed by causing the CPU to execute a predetermined program stored in the memory. The controller 901C of the sheet corrugation correcting device 900 controls the operations of the sheet tensioning conveyance device 101 and the sheet moistening device 450 included in the apparatus. In addition, the controllers 500C and 901C described above are connected to each other using a communication portion COM to exchange information.

Figure 25:
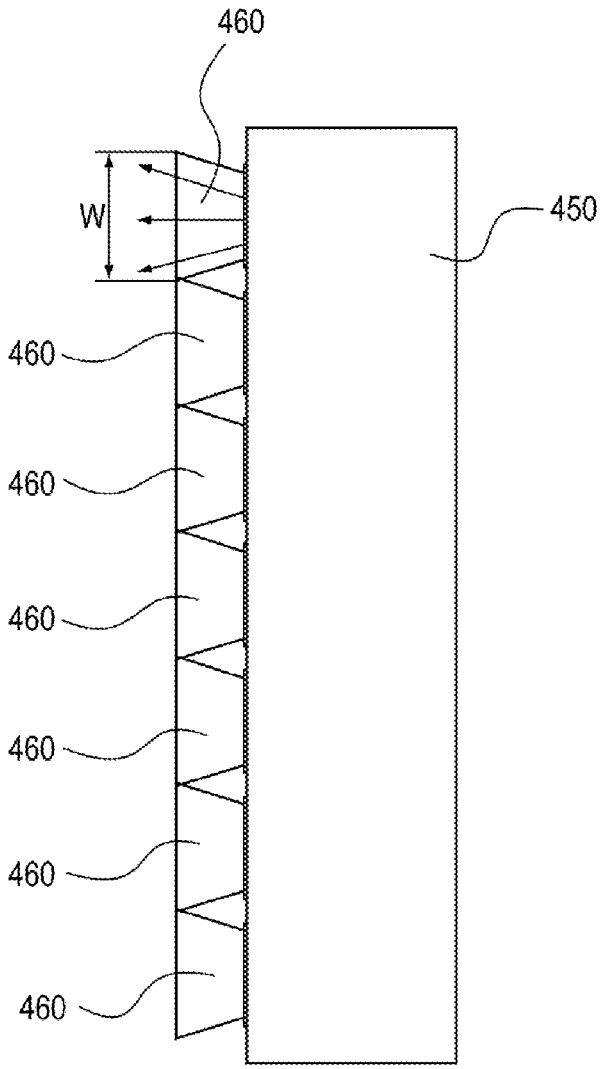
FIG. 25 is a top plan view illustrating a moistening device in Embodiment 4.
Figure 26:
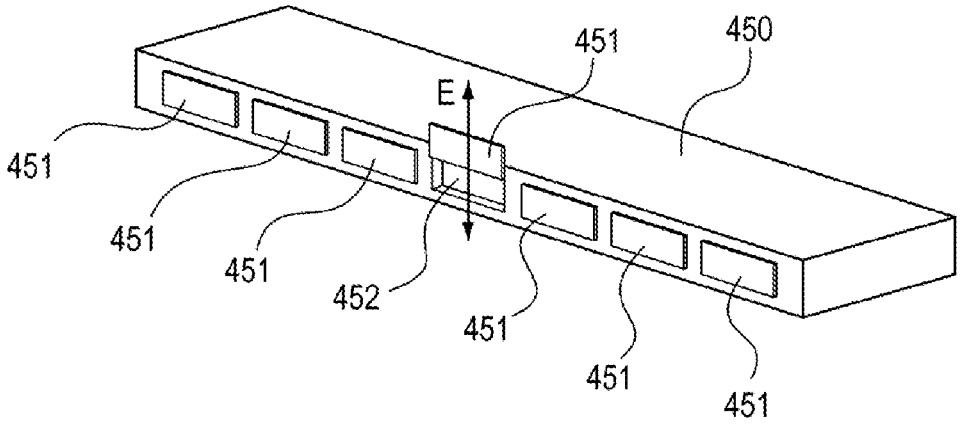
FIG. 26 is a perspective view illustrating the moistening device in Embodiment 4.

Next, the sheet moistening device 450 will be described in detail with reference to FIGS. 25 and 26. FIG. 25 is a top plan view illustrating the sheet moistening device 450, and FIG. 26 is a perspective view illustrating the sheet moistening device. Here, as the sheet moistening device 450, a spray moistening device that sprays a liquid in a mist state is exemplarily described.

As illustrated in FIG. 26, a plurality of spray nozzles 452 for spraying a moistening liquid L in an aerosol-like manner are opened in a surface of the sheet moistening device 450 facing a sheet P. A plurality of spray nozzles 452 are arranged side by side along a sheet width direction. In response to an instruction from the controller 901C (refer to FIG. 28), the sheet moistening device 450 sprays the moistening liquid L in a fan shape and an aerosol-like manner along the arrow direction 460 in FIG. 25 to a sheet P. In FIG. 25, each fan-shaped spray width (spray area) on a surface of a sheet P is denoted by W. However, a width (size), an interval, and a spray angle of the spray nozzle 452 are set such that spray widths (spray areas) of neighboring spray nozzles 452 to a sheet are slight overlapped with each other. For this reason, the moistening liquid L is sprayed onto a surface of a sheet P without a gap in the width direction for moistening.

A shutter 451 of FIG. 26 opens or closes each spray nozzle 452 of the sheet moistening device 450. In response to an instruction from the controller 901C (refer to FIG. 28), the shutter 451 reciprocates in the arrow direction E of FIG. 26 to open or close each spray nozzle 452 and switch a spray/non-spray state of the moistening liquid L so that the moistening liquid L is sprayed onto a necessary area.

Any sheet moistening device 450 may be employed. For example, a rotor dampening system produced from Weitmann & Konrad GmbH & Co. KG (WEKO Co., Ltd.) may be suitably employed. However, the sheet moistening device 450 according to this embodiment is not limited to the aforementioned rotor dampening system. Various types of spray systems may be employed. For example, a system having a plurality of shower nozzles in a width direction and capable of spraying a liquid to a necessary portion may also be employed.

It is noted that the sheet tensioning conveyance device 101 and a drive control thereof have the same configuration as those described above in conjunction with FIGS. 13 to 17 in Embodiment 2. For this reason, like reference numerals denote like elements as in FIGS. 13 to 17, and a description thereof will not be repeated in detail here.

With reference to FIG. 8, a description will be made for a shape characteristic of a curl or an edge corrugation generated in a sheet P and a measurement method. A sheet P passing through only the nip portion N of the fixing device 100 or a sheet P passing through the nip portion N of the fixing device 100, and then continuously through the sheet tensioning conveyance device 101 is loaded on a measurement table 650 as illustrated in FIG. 8. Here, "L edge [mm]" denotes an edge length of a sheet P in a sheet feeding direction, and "L center [mm]" denotes a center length.

A wave shape Pwave generated in the upper or lower side of the sheet P of FIG. 8, that is, the edge of the width direction perpendicular to the sheet feeding direction will be referred to as an edge corrugation. As an evaluation target, the largest one X max of gaps from the measurement table 650 is set as a corrugation amount.

FIGS. 18A and 18B illustrate a result of the experiment for checking effects of the tensioning device 101 performed by the inventors according to Embodiment 4. FIG. 18A describes the edge length L edge [mm], the center length L center [mm], and the maximum corrugation amount X max [mm] of a sheet P immediately after the sheet P passes through the fixing device at a conveyance speed of 300 mm/s. FIG. 18C describes the edge length L edge [mm], the center length L center [mm], and the maximum corrugation amount X max [mm] of a sheet P immediately after the sheet P passes through the fixing device, a moisture adding device of this embodiment, and the tensioning device according to this embodiment at a conveyance speed of 300 mm/s.

As illustrated in FIG. 18A, an elongation amount of the center length L center immediately after a sheet P passes through the fixing device is 0 mm, and an elongation amount of the edge length L edge is 0.6 mm, so that the edge length is longer than the center length by 0.6 mm. This is because, in the case of the fixing device having a wide nip, an ironing effect is provided to a sheet by setting a conveyance speed of the sheet edge side of the width direction to be higher than that of the sheet widthwise center portion in the nip portion in order to prevent a sheet folding while a sheet passes through the nip as described above. In this case, the sheet edge elongates relative to the vicinity of the center after the sheet is discharged from the nip portion.

If a sheet passes through the sheet corrugation correcting device 900 according to this embodiment at a speed of 300 mm/s after it passes through the fixing device at a speed of 300 mm/s as illustrated in FIG. 18C, an elongation amount of the center length L center measured by placing the sheet P for one day after it passes through the tensioning device is 0.6 mm. In comparison, the elongation amount of the edge length L edge is 0.6 mm, and a difference between the edge length and the center length is 0 mm. That is, since a sheet P is moistened by the sheet moistening device 450, and the center portion of the sheet P is pulled by the sheet tensioning conveyance device 101, an elongation amounts becomes approximately equal between the edge portion and the center accordingly. As a result, since the sheet length is equalized between the center and the edge portion, the maximum corrugation amount is 1.0 mm in FIG. 18C while the maximum corrugation amount is 3.3 mm in FIG. 18A. That is, the corrugation is reduced to approximately ⅓. In this embodiment, the moisture amount applied to a sheet for exerting the aforementioned effect is set to 8% or higher in any type of sheet.

As described above, by applying moisture to a sheet at a predetermined moisture amount or higher and pulling the sheet center portion while the sheet passes through the sheet tensioning conveyance device, it is possible to reduce a sheet length difference between the edge portion and the center and correct a corrugation.

It is noted that, although the elastic rubbers 105*b* and 107*b* of the first and second lower rollers 105 and 107, respectively, have a straight shape having a width of 100 mm (length L in FIG. 13) in this embodiment, the elastic rubber may have a tapered shape or a crown shape such as a parabolic shape. That is, at least a part of the outer diameters of the elastic rubbers 105*b* and 107*b* of the first and second lower rollers 105 and 107, respectively, may change in a rotational axis direction, and the center portion of the rotational axis direction may be larger than the edge portion of the rotational axis direction.

In FIG. 24, the conveyance path from a pair of discharge rollers 540 of the printer 500 to a pair of entrance rollers 901 of the sheet corrugation correcting device 900 has a height T1 with respect to an apparatus grounding plane Z. Similarly, a discharge port from a pair of discharge rollers 910 of the sheet corrugation correcting device 900 has a height T2.

Figure 29:
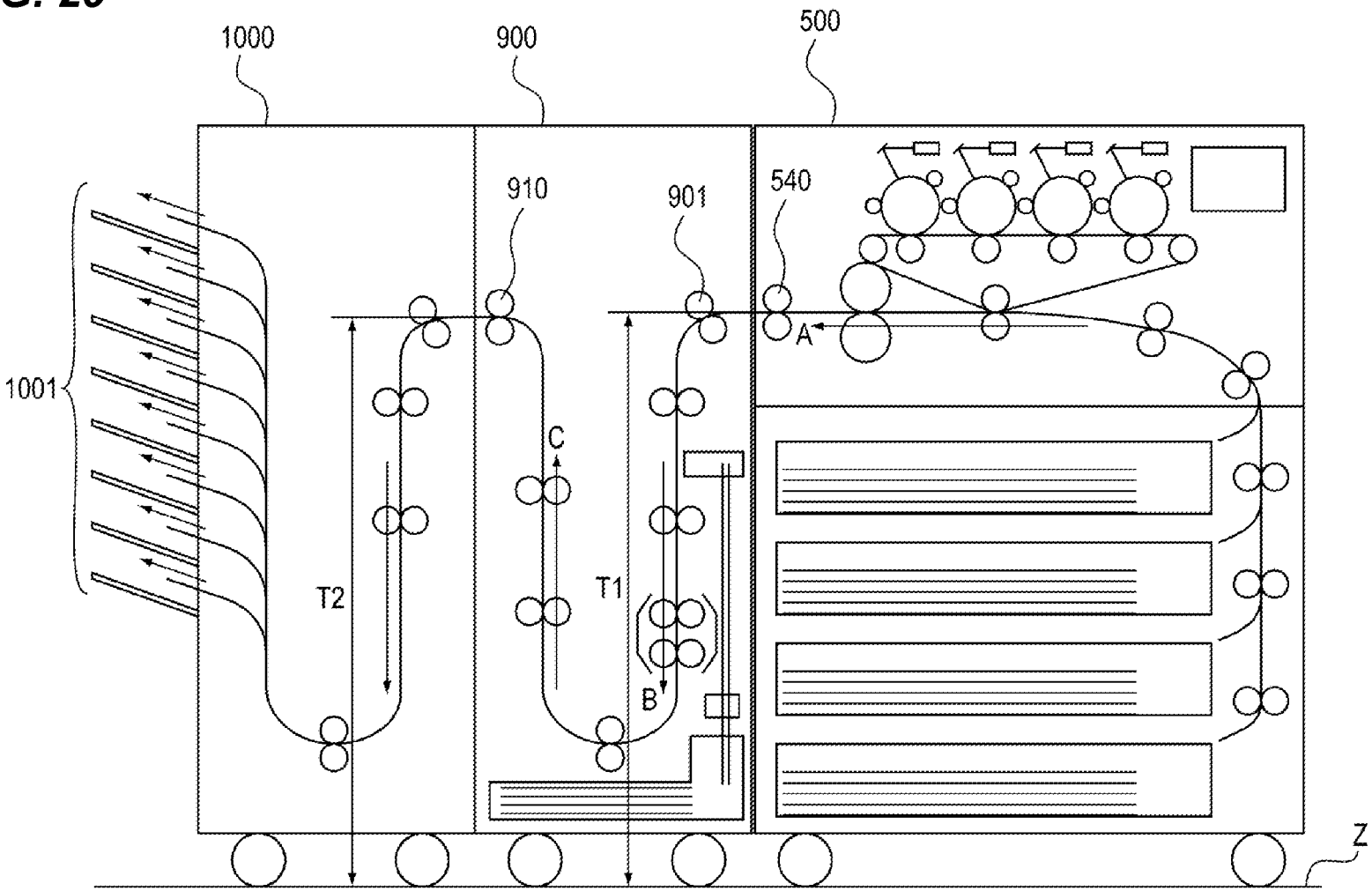
FIG. 29 is a cross-sectional view illustrating the electrophotographic printer in Embodiment 4.

FIG. 29 illustrates an example in which a sorter device 1000 capable of sorting sheets into a plurality of sort trays 1001 is connected to the downstream side of the sheet corrugation correcting device 900. Here, as described above, if the height T1 of the conveyance path from the pair of discharge rollers 540 of the printer 500 to the pair of entrance rollers 901 of the sheet corrugation correcting device 900 with respect to the apparatus grounding plane Z is set to be equal to the height T2 from the pair of discharge rollers 910 of the sheet corrugation correcting device 900 to the discharge port, versatility may be provided in a connection/access capability of each device. That is, the sorter device 1000 may be directly connected without disposing the sheet corrugation correcting device 900 in the downstream side of the color electrophotographic printer 500. As a result, it is possible to obtain functionality as the entire system including the color electrophotographic printer 500 or the sheet corrugation correcting device 900.

As illustrated in FIGS. 24 and 29, the conveyance path of a sheet P has an approximately vertically downward path (arrow direction B). In the approximately vertically downward path, the sheet moistening device 450 serving as a moistening portion for changing a moisture amount of the sheet P and the sheet tensioning conveyance device 101 serving as a tensile strength application portion to a sheet P in the downstream side (lower side) therefrom are arranged. Therefore, it is possible to efficiently arrange each device within a range of the height T1 with respect to the apparatus grounding plane Z in the conveyance path from the pair of discharge rollers 540 of the printer 500 to the pair of entrance rollers 901 of the sheet corrugation correcting device 900 in order to obtain functionality of the entire system.

Embodiment 5

A sheet moistening device 400 of a sheet corrugation correcting device 900 according to Embodiment 5 will be described with reference to FIGS. 30 to 34.

The configuration and the operation of the sheet corrugation correcting device 900 of Embodiment 5 are similar to those of Embodiment 4 except for the sheet moistening device 400. Therefore, a description thereof will not be repeated. In addition, in the configuration of the sheet moistening device 400 according to Embodiment 5, like reference numerals denote like elements as in the sheet moistening device 400 of Embodiment 1 described above.

In the sheet corrugation correcting device 900 according to Embodiment 5, the sheet moistening device 450 of Embodiment 4 is substituted with a sheet moistening device 400. However, they have the same object from the viewpoint of moistening of a sheet P. In Embodiment 4, as a moisture adding unit, the moisture is added to a sheet by spraying a moistening liquid. However, in Embodiment 5, a sheet is moistened using a roller rotated while a moistening liquid is retained in a surface layer.

Figure 31:
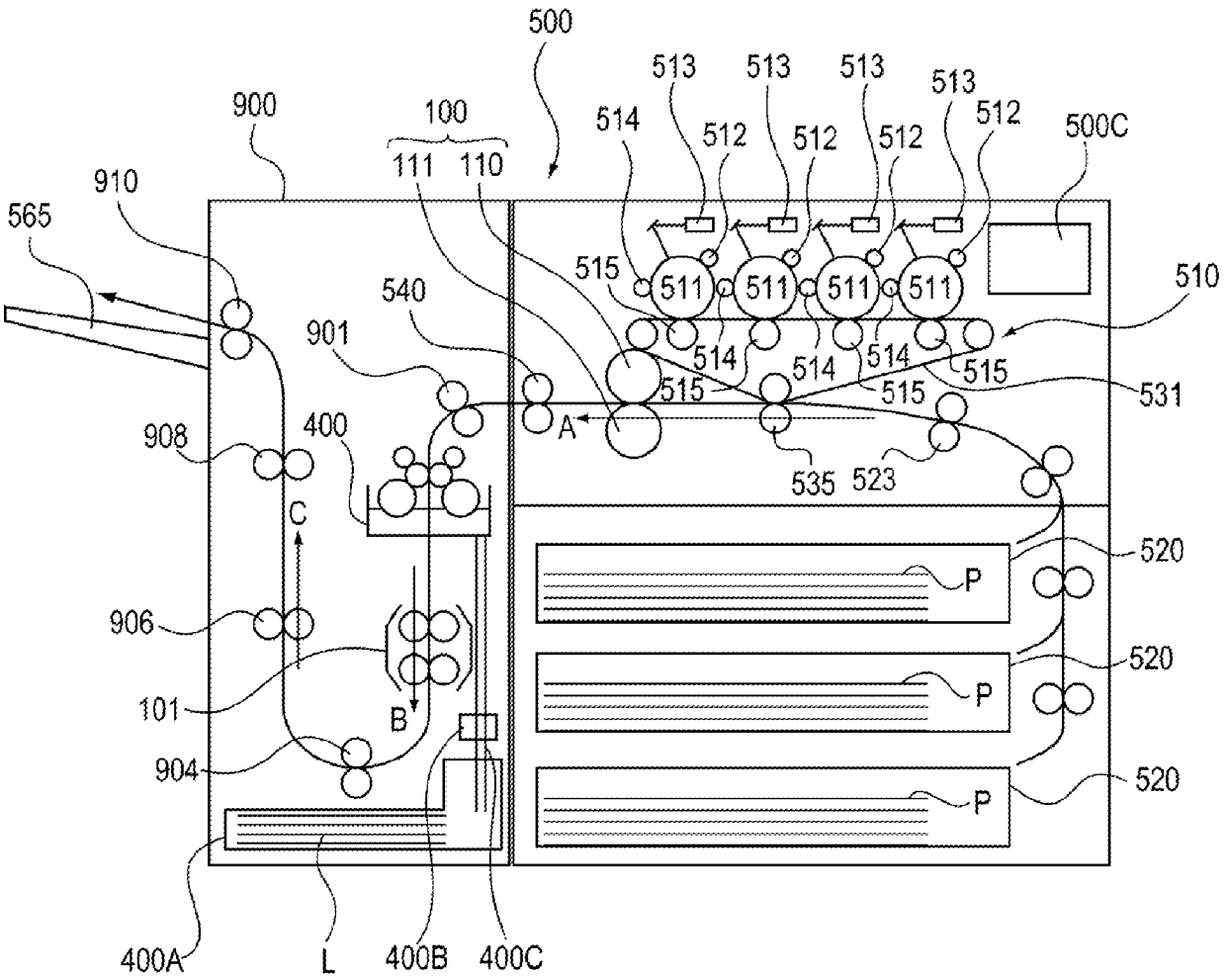
FIG. 31 is a cross-sectional view illustrating the sheet corrugation correcting device in Embodiment 5.
Figure 32:
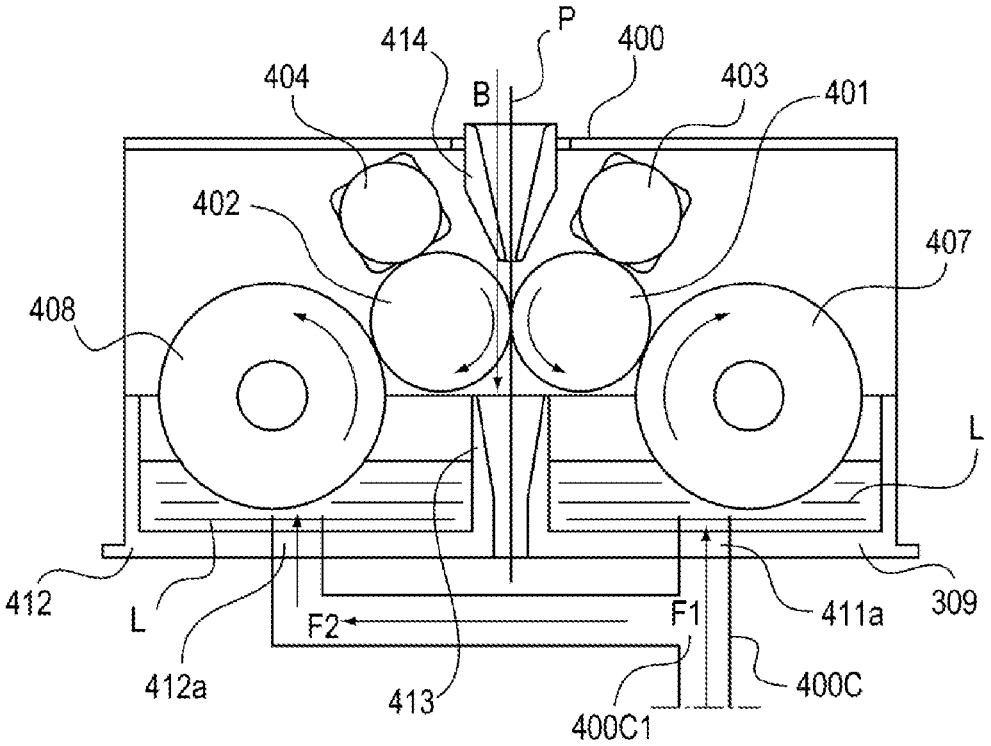
FIG. 32 is a cross-sectional view illustrating a moistening device in Embodiment 5.

As indicated by the arrow direction B of FIG. 24, a sheet P fed in the arrow direction B of FIG. 31 is guided to an entrance guide 414 of FIG. 32 and is fed to a nip portion of the pair of moistening rollers 401 and 402. Then, a sheet P is moistened by transferring the moistening liquid L onto a surface.

The pair of moistening rollers 401 and 402 is an elastic roller obtained by forming a solid rubber layer made of nitrile butadiene rubber (NBR), silicon, or the like as a main component on a surface of a core made of a metal rigid body such as stainless steel.

The liquid supply rollers 407 and 408 serve as a liquid supply member for sequentially supplying the moistening liquid L. The liquid supply rollers 407 and 408 are elastic rollers having a solid rubber layer made of a material, such as NBR, having a hydrophilic surface capable of holding a moistening liquid L on a core surface made of a metal rigid body such as stainless steel. The solid rubber layer may be made of metal or resin subjected to hydrophilic treatment.

Figure 34:
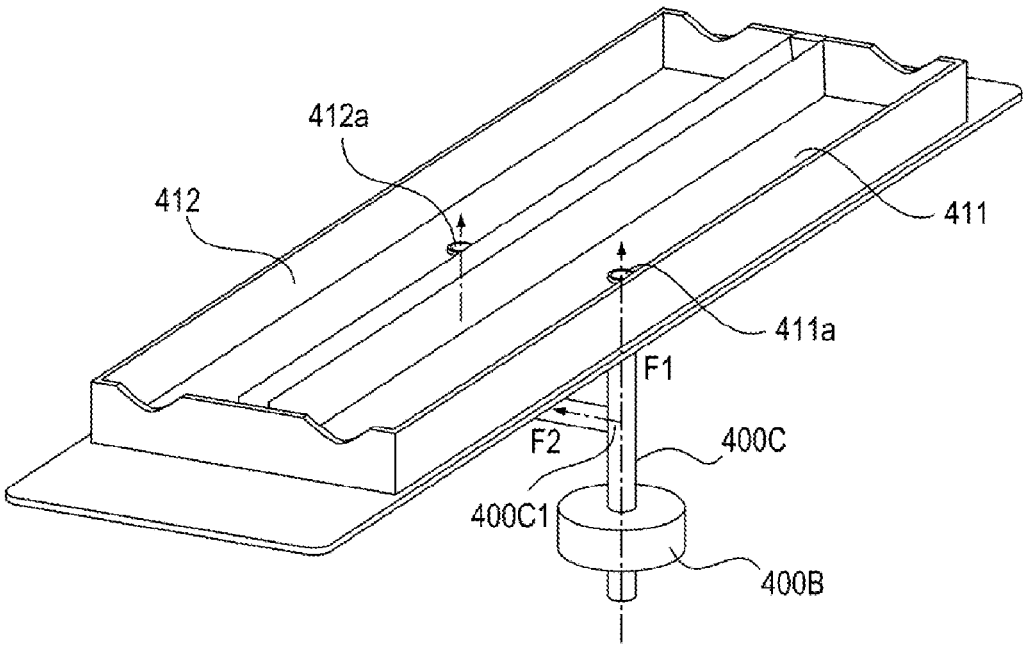
FIG. 34 is a perspective view illustrating surroundings of a reservoir of the moistening device in Embodiment 5.

A reservoir 400A of FIG. 31 is connected to liquid supply baths 411 and 412 provided in the sheet moistening device 400 via an intermediate pump 400B as illustrated in FIG. 34.

The moistening liquid L stored in the liquid supply pipe 400C is occasionally branched and supplied in the arrow directions F1 and F2 of FIGS. 32 and 34 to the liquid supply baths 411 and 412 via a branching portion 400C1 provided in the liquid supply pipe 400C using a pump 400B. The moistening liquid L contains water as a main component. Pipes branching from the liquid supply pipe 400C are connected to liquid supply ports 411*a* and 412*a* directly underlying the liquid supply rollers 407 and 408 provided in the bottoms of the liquid supply baths 411 and 412, respectively.

The moistening liquid L supplied by the pump 400B and stored in the bottom of the liquid supply baths 411 and 412 via the liquid supply ports 411*a* and 412*a* is pumped up by virtue of viscosity of the moistening liquid L itself, a surface tension, wettability of a rubber surface layer of the liquid supply rollers 407 and 408 as the liquid supply rollers 407 and 408 whose lower part is immersed are rotated as illustrated in FIG. 32.

The moistening liquid L held in the surface layers of the liquid supply rollers 407 and 408 is further transferred onto the surface layer of each of the moistening rollers 401 and 402 and is squeezed from each controlling roller 403 and 404. Therefore, the moistening liquid L is transferred onto each of the moistening rollers 401 and 402 while uniformity is maintained. The controlling rollers 403 and 404 abut on the moistening rollers 401 and 402, respectively, to appropriately suppress the amount of the moistening liquid held in the surface layer of the moistening roller to control the amount of the moisture supplied to a sheet. The controlling rollers 403 and 404 are made of a material obtained by applying hard chrome plating on a surface of, for example, stainless steel or iron steel.

As illustrated in FIG. 33, a drive input gear G1 for inputting a driving force is fixed to one end of the moistening roller 402 as illustrated in FIG. 33. The drive motor M52 serves as a drive source for driving the drive input gear G1 and is fixed to the same shaft as that of the drive gear G2. As the drive input gear G1 and the drive gear G2 mesh with each other, a driving force of the drive motor M52 is transmitted to the drive input gear G1.

The liquid supply roller 408 and the controlling roller 404 are pressed to the moistening roller 402, and the liquid supply roller 407 and the controlling roller 403 are pressed to the moistening roller 401 using a compression spring 420 obtained by bending a tension spring of FIG. 33 in a U-shape.

As a driving force of the drive motor M52 is transmitted to the drive input gear G1 as described above, the moistening roller 402 is rotationally driven. Then, except for the moistening roller 402, all of the moistening roller 401, the liquid supply roller 407 and 408, and the controlling rollers 403 and 404 are drivenly rotated.

Figure 30:
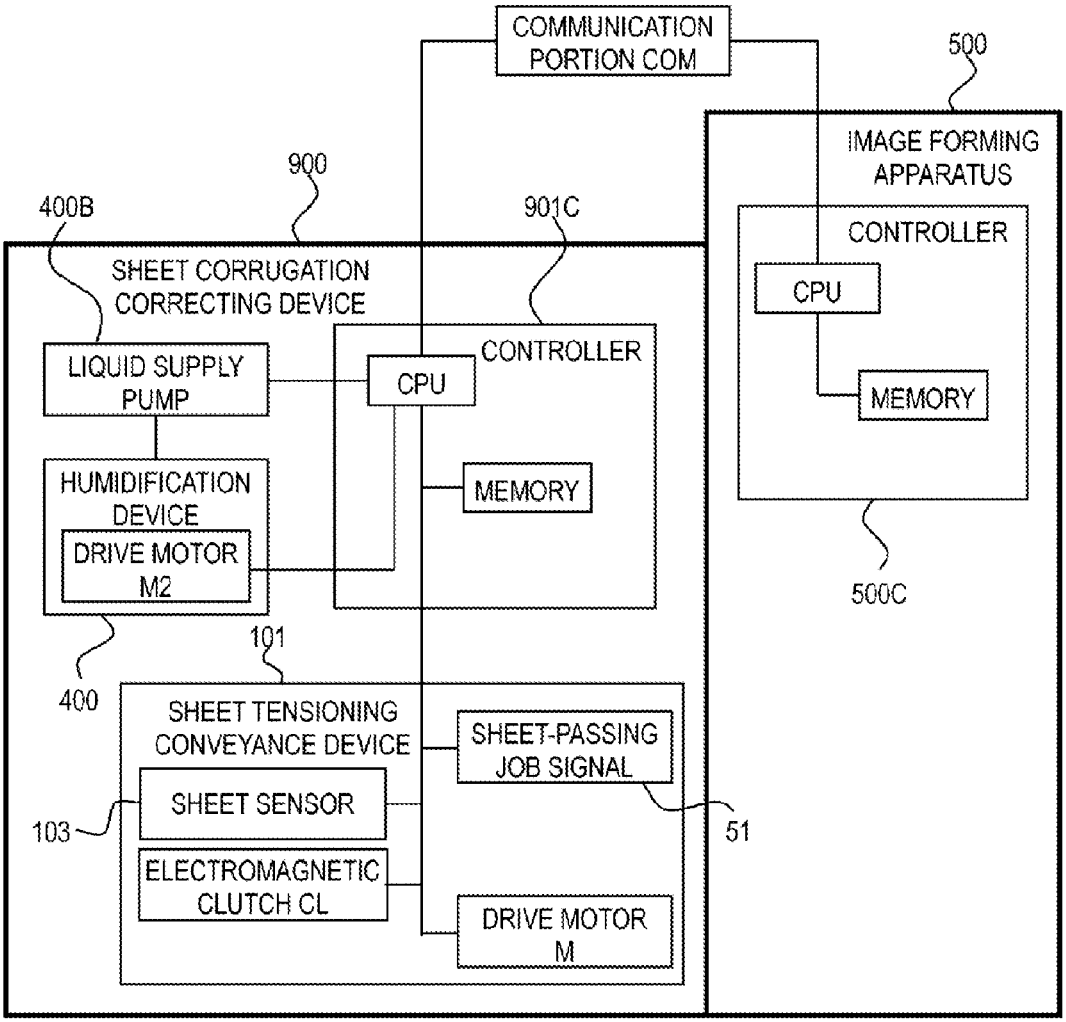
FIG. 30 is a block diagram illustrating control of a sheet corrugation correcting device in Embodiment 5.

It is noted that, as illustrated in FIG. 30, a drive operation of the drive motor M52 is controlled by the controller 901C. Other components are similar to those of Embodiment 4 illustrated in FIG. 28. Therefore, like reference numerals denote like elements, and descriptions thereof will not be repeated.

A sheet P that enters a nip portion of a pair of moistening rollers 401 and 402 and is moistened by transferring the moistening liquid L onto the surface thereof is guided to the discharge guide 413. Then, the sheet P is discharged from the sheet moistening device 400 and is conveyed to the sheet tensioning conveyance device 101 as in Embodiment 4.

In this embodiment, if the moistening amount applied to a sheet P by the sheet moistening device 400 is set to approximately 7% as in Embodiment 4, a sheet corrugation correction effect is also similar to that of Embodiment 4.

In this manner, without limiting to a configuration in which a sheet is moistened by spraying a moistening liquid as described above in Embodiment 4, it is possible to obtain the aforementioned effects similar to those Embodiment 4 by moistening a sheet using a pair of moistening rollers rotated while the moistening liquid is held in the surface layer.

Embodiment 6

Figure 35:
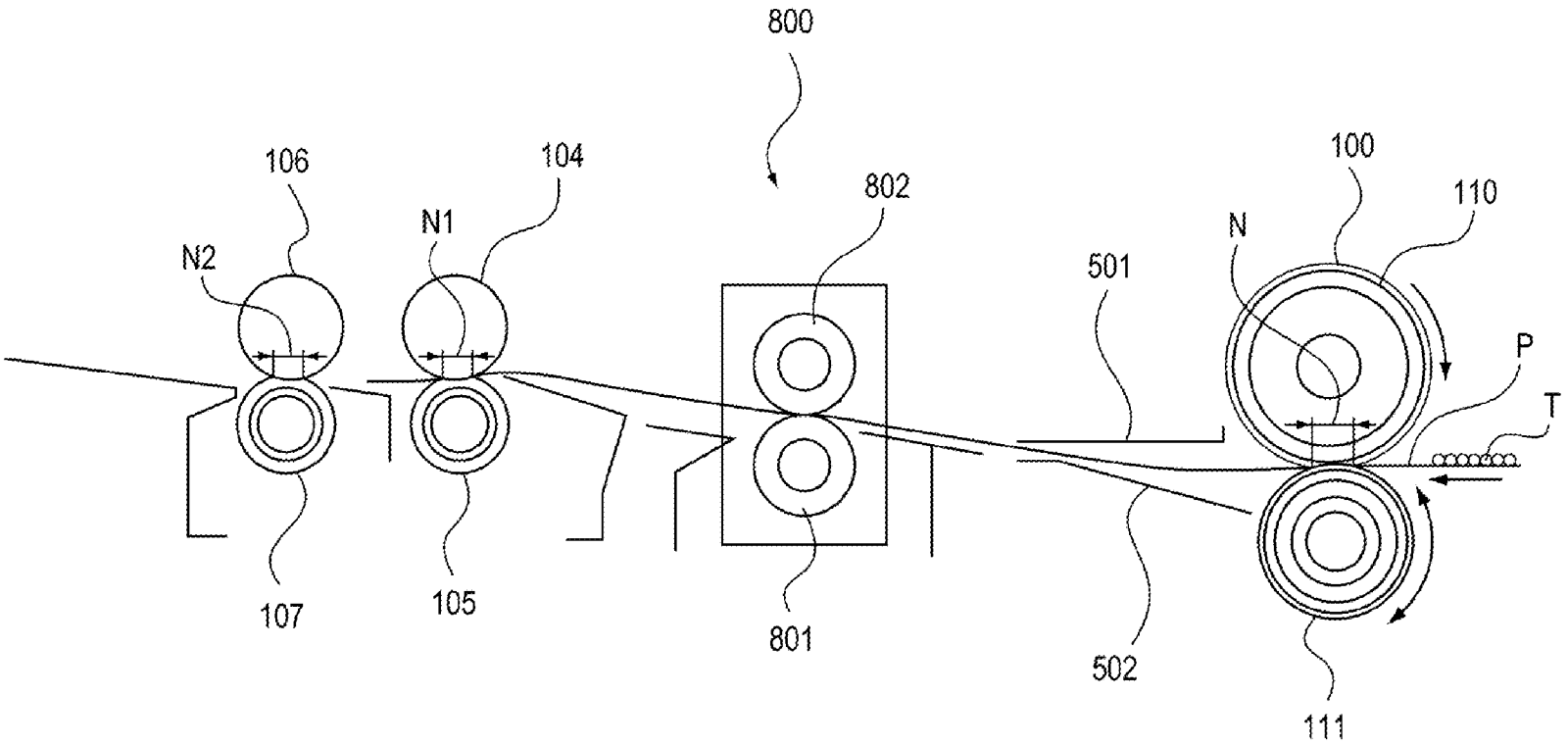
FIG. 35 is a cross-sectional view illustrating moisture application and a tensioning conveyance device in Embodiment 6.
Figure 36:
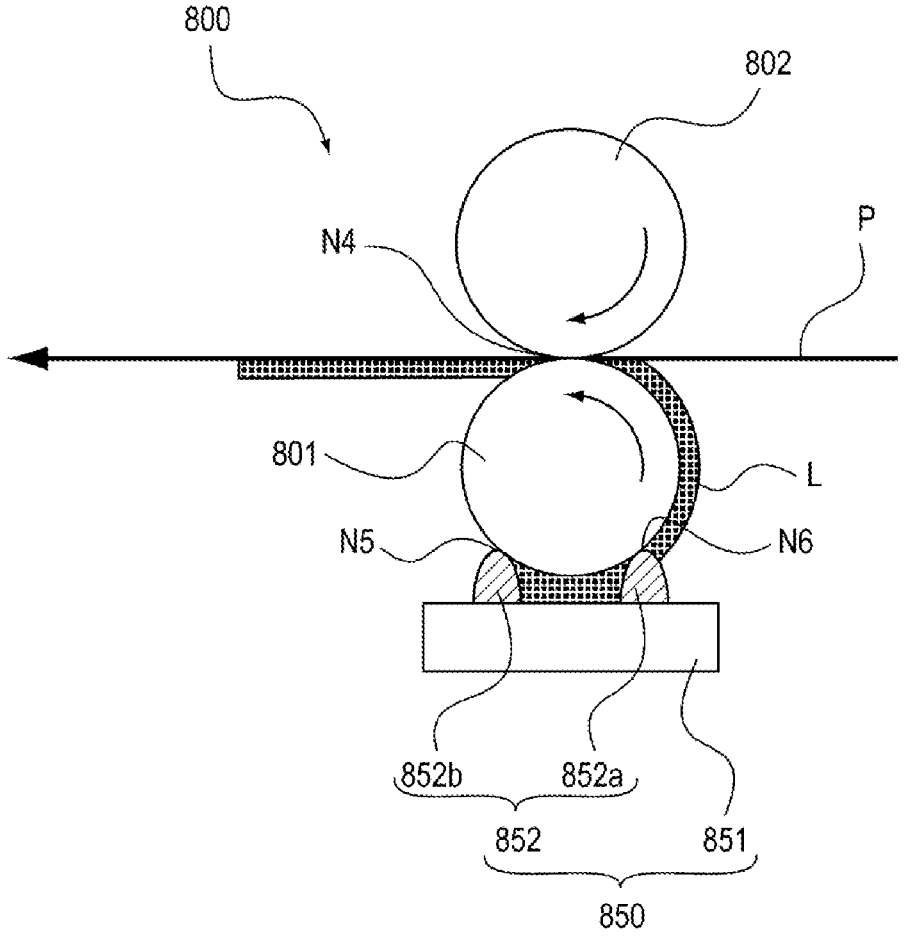
FIG. 36 is a cross-sectional view illustrating a moisture applying device in Embodiment 6.
Figure 37A:
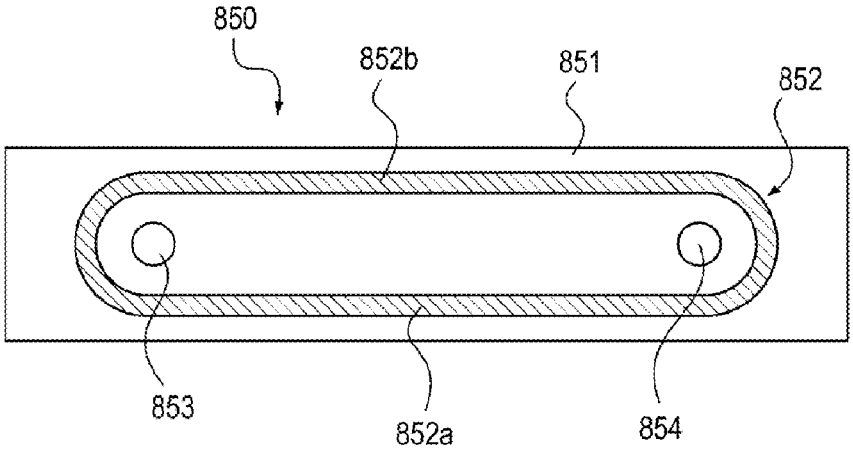
FIG. 37A is a top plan view illustrating the moisture applying device in Embodiment 6.
Figure 37B:
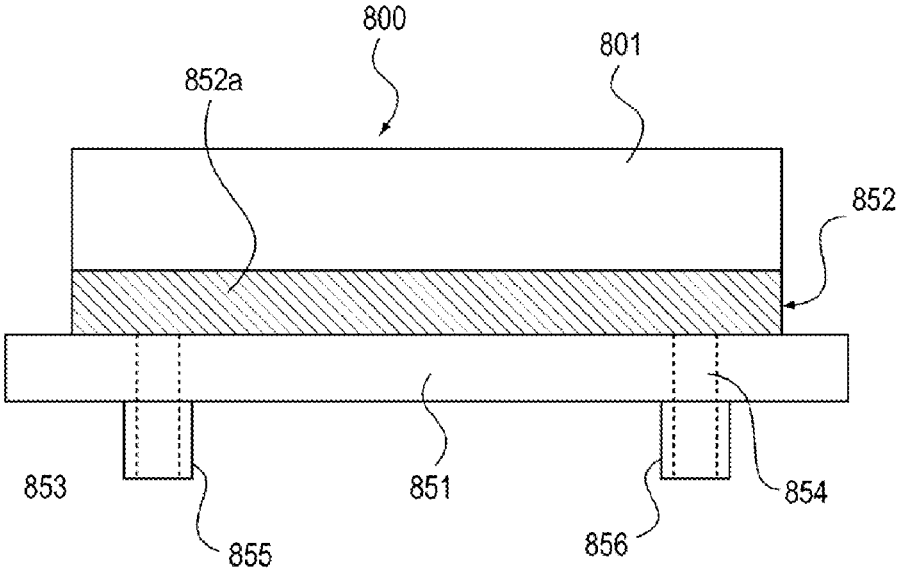
FIG. 37B is a front view illustrating the moisture applying device in Embodiment 6.
Figure 38A:
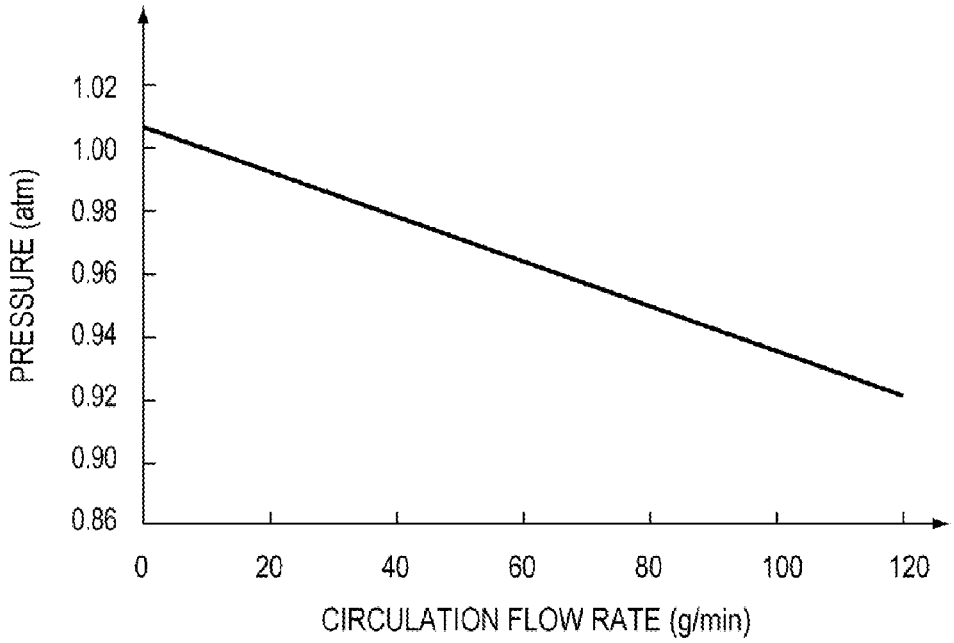
FIG. 38A is a graph illustrating a relationship between a circulation flow rate and a pressure of the moisture applying device in Embodiment 6.
Figure 38B:
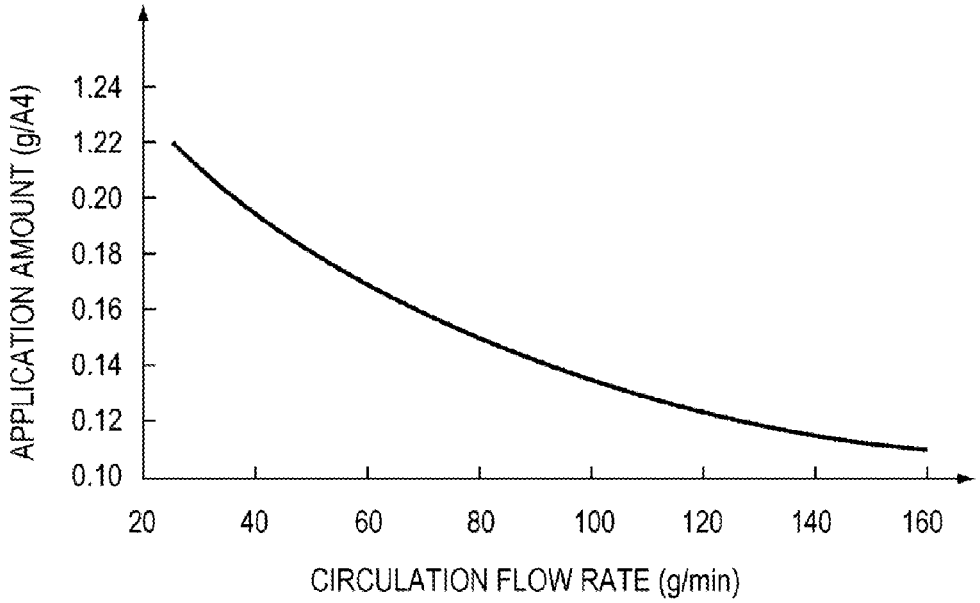
FIG. 38B is a graph illustrating a relationship between an application amount and a circulation flow rate of the moisture applying device in Embodiment 6.
Figure 39:
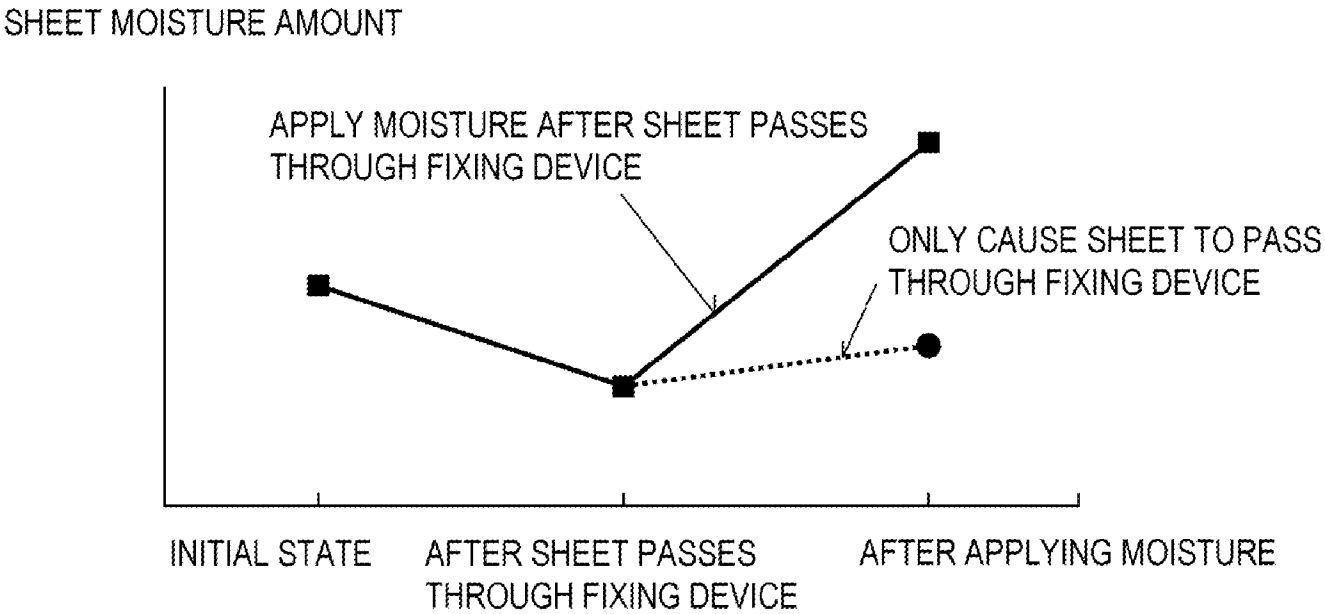
FIG. 39 is a graph illustrating a change of a moisture amount on a sheet in an experiment.

Embodiment 6 will be described with reference to FIGS. 35 to 39. FIG. 35 is a cross-sectional view illustrating a moisture applying device and a tensioning device. FIG. 36 is a cross-sectional view illustrating a moisture applying device according to Embodiment 6. FIG. 37A is a top plan view illustrating the moisture applying device according to Embodiment 6. FIG. 37B is a front view illustrating the moisture applying device according to Embodiment 6. FIG. 38A is a graph illustrating a relationship between a pressure and a circulation flow rate in the moisture applying device according to Embodiment 6. FIG. 38B is a graph illustrating a relationship between a circulation flow rate and an application amount in the moisture applying device according to Embodiment 6. FIG. 39 is a graph illustrating a change of the moisture amount in a sheet through an experiment.

In this embodiment, a configuration similar to that of Embodiment 2 described above is employed except that a moisture applying device (moisture adding device) 800 having a moisture adding unit for moistening a sheet having a curl or a corrugation is additionally provided. Therefore, a description will not be repeated except for the moisture applying device. Moisture is added to fibers by moistening a sheet to separate the hydrogen bonding between fibers and facilitate equalization of a sheet length In this embodiment, the moisture applying device 800 is arranged in a downstream side from the fixing device 100 in a sheet feeding direction and in a upstream side from the tensioning device 101. Here, it may be conceived that the moisture applying device 800 is arranged between a first pair of rollers and a second pair of rollers of the tensioning device 101. However, it is effective to arrange the moisture applying device 800 before the tensioning device 101 to moisten the entire sheet in consideration of a change of the sheet length using the tensioning device 101.

As an application method, for example, a liquid may be supplied to a sheet while a chamber retaining a liquid abuts on an applying roller (chamber type).

Next, the moisture applying device according to Embodiment 6 will be described with reference to FIGS. 36 to 37.

In the moisture applying device according to Embodiment 6, a liquid is supplied while a liquid retaining member (chamber) that retains a liquid abuts on an applying roller. In this configuration, it is advantageously prevent a liquid from being dried or leaking. In particular, in the image forming apparatus, it is possible to prevent a leakage of the application liquid that may be generated by a posture change when the image forming apparatus is carried.

As illustrated in FIGS. 36 and 37, the moisture applying device 800 includes an applying roller 801 as a moisture adding unit that applies a liquid (moisture) to a sheet and a liquid retaining member 850 that retains a liquid in a liquid retaining space abutting on the applying roller 801. The moisture applying device 800 applies, to a sheet, the liquid supplied from the liquid retaining member 850 to a surface of the applying roller 801 by rotating the applying roller 801.

The applying roller 801 is rotationally driven by a drive unit (not illustrated). The applying roller 801 is formed, for example, by coating a silicon rubber having a thickness of 3 mm (JIS-A hardness of 25° and surface roughness Ra of 1.5 μm) on an aluminum core bar having an outer diameter of 17 mm and a length of 340 mm. Therefore, here, the applying roller 801 has an outer diameter of 23 mm.

A backup roller 802 is arranged in a position facing the applying roller 801. The backup roller 802 is formed by coating ceramic particles with a thickness of 1 mm on an iron core bar having an outer diameter of 14 mm. The backup roller 802 is pressed to the applying roller 801 by a pressing portion (not illustrated) and is drivenly rotated by rotation of the applying roller 801 to convey a sheet by nipping it.

If the backup roller 802 has a simple cylindrical shaft, the application liquid stays and gathers in a nip portion N4 between the applying roller 801 and the backup roller 802. In this regard, the backup roller 802 is a special roller having minute unevenness on a surface in order to allow a liquid film (an application liquid or a liquid) to pass through the nip portion N4. For example, the backup roller 802 is a ceramic coat roller having unevenness formed by coating ceramic particles on a core bar. The size of the unevenness is controlled by a size of the ceramic particle. For example, when a ceramic particle having an average diameter of 20 μm is coated, the surface roughness (size of unevenness) Ra is approximately 15 μm.

The liquid retaining member 850 is pressed to the applying roller 801 by a pressing portion (not illustrated) so that the abutment member 852 abuts on the applying roller 801. In addition, together with a space forming member 851, the liquid retaining member 850 forms a liquid retaining space S extending in a sheet width direction across the entire liquid application area of the applying roller 801. In this liquid retaining space S, the application liquid is supplied from a liquid path via the liquid retaining member 850. The liquid retaining member 850 includes a space forming member 851 and an annular abutment member 852 protruding on one surface of the space forming member 851.

The abutment member 852 has a horizontally symmetrical shape formed by integrating a lower stream-side abutment portion 852*a* and an upstream-side abutment portion 852*b* in a roller rotation direction as illustrated in FIG. 37A when the applying roller 801 is rotated in the arrow direction as illustrated in FIG. 36. This annular abutment member 852 is fixed to the space forming member 851. Both edges of the abutment member 852 in the sheet width direction are formed in an arc shape in order to prevent a deviation on an abutment surface between the applying roller 801 and the abutment member 852. Therefore, in the liquid retaining member 850, the seamless annular abutment member 852 abuts on the outer circumferential surface of the applying roller 801 without a gap in a continuous state. As a result, the liquid retaining space S becomes a substantially occluded space blocked by the abutment member 852, one surface of the space forming member 851, and the outer circumferential surface of the applying roller 801 so that a liquid is stored in this space. In addition, while rotation of the applying roller 801 stops, the outer circumferential surface of the applying roller 801 and the abutment member 852 maintain a liquid-tight state. Therefore, it is possible to reliably prevent a liquid from leaking externally.

Meanwhile, as the applying roller 801 rotates, the liquid (application liquid) stored in the liquid retaining space S slidingly passes through a gap between the outer circumferential surface of the applying roller 801 and the downstream-side abutment portion 852*a* and adheres to the outer circumferential surface of the applying roller 801 in a layer shape.

Here, a fact that the abutment member 852 and surrounding surfaces have a liquid-tight state while the applying roller 801 stops means that no liquid flows between the inside and the outside of the liquid retaining space. In this case, the abutment state of the abutment member 852 also includes a state that the abutment member 852 abuts on the outer circumferential surface of the applying roller 801 by interposing a liquid film formed by a surface tension as well as a state that the abutment member 852 directly abuts on the outer circumferential surface of the applying roller 801.

Meanwhile, the space forming member 851 is provided with a liquid supply port 853 and a liquid recovery port 854 formed as a hole penetrating the space forming member 851 in an area enclosed by the abutment member 852 as illustrated in FIGS. 37A and 37B. The liquid supply port 853 and the liquid recovery port 854 communicate with the cylindrical connection portions 855 and 856, respectively, protruding to the rear side of the space forming member 851. In addition, the connection portions 855 and 856 are connected to a liquid path so that the liquid supply port 853 supplies the liquid (application liquid) supplied from the liquid path to the liquid retaining space S and discharges the liquid stored in the liquid retaining space S to the liquid path. Through such a liquid supply/discharge operation, the liquid (application liquid) in the liquid retaining space S flows one end portion (supply port side) to the other end portion (recovery port side) as illustrated in FIGS. 37A and 37B.

The liquid path (not illustrated) includes a buffer reservoir that stores the application liquid, an exchangeable reservoir that supplies the application liquid to the buffer reservoir, a pump (liquid flowing portion) that forcedly flows the application liquid, and a controller that controls an operation of the pump. By operating this pump, the application liquid is charged, supplied, and recovered. In addition, this controller performs control for a circulation rate and an application rate of the application liquid. That is, through circulation including supply and recovery of the application liquid to the liquid retaining member 850, a flow rate of the liquid generated in the liquid retaining member 850 and a rotation speed of the applying roller 801 are controlled.

Here, the application liquid (moisture) used in this embodiment is a liquid for preventing a sheet corrugation.

When water is used as the application liquid, in the chamber type moisture applying device of this embodiment, slidability in an abutment portion between the applying roller and the liquid retaining member is improved by adding a component capable of lowering a surface tension to the liquid. As an example of a composition of the application liquid described above, glycerin or a surfactant may be used to lower the surface tension of water.

The application liquid (liquid) as moisture added to a sheet is not limited to water. For example, if an aqueous solution containing a deliquescent material capable of capturing moisture in the air is used as a spraying aqueous solution (moisture), penetrability to a sheet is further improved. If a deliquescent material is contained, an aqueous solution easily penetrates into a gap between paper fibers, and the hydrogen bonding between fibers is easily separated, so that it is possible to alleviate a curl and a corrugation of paper. Alternatively, if a surfactant containing a hydrophilic group and a hydrophobic group is included in the aqueous solution, it is possible to improve penetrability to a sheet and prevent sheets from being stuck when sheets are loaded.

FIG. 38A illustrates a pressure in the liquid retaining space S against a circulation flow rate. Here, since a cross-sectional area of the inside of the liquid retaining space S is constant, the circulation flow rate is proportional to a flow velocity. It is noted that FIG. 38A illustrates an average pressure in a flow direction of the liquid retaining space S when a water head difference between the buffer reservoir (not illustrated) and the liquid retaining member 850 is zero. Although a pressure distribution depends on a flow velocity distribution of the flow direction in the liquid retaining space S, the pressure distribution illustrated in FIG. 38A applies to anywhere.

As illustrated in FIG. 38A, as the flow velocity increases, the pressure in the liquid retaining space S decreases. For example, a circulation flow rate of 80 [g/min] and a pressure of 0.95 [atm] are used. Therefore, the liquid retaining space S has a negative pressure.

FIG. 38B illustrates the application amount of the applying roller against the circulation flow rate inside the liquid retaining space S. As the circulation flow rate increases, the pressure inside the liquid retaining space S decreases, so that the application amount decreases. Therefore, as illustrated in FIG. 38B, as the circulation flow rate increases (flow velocity increases), the application amount decreases. That is, as the pressure inside the liquid retaining space S decreases, the abutment pressure of the abutment member 852 to the applying roller 801 increases. As a result, a contact area of the nip portion N5 between the downstream-side abutment portion 852*a* and the applying roller 801 increases, and the gap of the nip portion N5 is reduced. Therefore, it is difficult to slidingly pass the liquid through the nip portion N5. For example, when the circulation flow rate is 80 [g/min], the application amount is 0.15 [g/A4]

As described above, by changing (increasing or decreasing) the circulation flow rate (flow velocity) of the application liquid, the abutment state of the nip portion N5 between the abutment member 852 and the applying roller so that the amount of the application liquid slidingly passing through the gap of the nip portion N5 from the inside of the liquid retaining member 850, that is, the application amount changes.

As illustrated in FIG. 36, the application liquid adheres to the outer circumference of the applying roller 801 in a layer state. In addition, since the sheet P subjected to the fixing process in the fixing device 100 is introduced into the nip portion N4 between the applying roller 801 and the backup roller 802, the application liquid on the applying roller 801 is applied to a sheet P by substantially 100%.

However, in the nip portion N4, since the applying roller 801 rotates while the application liquid L in a non-sheet-passing area or between sheets (in a gap between sheets) remains in the applying roller 801, the application liquid slidingly passes through the nip portion N4 between the backup roller 802 and the applying roller 801. In addition, the application liquid slidingly passes through a gap between the applying roller 801 and the upstream-side abutment portion 852*b* resisting to a pressing force of the upstream-side abutment portion 852*b* and returns to the liquid retaining space S. Then, the returning application liquid is mixed with the application liquid charged in the liquid retaining space S. Here, since the liquid retaining space S has a negative pressure relative to the atmospheric pressure, the application liquid on the applying roller 801 returns by a single round and is recovered in the liquid retaining space S. Therefore, there is no problem if the applying roller 801 continuously rotates while no sheet exists in the nip portion N4.

In the case of a power-off or standby state, the application liquid is not dried because the liquid retaining space S is tightly sealed. Meanwhile, in some cases, the application liquid may be dried, and a material containing the application liquid may be deposited and adhered to a surface of the applying roller 801, a surface of the backup roller 802, or in the outside of the nip portions N5 and N6 of the applying roller 801 and the abutment member 852. In this case, the adhered material can be dissolved again and be removed by rotating the applying roller 801 for a moment before a liquid application operation to a sheet starts.

The applying roller according to Embodiment 6 will be described. In this embodiment, in order to more effectively reduce a corrugation on a sheet after a sheet passes through the fixing device, the application amount of the application liquid increases in a sheet center portion and decreases in both edge portions in the width direction perpendicular to the sheet feeding direction.

According to this embodiment, the sheet center portion elongates in the sheet feeding direction by applying a tension to the sheet center portion using a tensioning device 101 provided in the downstream side, so that a length of the sheet center portion of the sheet feeding direction is equalized with a length of the sheet edge portion of the sheet feeding direction. In addition, in a method of aligning the length of the sheet edge elongating using a fixing device, the hydrogen bonding between fibers is separated by applying moisture to gaps between fibers of a sheet. Therefore, it is possible to facilitate equalization of the length between the sheet center portion and the sheet edge portion. As a result, it is possible to correct an edge corrugation of a sheet.

FIG. 39 illustrates a result of the change of the moisture amount applied to a sheet in an experiment performed by the inventors according to Embodiment 6.

FIG. 39 shows a temporal change of the moisture amount in a sheet A passing through the fixing device (300 mm/s) and a sheet B passing through the fixing device (300 mm/s) and then the moisture applying device 800. In FIG. 39, the dotted line indicates the moisture amount change of the sheet A, and the solid line indicates the moisture amount change of the sheet B.

Since a sheet is heated by the fixing nip portion immediately after passing through the fixing device, the moisture amount is reduced, compared to a case where the moisture amount is not applied. Then, the moisture amount of a sheet slightly increases. Meanwhile, the moisture amount of the sheet B passing through the fixing device (300 mm/s) and then the moisture applying device 800 increases by virtue of the effect of the moisture application, compared to the sheet A. Here, the moisture application amount of the moisture applying device 800 is set such that a sheet center portion can effectively elongate in the tensioning device 101 according to Embodiment 6 for a predetermined sheet.

Similar to Embodiment 2, FIGS. 18A to 18C describe the edge length L edge [mm], the center length L center [mm], and the maximum corrugation amount X max [mm] after a sheet passes through the fixing device, moisture is applied, and the sheet then passes through the tensioning device 101. Here, FIG. 18B shows a result of the sheet A when it passes through the fixing device at a speed of 300 mm/s described above, and FIG. 18C shows a result of the sheet B when it passes through the fixing device at a speed of 300 mm/s and then the moisture applying device 800 as described above.

As illustrated in FIG. 18C, if a sheet passes through the tensioning device according to this embodiment at a speed of 300 mm/s after it passes through the fixing device at a speed of 300 mm/s, an elongation amount of the center length L center measured by placing the sheet for one day after it passes through the tensioning device is 0.6 mm. In comparison, the elongation amount of the edge length L edge is 0.6 mm. Therefore, a difference between the edge length and the center length is 0 mm. That is, since moisture is applied using the moisture applying device 800, and a center portion of a sheet P is pulled by virtue of the effect of the tensioning device according to Embodiment 6, an elongation amount becomes approximately equal between the edge portion and the center accordingly. As a result, since the sheet length is equalized between the center and the edge portion, the maximum corrugation amount is 1.0 mm in FIG. 18C while the maximum corrugation amount is 3.3 mm in FIG. 18A. That is, the corrugation is reduced to approximately ⅓. In this embodiment, the moisture amount applied to a sheet for exerting the aforementioned effect is set to 8% or higher in any type of sheet.

As described above, by applying moisture to a sheet at a predetermined moisture amount or higher and pulling the sheet center portion while the sheet passes through the tensioning device, it is possible to reduce a sheet length difference between the edge portion and the center and correct a corrugation.

Figure 40:
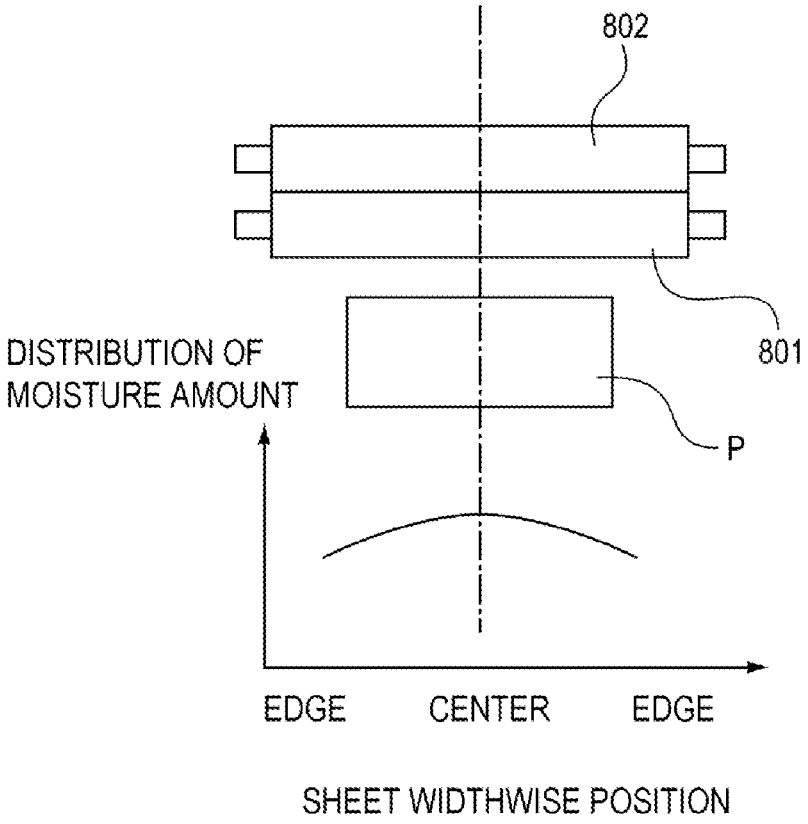
FIG. 40 is a front view illustrating the moisture applying device in Embodiment 6 and an explanatory diagram illustrating a distribution of the moisture amount.

FIG. 40 is a diagram illustrating a relationship of the moisture amount in the width direction when moisture is applied to a sheet using the moisture applying device according to this embodiment.

In order to enhance the effect described above, as illustrated in FIG. 40, the moisture amount in the sheet widthwise center potion is set to be larger than that that in both sheet widthwise edge portions. By increasing the moisture amount in the sheet center portion, the hydrogen bonding between fibers in the sheet center portion is separated in advance, so that elongation/contraction of a sheet in the sheet center portion is facilitated by applying a tension. As a result, it is possible to facilitate equalization of the length between the sheet edge portion and the sheet center portion and more effectively correct an edge corrugation.

In Embodiment 6, a description has been exemplarily made for a (chamber type) method of supplying a liquid to a sheet while the chamber that stores the liquid abuts on the applying roller as a method of applying the liquid to a sheet. However, the application method is not limited to the aforementioned one. Instead, any other methods may be employed if a sheet passing through the fixing device can be moistened at a predetermined moisture amount. For example, an applying roller method (refer to FIG. 41) disclosed in Japanese Patent Laid-Open No. 2006-154609 may be employed.

Figure 41:
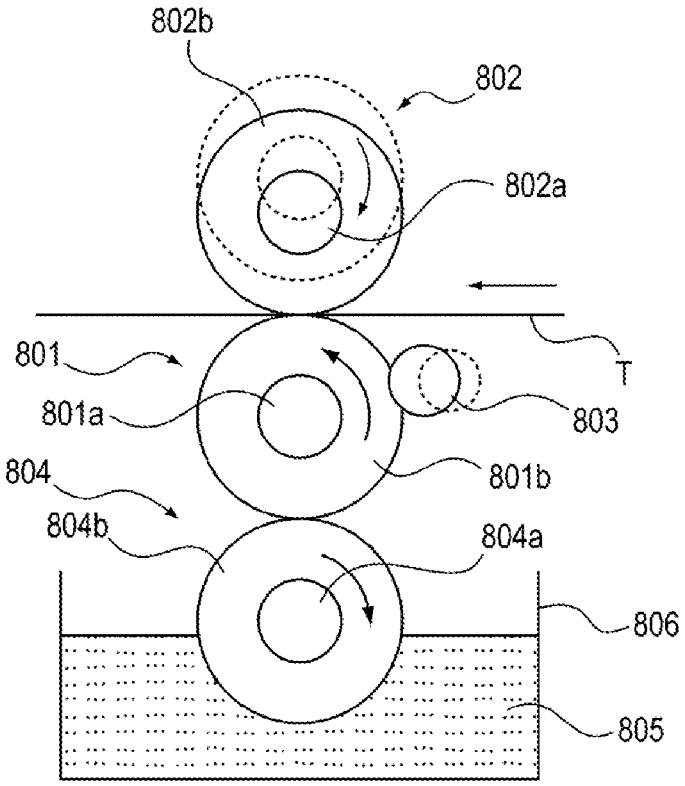
FIG. 41 is a cross-sectional view illustrating a configuration of the applying roller of the moisture applying device in Embodiment 6.

FIG. 41 is a schematic cross-sectional view illustrating the applying roller type moisture adding device.

In FIG. 41, both the applying roller 801 and the backup roller 802 include cores 801*a* and 802*a* made of a rigid body such as metal or hard resin and porous layers 801*b* and 802*b* made of a porous urethane rubber or the like formed on the cores 801*a* and 802*a*, respectively. The porous layers 801*b* and 802*b* are supplied with water from surfaces thereof and form a porous surface for moistening a sheet P by applying moisture. The liquid supply roller 804 as a liquid supply unit makes contact with the applying roller 801 and supplies water from a surface thereof. The liquid supply roller 804 includes a core 804*a* made of a rigid body such as metal or hard resin and a porous layer 804*b* made of a porous urethane rubber or the like formed on the core 804*a*.

Alternatively, the liquid supply roller 804 may be a roller or pad type having only a porous material without the core 804*a*. The liquid supply roller 804 preferably has a porous layer 804*b* as described above in order to rapidly supply a liquid to the applying roller 801 when it is activated. However, the porous layer is not indispensable. Alternatively, the roller may be made of a material having a hydrophilic surface capable of holding water on a surface without absorbing water, such as metal, hydrophilic treatment resin, or solid rubber.

A controlling member 803 serving as a controlling unit is made of a rigid body such as round bar-like metal or hard resin. The controlling member 803 makes pressed contact with the applying roller 801 to control the moisture amount supplied to a sheet P by controlling the moisture contained in a surface of the porous layer 801*b*. That is, the controlling member 803 makes pressed contact with the porous layer 801*b* of the applying roller 801 to deform the porous layer 801*b* and squeeze water contained in the porous layer 801*b*. As a result, the amount of water applied to a sheet P is controlled to suitably moisten the sheet P, so that it is possible to prevent sticking of a sheet P caused by excessive moistening. By adjusting a contact pressure of the controlling member 803 using a contact pressure adjustment portion (not illustrated), it is possible to suitably moisten a sheet.

The applying roller 801, the backup roller 802, and the liquid supply roller 804 are driven to rotate in the arrow direction by a motor (not illustrated) so that a sheet P is nipped and conveyed by the applying roller 801 and the backup roller 802. The conveyed sheet P is moistened by water bleeding from the porous layer in the nip portion between the applying roller 801 and the backup roller 802. The amount of water supplied to a sheet P is suitably controlled by squeezing water using the controlling member 803.

While the controlling member 803 makes pressed contact with the applying roller 801 to control the water supply amount, it may be drivenly rotated by the applying roller 801 or may make pressed contact with the applying roller 801 without rotation. In addition, the pressure of the pressed contact of the controlling member 803 is suitably set. Furthermore, water from the liquid supply roller 804 to the backup roller 802 may be supplied from the lower applying roller 801. Moreover, the applying roller 801 or the liquid supply roller 804 may be arranged in the upper side to supply water to the backup roller 802 in the lower side. Alternatively, water may be supplied to the rollers 801 and 802 in the upper and lower sides.

By controlling the water supply amount to the rollers 801 and 802 using the controlling member 803 in this manner, the conveyed sheet P is suitably moistened. For this reason, it is possible to effectively prevent insufficient correction of a corrugation on a sheet P caused by insufficient moistening or prevent adherence of stacked sheets P or sticking of a toner used to form an image on a sheet or a contact member caused by excessive moistening.

The backup roller 802 may move to an upper position relative to the applying roller 801 as indicated by the dotted line. That is, when an apparatus stop, the backup roller 802 may be set in a position indicated by the dotted line and be separated from the applying roller 801 in order to prevent deformation of the rollers 801 and 802. Similarly, when an apparatus stops, the controlling member 803 may move to a position indicated by the dotted line and be separated from the applying roller 201. As a result, it is possible to prevent deformation of the rollers 801 and 802.

Embodiment 7

A configuration of Embodiment 7 is similar to those of the embodiments described above except that a liquid can be selectively applied to a single side or both sides of a sheet. Therefore, similar parts will not be repeatedly described except for a characteristic configuration of Embodiment 7.

Here, as an application method, a configuration of applying mist-like moisture is exemplarily described instead of the chamber method described above. As a unit for applying moisture in a mist-like manner, an inkjet head (discharge method) may be employed as disclosed in Japanese Patent Laid-Open No. 2009-268972.

Figure 42:
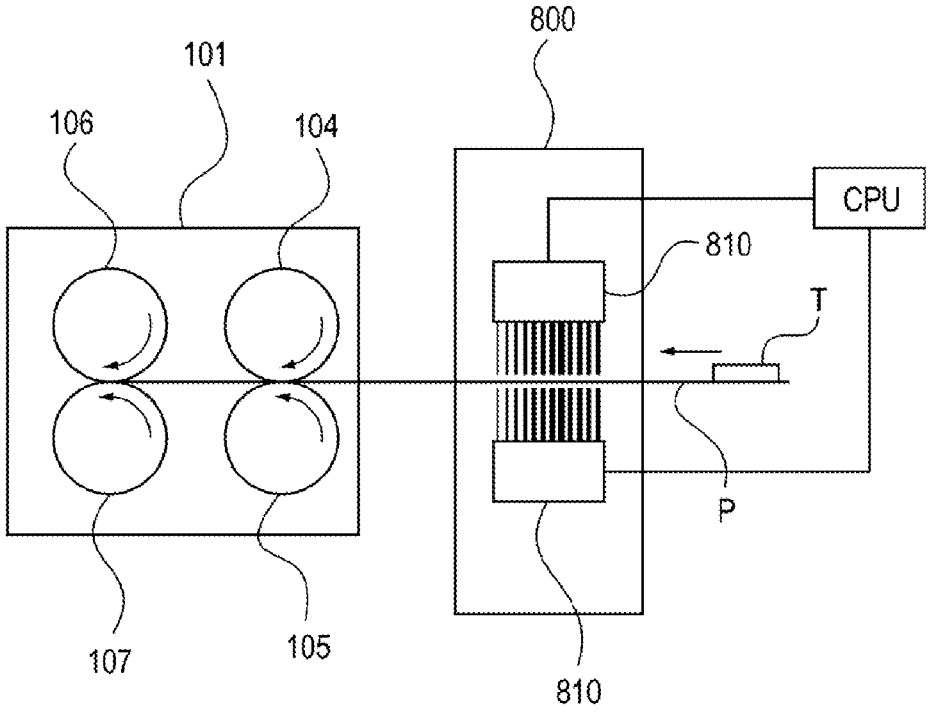
FIG. 42 is a cross-sectional view and a block diagram illustrating a moisture applying device in Embodiment 7.

FIG. 42 is a cross-sectional view illustrating a moisture applying device according to Embodiment 7.

As illustrated in FIG. 42, the moisture applying device 800 is provided in the downstream side from the fixing device in the feeding direction of a sheet P (arrow direction in FIG. 42) to moisten the sheet P passing through the fixing device. The moisture applying device 800 has a moisture adding unit for moistening a conveyed sheet P. Here, as the moisture adding unit, spray nozzles 810 and 810 that spray moisture (aqueous solution) to a sheet are employed. The spray nozzles 810 and 810 are arranged in the front side and the rear side of the sheet by interposing the sheet feeding path so that moisture (water in this embodiment) can be added to both sides or a single side of a sheet.

The moisture application amount of the spray nozzles 810 and 810 can be controlled by a CPU in the width direction perpendicular to the sheet feeding direction. Specifically, the spray amount of each spray nozzle 810 and 810 to a sheet is controlled by the CPU such that more moisture is added to the sheet widthwise center portion relative to both edge portions. As a result, the spray nozzles 810 and 810 can more accurately add the mount of water to various areas of a sheet. That is, a distribution of the moisture amount can be formed in the sheet width direction so that it is possible to enhance an effect of reducing a difference of the sheet length between the center portion and the edge portion of a sheet using the tensioning device 101. As a result, it is possible to correct a corrugation in the sheet edge portion caused by a difference of the length between the sheet center portion and the sheet edge portion.

It is noted that, according to this embodiment, only one of two spray nozzles may be used as necessary. The one spray nozzle may add more water to the center area selected on a front or rear side of a sheet relative to the edge area.

Figure 43:
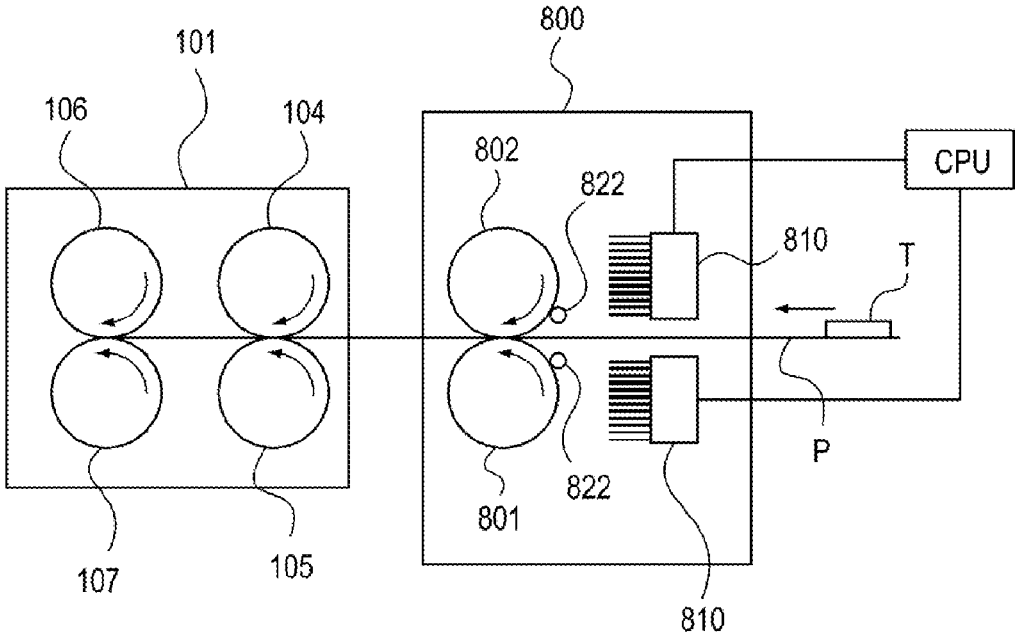
FIG. 43 is a cross-sectional view and a block diagram illustrating the moisture applying device in Embodiment 7.

Although a description has been exemplarily made for a configuration in which moisture is directly added from the spray nozzle to a sheet, the invention is not limited thereto. As illustrated in FIG. 43, moisture may be indirectly added from the spray nozzle. FIG. 43 is a cross-sectional view illustrating a moisture applying device according to Embodiment 7.

As illustrated in FIG. 43, the moisture applying device 800 includes water jet nozzles 810 and 810, as a moisture adding unit, having a plurality of discharge ports that discharges moisture to each of front and rear sides of a sheet, applying rollers 801 and 802, and controlling members 822 and 822. A mechanism similar to that of FIG. 42 is employed in this case except for a configuration of the water jet nozzles 810 and 810 for applying moisture to the applying rollers 801 and 802.

The water jet nozzles 810 and 810 apply moisture to surfaces of the applying rollers 801 and 802. The controlling member 822 makes pressed contact with the applying roller 802 to control the water supply amount. However, the controlling member 822 may be drivenly rotated by the applying roller 802 or may make pressed contact without rotation. In addition, a pressure of the pressed contact of the controlling member 822 is suitably set.

In this manner, by controlling the water supply amount to the applying rollers 801 and 802 using the controlling members 822 and 822, a conveyed sheet P is suitably moistened. For this reason, it is possible to reduce a difference of the length between the sheet widthwise center portion and sheet widthwise edge portion using the tensioning device 101.

In the portion for moistening a sheet in a mist-like manner, an evaporation method or a vapor method may be employed instead of the water jet nozzle. In the evaporation method, moistening is performed by evaporating water at a room-temperature. In this method, controllability is worse than the spray method. However, energy consumption can be reduced. In the vapor method, moisture is boiled through electric heating, and steam is discharged/diffused using a fan to moisten a sheet. In this method, energy consumption is not negligible. However, control is simple, and excellent moistening efficiency can be obtained.

As a configuration for applying a liquid on a single or both sides of a sheet P, the applying rollers of Embodiment 1 may be arranged to face each other, and water may be selectively applied to one or both sides of a sheet.

Similarly, in this embodiment, the moisture application amount in the sheet widthwise center portion increases by setting the moisture amount in the sheet widthwise center portion to be larger than that of both edge portions. Therefore, the hydrogen bonding between fibers in the sheet center portion is separated in advance so that elongation/contraction of a sheet in the sheet center portion is facilitated by applying a tension. As a result, it is possible to facilitate equalization of the length between the sheet edge portion and the sheet center portion and more effectively correct an edge corrugation.

Embodiment 8

An image forming apparatus having a sheet processing apparatus according to embodiment 8 will be described with reference to FIGS. 44 to 50. In the following description, the image forming apparatus will be described first and a sheet processing apparatus will then be described. In Embodiment 8, a description will be made for an image forming system in which a sheet processing apparatus is connected to the outside of the image forming apparatus. However, the invention is also effectively applicable to an image forming system having a sheet processing apparatus integrated into the inside of the image forming apparatus.

Figure 44:
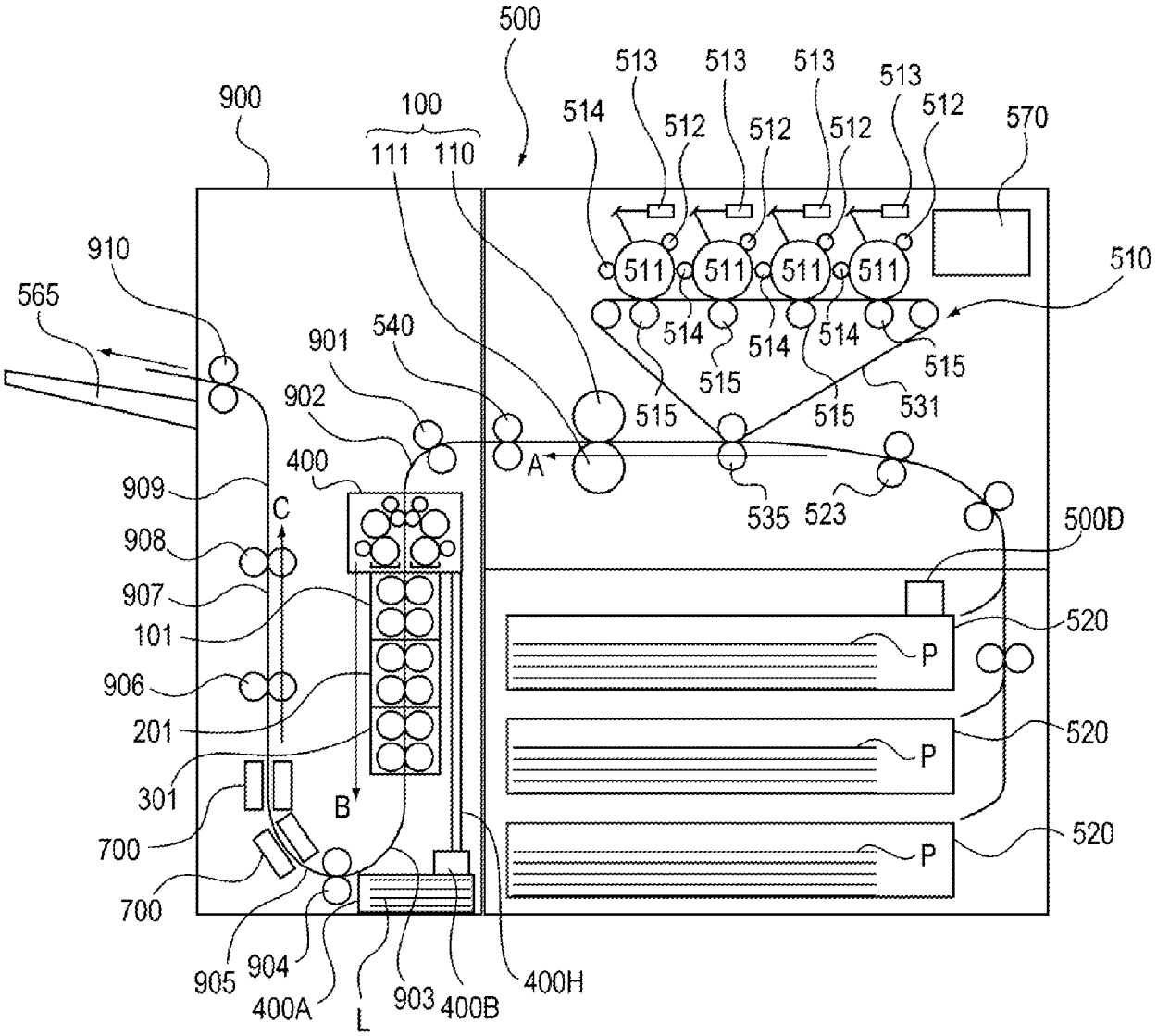
FIG. 44 is a cross-sectional view illustrating an electrophotographic printer in Embodiment 8.

First, a description will be made for an image forming apparatus as an example of an image forming system and a sheet processing apparatus detachably attached to the image forming apparatus with reference to FIG. 44. FIG. 44 is a cross-sectional view schematically illustrating a color electrophotographic printer 500 as an example of the image forming apparatus and a sheet corrugation correcting device 900 having a moisture adding device and a tensioning device as an example of the sheet processing apparatus along a sheet feeding direction. Note that the color electrophotographic printer will be simply referred to as a "printer" in the following description.

A toner image is formed on a sheet. Specifically, the sheet may include, for example, a plain paper sheet, a resin sheet as a substitute of the plain paper sheet, a thick paper sheet, an overhead projector applicable sheet, and the like.

The printer 500 of FIG. 44 has the same configuration as that of the printer 500 described in conjunction with FIG. 1 in Embodiment 1. Therefore, like reference numerals denote like elements, and a description thereof will not be repeated in detail here.

In the printer 500 of FIG. 44, the sheet P having the toner image fixed by the fixing device 100 is fed to the sheet corrugation correcting device 900 by a pair of discharge rollers 540. The sheet P is conveyed along a conveyance guide 902 by a pair of entrance rollers 901 of the sheet corrugation correcting device 900, and the conveyance direction is changed to a vertically downward direction (arrow direction B in FIG. 44) by the conveyance guide 902. Then, the sheet P is fed to a sheet moistening device 400 as a moisture adding device (moisture adding unit). Here, the sheet P is moistened by a pair of moistening rollers 401 and 402.

Subsequently, the sheet P discharged from the sheet moistening device 400 is sequentially conveyed to sheet tensioning conveyance devices 101, 201, and 301 as a tensioning device. The sheet P is moistened by the sheet moistening device 400 at a predetermined moisture amount or more. Then, the sheet P sequentially passes through the sheet tensioning conveyance devices 101, 201, and 301, and the center portion of the width direction perpendicular to the sheet feeding direction is pulled in the sheet feeding direction so as to reduce a length difference between the sheet widthwise edge portion and the sheet widthwise center portion in the sheet feeding direction.

The sheet P obtained by correcting a corrugation in the sheet widthwise edge portion in this manner is fed by a pair of controlling rollers 904 while a conveyance direction is changed to a vertically upward side (arrow direction C in FIG. 44) using the conveyance guides 903 and 905, so that a sheet is fed to a sheet drying device 700. In the sheet drying device 700, the sheet P is dried.

The dried sheet P is conveyed by a pair of conveying rollers 906 and 908 while it is guided by the conveyance guide 907 and 909. Then, the sheet P is discharged to the outside of the sheet corrugation correcting device 900 by a pair of discharge rollers 910 and is loaded on the discharge tray 565.

It is noted that, in FIG. 44, a moistening liquid L for moistening the sheet P is stored in a reservoir 400A. The moistening liquid L stored in the reservoir 400A is occasionally supplied to liquid supply baths 411 and 412 provided in the sheet moistening device 400 using a pump 400B through a liquid supply pipe 400C. The moistening liquid L contains water as a main component.

Figure 45:
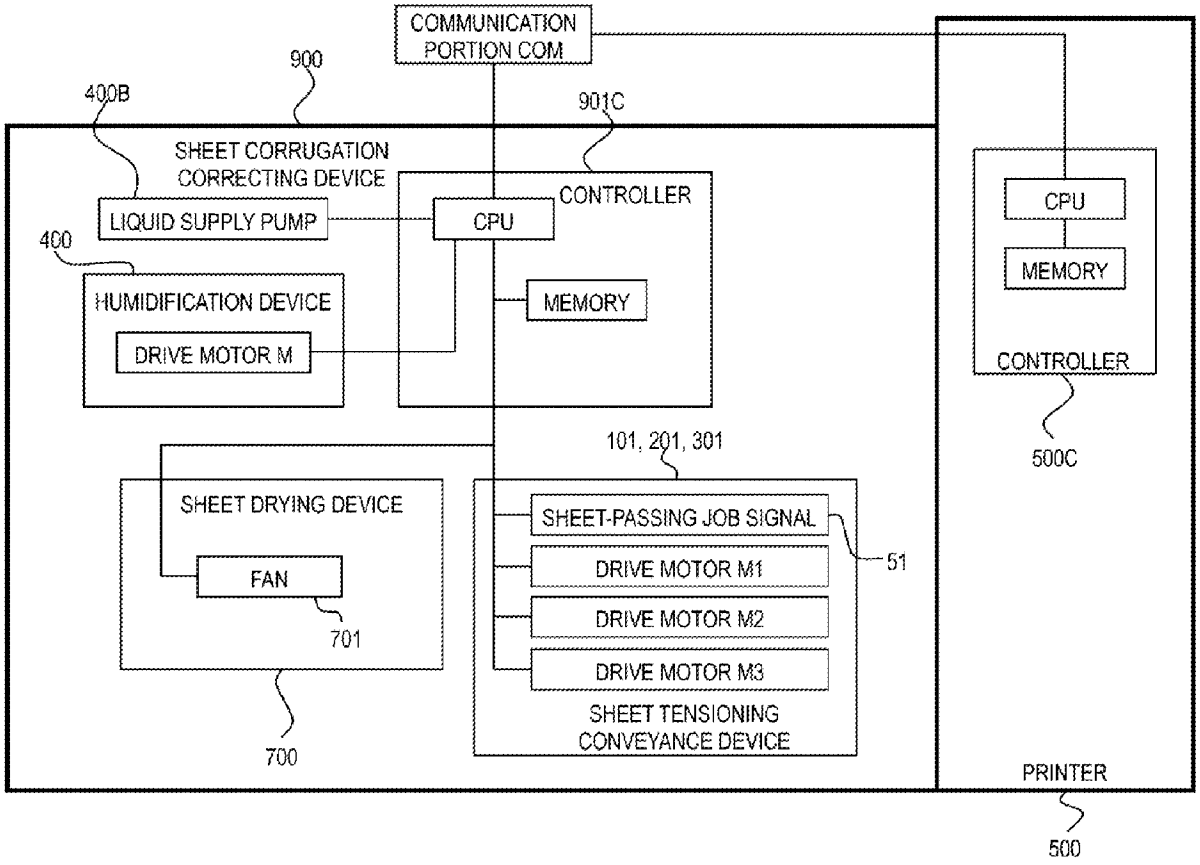
FIG. 45 is a block diagram illustrating control of a printer and a sheet corrugation correcting device in Embodiment 8.

Here, a control relationship in the entire image forming system will be described with reference to FIG. 45. FIG. 45 is a block diagram illustrating a control relationship in the entire image forming system including the printer 500 and the sheet corrugation correcting device 900. A computer system having a CPU, a memory, an operational unit, an input/output (I/O) port, a communication interface, a driving circuit, and the like is employed in a controller 500C of the printer 500 and a controller 901C of the sheet corrugation correcting device 900.

Control operations of each controller 500C and 901C described above are performed by causing the CPU to execute a predetermined program stored in the memory. The controller 901C of the sheet corrugation correcting device 900 controls the operations of the sheet moistening device 400, the sheet tensioning conveyance devices 101, 201, and 301, and the sheet drying device 700 included in the apparatus. In addition, the controllers 500C and 901C described above are connected to each other using a communication portion COM to exchange information.

In the sheet corrugation correcting device 900, the sheet moistening device 400 has the same configuration as that of the sheet moistening device 400 described above in conjunction with FIG. 3 in Embodiment 1. Therefore, like reference numerals denote like elements, and a description thereof will not be repeated in detail here.

Figure 46:
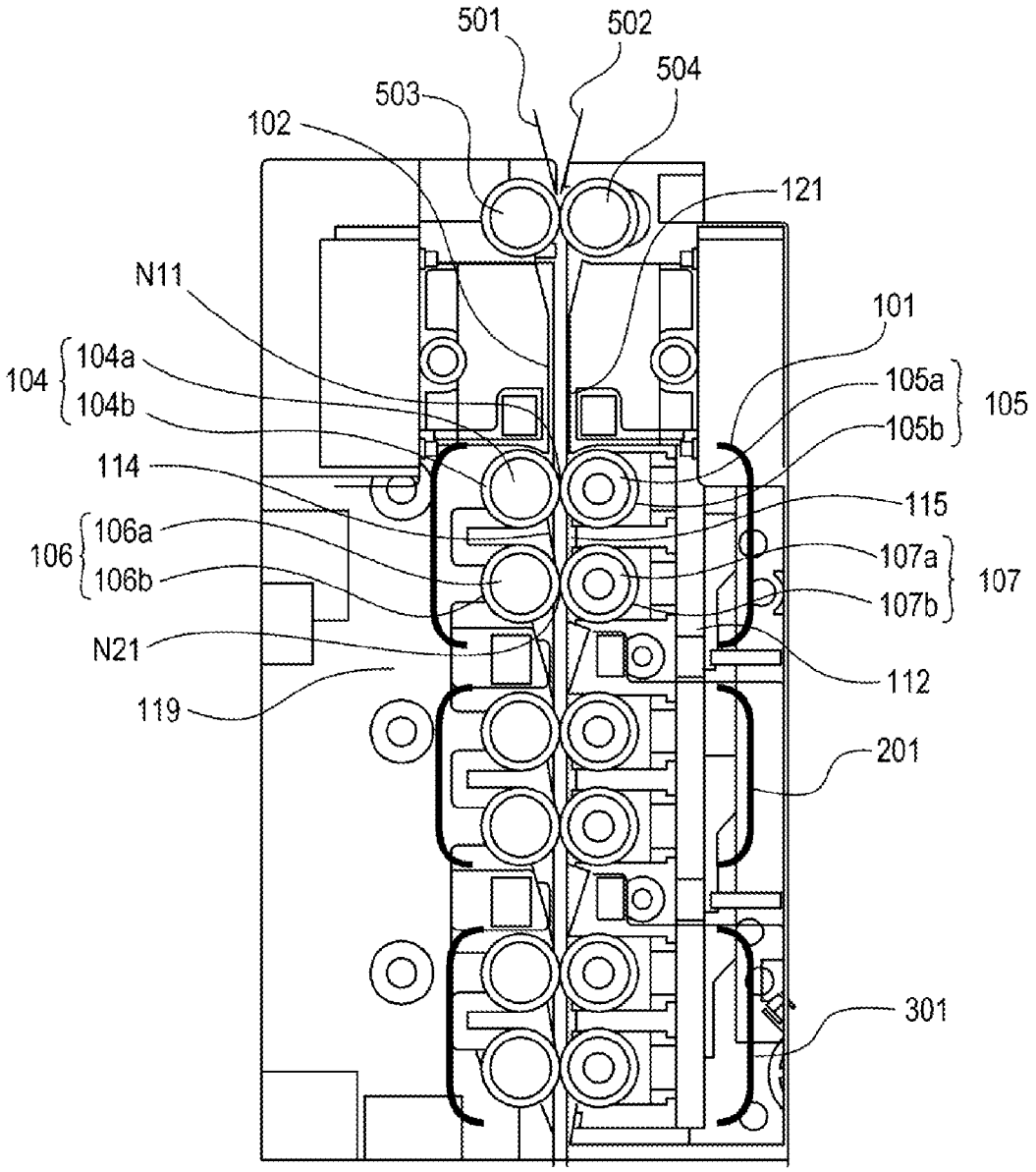
FIG. 46 is a cross-sectional view illustrating a tensioning conveyance device and a curl correcting device in Embodiment 8.

Similarly, in the sheet corrugation correcting device 900, the sheet tensioning conveyance devices 101, 201, and 301 have the same configurations as those of the sheet tensioning conveyance devices 101, 201, and 301 described above in conjunction with FIGS. 3 to 6 in Embodiment 1. Therefore, like reference numerals denote like elements, and a description thereof will not be repeated in detail here. It is noted that, although the sheet tensioning conveyance devices 101, 201, and 301 and the curl correcting device 600 are illustrated in FIG. 4 in Embodiment 1, the sheet corrugation correcting device 900 of this embodiment does not have a curl correcting device. Therefore, a configuration thereof is illustrated in FIG. 46. It is noted that the sheet tensioning conveyance devices 101, 201, and 301 of FIG. 46 have the same configurations as those of the sheet tensioning conveyance devices 101, 201, and 301 of FIG. 4. Therefore, like reference numerals denote like elements, and a description thereof will not be repeated in detail here.

Figure 47:
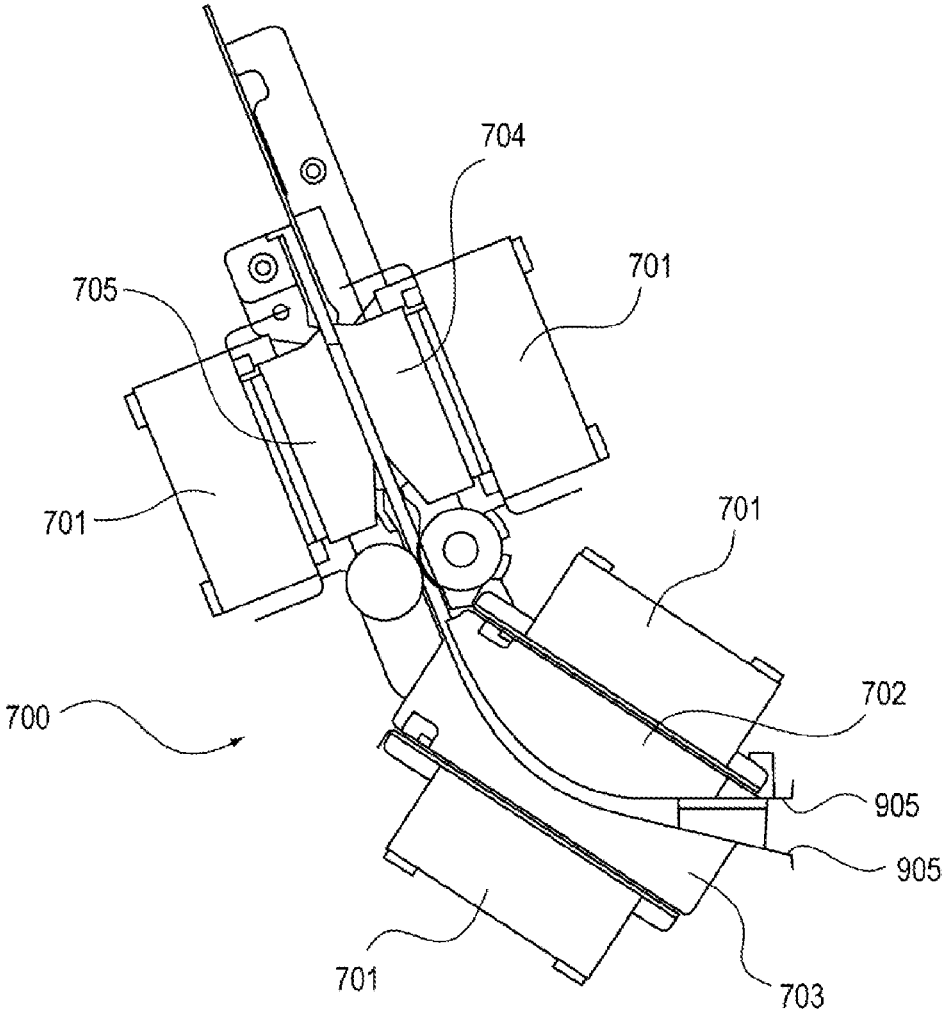
FIG. 47 is cross-sectional view illustrating the curl correcting device in Embodiment 8.
Figure 48:
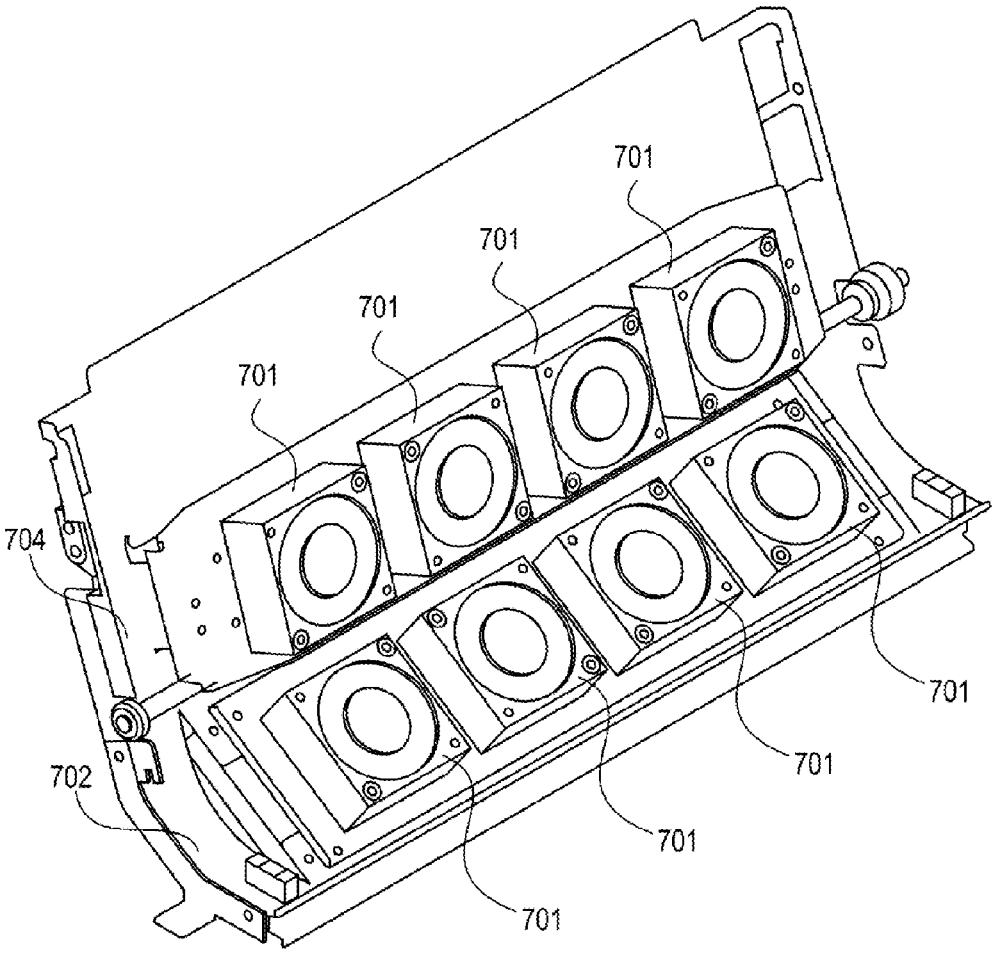
FIG. 48 is a perspective view illustrating surroundings of a fan of the curl correcting device in Embodiment 8.
Figure 49:
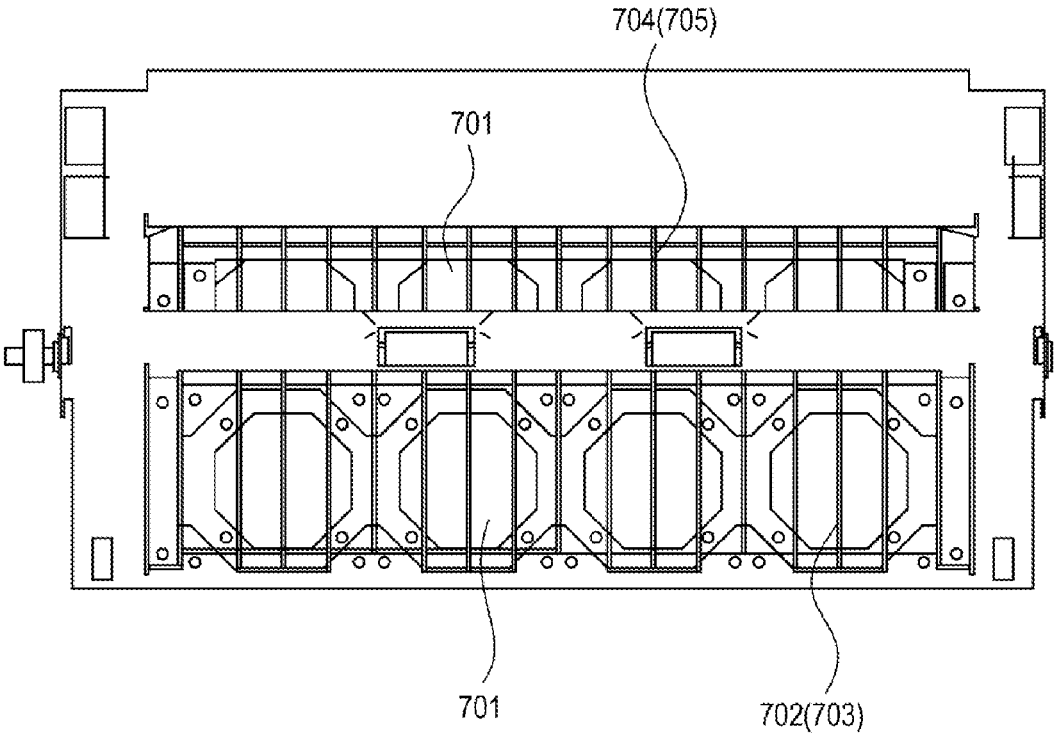
FIG. 49 is a rear view illustrating surroundings of the fan of the curl correcting device in Embodiment 8.

Next, the sheet drying device 700 of the sheet corrugation correcting device 900 will be described with reference to FIGS. 47, 48, and 49. FIG. 47 is a front cross-sectional view illustrating the sheet drying device 700. FIG. 49 is a perspective view illustrating the sheet drying device 700. FIG. 49 is a left side view illustrating the sheet drying device 700.

As described above, the sheet P obtained by correcting a corrugation in the edge portion of the sheet width direction is fed to the sheet drying device 700 by a pair of conveying rollers 904 while it is guided by the conveyance guides 903 and 905.

The moisture amount of the sheet P discharged from the sheet tensioning conveyance devices 101, 201, and 301 is approximately 7%, which is higher than a sheet moisture amount of 5.5% under a typical atmosphere. As described above, if a sheet is discharged to the outside of the apparatus after a corrugation is corrected while the sheet moisture amount is large, the sheet is slowly dried from an upper surface of the discharged sheet, and the sheet may be curled to the upper surface side due to such a drying process.

In this regard, in order to address the aforementioned problem in this embodiment, the sheet drying device 700 is provided in the downstream side of the sheet tensioning conveyance devices 101, 201, and 301 as illustrated in FIG. 44.

In the sheet drying device 700, fan guides 702 and 704 are installed in upper surface sides of a pair of conveyance guides 905, and fan guides 703 and 705 are installed in lower surface sides of the fan guides 702 and 704 as illustrated in FIG. 47. A fan 701 is installed in each fan guide. That is, the fan 701 is installed in each of one surface side and the other surface side of a sheet by interposing a sheet feeding path. As illustrated in FIG. 48, four fans 701 are installed in a depth direction of FIG. 47 (width direction perpendicular to the sheet feeding direction) so that a total of 16 fans are arranged in the upper and lower surface sides. In addition, as illustrated in FIG. 49, the fan guides 702 and 704 are rib guides having holes where the air of the fan 701 can pass. Although only the upper surface side is illustrated in FIG. 49 for description purposes, the fan guides 703 and 705 in the lower surface side have the same rib guide shape.

All of the fans 701 are turned on immediately before a sheet passes. The fans 701 are turned off as a sheet passing job is terminated. This operation of the fans 701 is controlled by the controller 901C of FIG. 45.

With reference to FIG. 8, a description will be made for a shape characteristic of a curl or an edge corrugation generated in a sheet P and a measurement method. A sheet P passing through only the nip portion N of the fixing device 100 or a sheet P passing through the nip portion N of the fixing device 100, and then continuously through the sheet tensioning conveyance devices 101, 201, and 301, and the curl correcting device 600 is loaded on a measurement table 650 as illustrated in FIG. 8. Here, "L edge [mm]" denotes an edge length of a sheet P in a sheet feeding direction, and "L center [mm]" denotes a center length.

A wave shape Pwave generated in the upper or lower side of the sheet P of FIG. 8, that is, the edge of the width direction perpendicular to the sheet feeding direction will be referred to as an edge corrugation. As an evaluation target, the largest one X max of gaps from the measurement table 650 is set as a corrugation length, and the largest one Y max of distances between four corners of a sheet P and the measurement table 650 is set as a maximum curl amount.

FIG. 50 illustrates a result of the experiment for checking effects of the tensioning device and the sheet drying device performed by the inventors according to Embodiment 8.

As an experimental condition, it is assumed that a sheet moisture amount immediately after a sheet passes through the sheet moistening device 400 is 7%. In addition, it is assumed that the atmospheric humidity is 50%.

In this embodiment, the inventors measured the sheet moisture amount immediately after the sheet P passes through the sheet corrugation correcting device 900 and is discharged to the discharge tray 565. In this embodiment, a microwave type paper moisture amount meter is used.

The edge length L edge [mm], the center length L center [mm], the maximum corrugation amount X max [mm], and the maximum curl amount Y max [mm] are measured for each sheet P after the sheet P passes through the sheet corrugation correcting device 900. FIG. 50A shows the result of measurement when a sheet P does not pass through the sheet corrugation correcting device 900 immediately after the sheet P passes through the fixing device 100. FIG. 50B shows the result of measurement when the fan 701 of the sheet drying device 700 is turned off. FIG. 50C shows the result of measurement when a sheet P passes through the sheet corrugation correcting device 900 while the fan 701 of the sheet drying device 700 is turned on.

As illustrated in FIG. 50A, while an elongation amount of the center length L center immediately after a sheet P passes through the fixing device is 0 mm, an elongation amount of the edge length L edge is 0.6 mm, so that the edge length is longer than the center length by 0.6 mm. As a result, the maximum corrugation amount X max is 3.3 mm, which is significant. In addition, the maximum curl amount Y max is 5.0 mm. The sheet moisture amount immediately after a sheet is discharged from the sheet corrugation correcting device 900 is 4.0%.

As illustrated in FIG. 50B, when the fan 701 of the sheet drying device 700 is turned off, the center length L center of a sheet P elongates by 0.6 mm, which indicates that a sufficient pulling effect is obtained. In addition, the maximum corrugation amount X max is 1.0 mm, which is reduced by ⅓. However, the maximum curl amount Y max increases to 10 mm. In this case, the sheet moisture amount immediately after a sheet is discharged from the sheet corrugation correcting device 900 is 7.0%.

As illustrated in FIG. 50C, when the fan 701 of the sheet drying device 700 is turned on, the center length L center of a sheet P elongates by 0.6 mm, which indicates that a sufficient pulling effect is obtained. In addition, the maximum corrugation amount X max decreases to 1.0 mm, and the maximum curl amount Y max is improved to 1.0 mm. In this case, the sheet moisture amount immediately after a sheet is discharged from the sheet corrugation correcting device 900 is 5.5%.

As described above, it is observed that both a corrugation and a curl can be corrected by arranging the curl correcting device 700 in the downstream side of the sheet tensioning conveyance devices 101, 201, and 301 in the sheet feeding direction. In this case, a curl direction or a curl correction amount is known through an experiment in advance based on a sheet surface where a toner is transferred, a toner density, a sheet moistening amount, and the like. Therefore, a fan 701 and an air volume of the fan 701 can be selected for each sheet depending on a curl direction.

That is, a curl can be adjusted for each sheet depending on sheet information transmitted to a controller having a CPU and a memory in the image forming apparatus, image density information of a toner image on a sheet P having an image, and information about a temperature, a humidity, and a moistening amount from the atmospheric sensor 500D.

Since a curl and a corrugation on a sheet are corrected in this manner, it is possible to prevent a conveyance error such as a jam, stably convey a sheet, and obtain excellent loadability on a sheet discharge tray.

It is noted that, although a description has been made for a configuration in which the fan 701 is provided in the sheet drying device 700 in this embodiment, the invention is not limited thereto. For example, a drier having a heater in the fan may be employed in order to enhance a drying capability. In addition, a sheet may be dried by feeding a sheet while a heating roller makes contact with a surface of the sheet.

Other Embodiments

Although, in the aforementioned embodiment, a description has been made for the moisture adding unit adds more moisture to the sheet widthwise center portion than both edge portions, moisture may be added only to the center portion without adding moisture to both sheet widthwise edge portions. In this configuration, similar to the aforementioned embodiments, it is possible to reduce a corrugation of a sheet more effectively.

Although, in the aforementioned embodiments, a description has been made for the tensioning device integrated into the image forming apparatus, the invention is not limited thereto. For example, the tensioning device may be detachably attached to the image forming apparatus as an optional external device. It is possible to obtain similar effects in the entire image forming system by applying the invention to this tensioning device. In addition, although a description has been made for a configuration in which the operation of the tensioning device is controlled by a control unit provided in the image forming apparatus, the tensioning device may have a control unit, and the operation may be controlled by this control unit. Alternatively, the control unit of the tensioning device may be controlled by a control unit of the image forming apparatus in order to control the operation of the tensioning device. It is possible to obtain similar effects even when such a configuration is employed.

Although a description has been made for a printer as the image forming apparatus in the aforementioned embodiment, the invention is not limited thereto. For example, the invention may be applied to other image forming apparatuses such as a copying machine, a facsimile, or a multi-function peripheral having such functionalities. In addition, although a description has been made for an image forming apparatus in which an intermediate transfer member is employed, and toner images of each color is transferred onto the intermediate transfer member in a sequentially superimposed manner so that the toner images borne in the intermediate transfer member are collectively transferred onto a sheet, the invention is not limited thereto. For example, the invention may also apply to an image forming apparatus having a configuration in which a sheet bearing member is employed, and toner images of each color are transferred onto a sheet borne in the sheet bearing member. It is possible to obtain similar effects when the present invention is applied to the image forming apparatus or the tensioning device included in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-238500, filed Oct. 30, 2012, which is hereby incorporated by reference herein in its entirety.

The invention claimed is:

1. A sheet processing apparatus comprising:

a first roller;

a driving member that has a drive source for generating a driving force and which rotates the first roller by the driving force of the drive source;

a first opposite roller that forms a first nip portion along with the first roller;

a second roller provided on a downstream side in a sheet feeding direction from the first roller;

a second opposite roller that forms a second nip portion along with the second roller; and a load unit that applies a load torque to the first roller, wherein at least one of the first nip portion and second nip portion is shorter than a maximum length of a sheet that can be conveyed in a main body of the apparatus in a width direction perpendicular to the feeding direction, and the load unit applies a tension in the sheet feeding direction to the sheet fed between the first and second nip portions after the sheet fed by the first nip portion is nipped in the second nip portion.

2. The sheet processing apparatus according to claim 1, wherein the first and second nip portions are provided in a center area of the fed sheet in the width direction.

3. The sheet processing apparatus according to claim 1, further comprising a drive control unit that controls the driving member, wherein the drive control unit prevents a driving force of the drive source from being transmitted to the first roller after the sheet fed by the first nip portion is nipped in the second nip portion.

4. The sheet processing apparatus according to claim 3, wherein the drive control unit has a clutch which prevents a driving force of the drive source from being transmitted to the first roller.

5. The sheet processing apparatus according to claim 1, wherein said driving member is a first driving member, and further comprising a second driving member that rotates the second roller, wherein a circumferential velocity of the second roller rotated by the second driving member is faster than a circumferential velocity of the first roller rotated by the first driving member.

6. The sheet processing apparatus according to claim 1, further comprising a one-way clutch provided between the drive source and the first roller.

7. The sheet processing apparatus according to claim 1, wherein the load unit has a torque limiter.

8. The sheet processing apparatus according to claim 1, wherein a length in the width direction of at least one of the first roller, the first opposite roller, the second roller, and the second opposite roller is shorter than the maximum length of the width direction of the sheet.

9. The sheet processing apparatus according to claim 1, wherein, in an outer diameter of at least one of the first roller, the first opposite roller, the second roller, and the second opposite roller, a center portion of a rotational axis direction is larger than an edge portion of the rotational axis direction.

10. The sheet processing apparatus according to claim 1, further comprising a pressure release unit that releases a pressure of the first opposite roller applied to the first roller, wherein the first opposite roller has a pressure release state to the first roller by the pressure release unit before a sheet is nipped in the second nip portion, and the first opposite roller has a pressure state to the first roller by the pressure release unit after a sheet is nipped in the second nip portion.

11. The sheet processing apparatus according to claim 1, further comprising a sheet detection unit that detects a sheet with a predetermined distance toward an upstream side in a sheet feeding direction from the second nip portion, wherein it is determined whether or not a sheet is nipped in the second nip portion based on a predetermined distance from the sheet detection unit to the second nip portion and a feeding velocity of the sheet.

12. The sheet processing apparatus according to claim 1, further comprising a moisture adding unit that adds moisture to a sheet, wherein the moisture adding unit is arranged on an upstream side of the sheet in a sheet feeding direction from the first and second rollers.

13. The sheet processing apparatus according to claim 12, wherein the moisture adding unit adds more moisture to a center portion of a width direction perpendicular to the sheet feeding direction than both edge portions.

14. The sheet processing apparatus according to claim 12, wherein the moisture adding unit adds moisture only to a center portion of a width direction perpendicular to the sheet feeding direction.

15. The sheet processing apparatus according to claim 12, wherein the moisture adding unit has an applying roller that applies a liquid to a sheet and has a liquid retaining member that retains a liquid in a liquid retaining space formed to abut on the applying roller, and a liquid supplied to a surface of the applying roller is applied from the liquid retaining member by rotating the applying roller.

16. The sheet processing apparatus according to claim 12, further comprising a conveyance path that guides a sheet approximately vertically from an upper side to a lower side, wherein the moisture adding unit and the first roller and second roller are sequentially arranged in the conveyance path.

17. The sheet processing apparatus according to claim 1, further comprising a curl correction unit that corrects a curl in a sheet, wherein the curl correction unit is arranged on a downstream side in the sheet feeding direction from the second roller.

18. The sheet processing apparatus according to claim 17, wherein the curl correction unit corrects a curl by nipping and conveying a sheet through a curved nip portion formed by causing an elastic roller and a rigid roller to make pressed contact.

19. The sheet processing apparatus according to claim 17, wherein the curl correction unit corrects a curl by nipping and conveying a sheet in a curved nip portion formed by causing an endless belt stretching around a plurality of rollers and a rigid roller to make pressed contact.

20. The sheet processing apparatus according to claim 17, wherein the curl correction unit has a first curl correcting portion that corrects a curl protruding toward one surface side of a sheet and second curl correcting portion that corrects a curl protruding toward the other surface side of the sheet.

21. The sheet processing apparatus according to claim 1, further comprising a sheet drying unit that dries a sheet, wherein the sheet drying unit is arranged on a downstream side in the sheet feeding direction from the second roller.

22. The sheet processing apparatus according to claim 21, wherein the sheet drying unit is a fan.

23. The sheet processing apparatus according to claim 21, wherein the sheet drying unit is a drier having a fan and a heater.

24. The sheet processing apparatus according to claim 21, wherein the sheet drying unit is provided in each of one surface side and an other surface side of a sheet.

25. An image forming system comprising:

an image forming apparatus having a transfer portion that transfers a toner image onto a sheet and a fixing portion that fixes the transferred toner image on a sheet by heating the transferred toner image; and a sheet processing apparatus that is detachably connected to the image forming apparatus and performs a processing for the sheet discharged from the image forming apparatus, wherein the sheet processing apparatus is the sheet processing apparatus according to claim 1.

* * * * *